United States Patent [19]

Wachi et al.

[11] Patent Number: 4,554,858

[45] Date of Patent: Nov. 26, 1985

[54] DIGITAL FILTER FOR AN ELECTRONIC MUSICAL INSTRUMENT

[75] Inventors: Masatada Wachi; Mitsumi Katoh, both of Hamamatsu, Japan

[73] Assignee: Nippon Gakki Seizo Kabushiki Kaisha, Hamamatsu, Japan

[21] Appl. No.: 520,232

[22] Filed: Aug. 4, 1983

[30] Foreign Application Priority Data

Aug. 13, 1982 [JP] Japan ..... 57-140551
Sep. 14, 1982 [JP] Japan ..... 57-158871

[51] Int. Cl.[4] ..... G10H 1/12

[52] U.S. Cl. ..... 84/1.19; 84/1.22; 84/DIG. 9; 328/167; 333/165; 333/166; 364/724; 381/51

[58] Field of Search ..... 84/1.01, 1.11–1.13, 84/1.19–1.26, DIG. 9; 364/724; 381/51–53, 61, 98–100, 118, 36, 41; 328/167; 333/165, 166

[56] References Cited

U.S. PATENT DOCUMENTS 4,125,900 11/1978 Betts ..... 364/724
4,136,398 1/1979 Eggermont ..... 364/724
4,265,158 5/1981 Takahashi ..... 84/1.22
4,300,435 11/1981 Schmoll, III ..... 84/1.19
4,338,581 7/1982 Morgan ..... 333/165
4,358,737 11/1982 Bennett ..... 328/167 X
4,360,791 11/1982 Norris et al. ..... 333/165
4,377,793 3/1983 Horna ..... 333/165
4,377,794 3/1983 Sakaue et al. ..... 333/165
4,378,469 3/1983 Fette ..... 381/41 X
4,433,604 2/1984 Ott ..... 84/1.19
4,443,859 4/1984 Wiggins ..... 364/724
4,472,993 9/1984 Futamase et al. ..... 84/1.24

*Primary Examiner*—S. J. Witkowski
*Attorney, Agent, or Firm*—Spensley Horn Jubas & Lubitz

[57] ABSTRACT

A digital filter imparting a desired tone color to the tone signal is realized by the combination of a digital pole filter and a digital zero filter capable of controlling a pole and a zero in an amplitude-frequency characteristic respectively. The amplitude-frequency characteristic of the digital filter is a composite of the respective characteristics of the pole filter and the zero filter. A "peak" portion and a "valley" portion in this composite characteristic can be set independently by the pole control of the pole filter and the zero control of the zero filter, whereby the desired tone color characteristic can be readily realized. Further, the digital filter may comprise a plurality of digital filters having respective different constructions and a connection switching circuit capable of setting arbitrarily connection between these filters. The filter characteristic as a whole can be diversely altered by changing the connection, whereby diverse tone color characteristics can be realized with ease.

20 Claims, 35 Drawing Figures

DIGITAL FILTER FOR AN ELECTRONIC MUSICAL INSTRUMENT

BACKGROUND OF THE INVENTION

This invention relates to a digital filter for an electronic musical instrument and, more particularly, to a digital filter employing a pole filter capable of controlling a pole of amplitude-frequency characteristic and a zero filter capable of effecting zero control in combination, and further to a digital filter employing filters of different constructions in switchable combinations.

A tone color circuit in an electronic musical instrument which requires subtle characteristics have heretofore been constituted mostly of an analog circuit. An analog tone color circuit (particularly an analog filter), however, tend to become a large circuit. This is particularly the case when a tone color requiring a fixed formant (e.g., a human voice, wind instruments such as oboe and bassoon, piano and string instruments) must be realized, for a large number of analog filter circuits must be provided in parallel resulting in a circuit design of a large scale system. Further, since a digital tone signal cannot be applied directly to the analog tone color circuit, this type of circuit requires a further complicated circuitry if a digital tone generation circuit is to be combined to the analog tone color circuit.

To cope with this problem, an attempt has recently been made to employ a digital filter for a tone color circuit of an electronic musical instrument. According to the digital filter, a digital tone signal generated by a digital tone generation circuit can be applied directly and in addition, a simultaneous processing of plural tone signals can be attained on a time shared basis with a relatively small hardware construction. Hence, the digital filter is much more economical than the analog tone color circuit. In the digital filter, it is generally difficult to set a coefficient so as to obtain a desired amplitude-frequency characteristic. Particularly in the electronic musical instrument, a high fidelity realization of a desired fixed formant requires skilled controlling of locations (bands) and levels of "peak" and "valley" in the filter amplitude-frequency characteristic and this is very difficult to realize by simply applying a digital filter to a tone color circuit of an electronic musical instrument. There are several known basic types of digital filter but they are only capable of performing a control which is mainly directed either to the pole or zero and none of them is capable of simultaneously controlling both pole and zero skilfully and readily. In a digital filter of a type capable of mainly controlling the pole, for example, a plurality of poles are formed in different frequency regions and a valley portion is obtained only as a result of overlapping skirt portions of peaks thus formed. In this case, it is very difficult to set the location and level of the valley portion to desired states.

It is, therefore, an object of the present invention to provide a digital filter suitable for use in an electronic musical instrument which is capable of controlling relatively easily both the peak and valley portions in the amplitude-frequency characteristic.

The "peak" characteristic herein means an amplitude-frequency characteristic forming a pass band in the vicinity of the frequency corresponding to a pole, the "valley" characteristic an amplitude-frequency characteristic forming a stop band in the vicinity of the frequency corresponding to zero.

As described above, there are several basic types in the digital filter and digital filters of various constructions can be designed on the basis of these basic types. For example, one digital filter of the same basic type as another can be made a digital filter of a different construction by providing it with a different number of operation stages. If the basic type is different, a digital filter is naturally of a different construction. In utilizing a digital filter as a tone color circuit of an electronic musical instrument, it is desirable to employ a digital filter of a construction most suitable for the purpose of the tone color control. Since, however, a digital filer of a fixed construction cannot be selectively changed, there is the inconvenience that once a filter of a certain construction has been provided in a tone color circuit, it cannot be readily changed. Further, digital filters of various constructions are required depending upon the type of an electronic musical instrument. If a large number of digital filters of different constructions are prepared for each of various types of electronic musical instruments, this will be extremely uneconomical in the aspect of the manufacturing cost.

It is, therefore, another object of the present invention to provide a digital filter suitable for use in an electronic musical instrument which is capable of selectively realizing digital filters of various constructions by a single set of digital filter device.

It is still another object of the invention to provide a digital filter for an electronic musical instrument which is capable of selectively realizing various filter constructions by combining plural sets of digital filter devices of a common hardware construction and selectively switching the filter constructions of the respective filter devices, and which is also capable of contributing to reduction of the manufacturing cost by the unification of the hardware construction of the respective filter devices.

SUMMARY OF THE INVENTION

The first object of the present invention is achieved by a digital filter which is a combination of a digital type pole filter capable of mainly controlling the pole in the amplitude-frequency characteristic and a digital type zero filter capable of mainly controlling zero in the amplitude-frequency characteristic. The peak portion and the valley portion in a desired amplitude-frequency characteristic (fixed formant) to be realized are separately and independently considered and the characteristic of the peak portion is set by the pole filter whereas the characteristic of the valley portion is set by the zero filter. A digital tone signal which have passed through the pole filter and zero filter combined, for example, in series is controlled by the amplitude-frequency characteristics of the two filters and, as a result, a filter control is made in accordance with a fixed formant having the desired peak and valley characteristics. According to the invention, coefficients may be set in such a manner that, with respect to the pole filter, the pole is produced at a desired frequency and at a desired level and, with respect to the zero filter, zero is produced at a desired frequency and at a desired level. Since settings of the coefficients for the pole and zero are thus made independently, these coefficients may be readily set and both the peak and valley portions in the amplitude-frequency characteristic can be relatively easily controlled to desired states.

The pole filter herein is defined as a filter in which a denominator of Z-converted transfer function is a polynominal of Z and a numerator thereof is a constant. Likewise, the zero filter herein is defined as a filter in which a numerator of Z-converted transfer function is a polynominal of Z and a denominator thereof is a constant.

In a preferred embodiment of the invention, the pole filter is constituted of an infinite impulse response filter (IIR filter) and the zero filter by a finite impulse response filter (FIR filter). The pole filter may be advantageously constituted of a lattice-type filter among infinite impulse response filters.

The second object of the invention is achieved by a digital filter device comprising a plurality of digital filters of different constructions and connection switching means capable of setting combinations of connections between these digital filters and selectively switching these combinations of connections in response to a selection signal. The filter construction of this digital filter as a whole represents a switchable combination of respective digital filter components of different constructions in accordance with the combinations of connections by the connection switching means so that various combinations can be realized.

The combinations of connections by the connection switching means may be fixed or semi-fixed at a selected combination in accordance with the purpose of control or may be changed at any desired time by a switch operation. Employment of digital filters of different basic types as digital filter components is effective. For example, the digital filter device comprises a pole filter capable of mainly controlling the pole in the amplitude-frequency characteristic and a zero filter capable of mainly controlling zero in the amplitude-frequency characteristic. Alternatively, filters of the same basic type may be made of a different construction by differing their operation stages and the digital filter device may comprise a plurality of these filters. Various combinations of connections can be conceived such as a combination of a pole filter provided in a forward stage and a zero filter provided in a post stage. a reverse combination of a zero filter and a pole filter, a combination of zero filters only, a combination of pole filters only, a combination of pole filters (or zero filters) of different stages connected in series, a combination of a pole filter and a zero filter connected in parallel and a combination of pole filters (or zero filters) connected in parallel. Infinite impulse response filters (IIR filters) or finite impulse response filters (FIR filters) other than the pole filter and zero filter may also be used as the digital filter of this invention.

The third object of the invention is achieved by a digital filter system which comprises a plurality of filter composites each including digital filters of different constructions and connection switching means for selectively switching the combination of connection between these digital filters in response to a selection signal and in which the combination of connection between the digital filter components in each composite is set as desired by the connection switching means of each composite and various filter constructions can thereby be realized selectively.

For example, one filter composite comprises a pole filter and a zero filter and the combination of connection between them can be switched. By way of example, a combination of the zero filter provided in the forward stage and the pole filter in the post stage is selected in a first filter composite whereas a combination of the pole filter provided in the forward stage and the zero filter in the post stage is selected in a second filter component connected serially to the first filter composite. By this arrangement, a filter construction of a zero filter, pole filter, pole filter and zero filter connected in series in the order shown is virtually realized. If, for example, third filter composite in which a combination of connection selecting only a pole filter is selected is inserted between the first filter composite and the second filter composite, a filter construction of a zero filter, pole filter, pole filter, pole filter and zero filter connected in series in the order shown can be realized. The first through third filter composites may be realized by using filter composites of a common hardware construction and switching combinations of connection between filter components in the respective filter composites. Accordingly, it will suffice to manufacture a single type of filter composite in a large scale and, as a result, the manufacturing cost will be greatly reduced.

BRIEF DESCRIPTION OF THE DRAWINGS

In the accompanying drawings,

FIGS. 8(*b*) and 8(*c*) are block diagrams showing equivalent circuits of the lattice-type filter;

FIG. 24(*b*) is a block diagram showing realization of the filter construction shown in FIG. 24(*a*) by employing a single digital filter circuit shown in FIG. 13;

FIG. 25(*b*) is a block diagram showing realization of the filter construction shown in FIG. 25(*a*) by employing two digital filter circuits shown in FIG. 13;

FIG. 26(*b*) is a block diagram showing realization of the filter construction shown in FIG. 26(*a*) by employing three digital filter circuits shown in FIG. 13.

DESCRIPTION OF PREFERRED EMBODIMENTS

Figure 1:
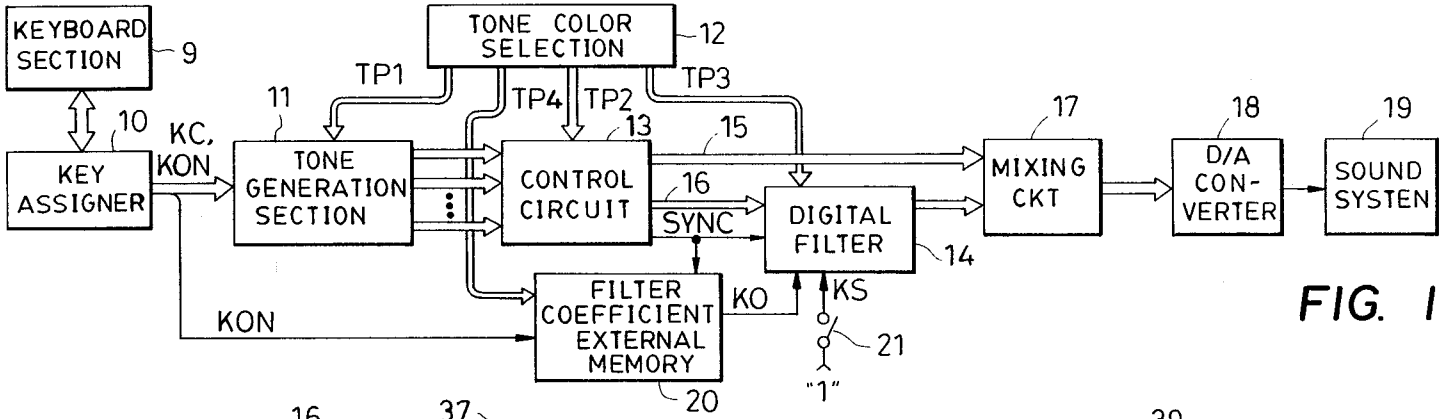
FIG. 1 is an electrical block diagram showing an example of entire construction of an electronic musical instrument incorporating a digital filter made according to the invention.

Referring to FIG. 1, a keyboard section 9 comprises a plurality of keyboards, e.g., an upper keyboard, a lower keyboard and a pedal keyboard, and a key switch circuit including key switches corresponding to keys in these keyboards. A key assigner 10 comprises a circuit for detecting on and off states of the respective key switches in the keyboard section 9 and a circuit for assigning a key corresponding to a key switch which has been turned on, i.e., a depressed key, to available one of a plurality of tone generation channels. A key, code KC which is information representing a key which has been assigned to each of the tone generation channels and a key-on signal KON which is information indicating whether depressiobn of the key is kept on or the key has been released are supplied from the key assigner 10 to a tone generation section 11. The tone generation section generates tone signals corresponding to keys depressed in the keyboard section 9 in response to outputs of the key assigner 10. The generated tone signals are outputted in parallel in a plurality of channels corresponding to the type of keyboard, the tone color and the like. More specifically, the tone generation section 11 has, for the respective keyboards, tone generation channels for tone source corresponding in number to the number of tones to be sounded simultaneously so that tone signals for one or more keys can be generated simultaneously. The tone generation section further has these tone generation channels for tone sources in multiple channels and outputs tone signals of respective channels in parallel and in a digital form.

A tone color selection device 12 includes a number of switches for selecting tone colors and various effects of the respective keyboards. A predetermined output TP1 among outputs of the tone color selection device 12 is applied to the tone generation section 11 to control a tone signal generation operation therein including providing of a tone color to a tone signal to be generated, setting of an amplitude envelope corresponding to the tone color and selection of a tone source waveform and the like. In the tone generation section 11, the tone color providing operation has been completed with respect to some tone signals generated in response to tone selection by the tone color selection device 12 but it has not been completed with respect to other tone signals. As to the tone signals for which the tone color providing operation has not been completed, a tone color control is effected in a digital filter section 14 provided in a post stage. For example the tone colors having a constant spectrum distribution regardless of the tone pitch (i.e., movable formant type tone colors) are provided by the tone generation section 11 whereas fixed formant type tone colors are provided by the digital filter section 14. However, some movable formant type tone colors such as low frequency characteristics of brass tones, complicated characteristics of strings tones, etc. preferably are amended in their spectrum distributions by further subjecting them to the fixed dormant type filter control. The digital filter section 14 may also be used to provide such tone colors.

The digital tone signals on the respective channels outputted from the tone generation section II are applied to a tone signal distribution accumulation and serial conversion control circuit 13. A predetermined output TP2 of the outputs of the tone color selection device 12 is applied to this control circuit 13. In response to the tone color parameter TP2 supplied from the tone color selection device 12, the control circuit 13 sorts out the tone signals for those channels to be accumulated from the tone signals for the other channels to be passed through the digital filter section 14. Then the control circuit 13 accumulates (mixes) those tone signals to be accumulated and outputs them on a line 15 whereas it serializes those parallel digital tone signals for the respective channels to be passed through the digital filter section 14 and outputs on time division multiplex basis the obtained serial digital tone signals by predetermined channels, on a common line. The predetermined channels by which the tone signals are time-division multiplexed mean channels of different keyboards or tone colors. As will be described more fully later, a plurality of tone sources or tone generation channels (hereinafter referred to as "subchannels") are prepared for each tone color to be realized in the present embodiment and the time-division multiplexing operation is not performed between these subchannels. Hence the control circuit 13 outputs, in parallel and for the respective subchannels, serial digital tone signals which have been time-division multiplexed by predetermined channels. These digital tone signals are supplied to the digital filter section 14 through a line 16.

To timewise serialize a plural bits of the digital tone signals and supply them to the digital filter section 14 is advantageous in that the calculation circuit in the filter section 14 can thus be a serial calculation circuit and the filter section may therefore be simple in construction. Further, time division multiplexing the digital tone signals on a plurality of channels so as to put them into a common line obviates the necessity to expressly provide a digital filter for each channel, thereby simplifying the construction of the digital filter section 14. However, the serialization and time-division multiplexing need not necessarily be effected but digital tone signals of plural bits may be applied to the digital filter section 14 in parallel.

The table below gives an example of channels and shows how they are sorted out by the control circuit 13. The "mono/poly" column indicates the distinction between the monophonic tone generation channel and the polyphonic tone generation channel. In the case of the polyphonic tone generation channels, the tone generation section 11 of course adds and mixes the digital tone signals of plural tones and outputs single-channel tone signal. The characters ch1, ch2, ch3, and ch4 in the "distribution" column designate filter channels and are used as reference characters for the respective channels in describing the time-division processing of the tone signals for the respective channels by the digital filter section 14. It should be noted that the filter channels ch1–ch4 herein are entirely different from the tone generation channels for assigning the depressed keys by the key assigner 10 and they are channels for performing a different filter processing.

TABLE 1

| CHANNELS | mono/poly | DISTRIBUTION | |
|---|---|---|---|
| upper keyboard flute (UFL) | poly | | to the accumulators |
| lower keyboard orchestra (LOR) | poly | | |
| pedal keyboard (PKB) | mono | | |
| upper keyboard solo (USL) | mono | ch1 | to the digital filter section |
| upper keyboard special (USP) | poly | ch2 | |
| upper keyboard custom (UCS) | mono | ch3 | |
| lower keyboard special (LSP) | poly | ch4 | |

In channels shown in the column of "CHANNELS" in Table 1, it is possible to select one or more of tone colors from among a plurality of different tone colors. The above described subchannel is provided in each of four channels leading to the digital filter section 14. In "the upper keyboard special", for example, one or more tone colors can be selected from among predetermined types of tone colors and signals (tone source signals) corresponding to the selected tone colors are respectively generated in the respective subchannels.

The tone signals through the line 15 are directly supplied to a mixing circuit 17 while the tone signals through the line 16 are supplied to the mixing circuit 17 through the digital filter section 14. The mixing circuit 17 mixes (digitally adds) the tone signals that were filtered by the digital filter section 14 and the tone signals from the line 15 that were not filtered. Since the filtered tone signals, each signal being bit-parallel, have been serialized, these serial tone signals are converted to parallel signals for the respective channels before said mixing. The digital tone signal outputted from the mixing circuit 17 is converted to an analog signal by a digital to analog converter 18 and supplied to a sound system 19.

The digital filter section 14 comprises a pole filter capable of effectively controlling a characteristic of a peak portion in its filter characteristic and a zero filter capable of effectively controlling a characteristic of a valley portion in the filter characteristic and is capable of changing combination of connection of one filter with the other thereby to realize a complicate filter characteristic. A predetermined output TP3 among outputs of the tone color selection device 12 is supplied to the digital filter section 14 and a filter characteristic (e.g. filter coefficient) for each of the filter channels ch1–ch4 is set in response to the selected tone color. The digital filter section 14 is constructed such that inputted tone signals of the respective subchannels are sorted out in response to the tone color parameter TP3 into signals to be passed through the filter and those not to be passed through it.

For setting the filter characteristic, the filter section 14 comprises a filter coefficient internal ROM (ROM represents read-only-memory and will be used as such hereinafter) from which a predetermined filter coefficient is read out in response to the tone color selection data (a tone color parameter TP3) and used in the filter section 14. Apart from this filter coefficient internal ROM is provided a filter coefficient external memory 20 which may be a semiconductor memory or may comprise a detachable memory media such as a magnetic card. The filter coefficient KO read from the external memory 20 is applied to the digital filter section 14. A filter coefficient selection switch 21 is provided in association with the digital filter section 14 to select either one of the internal ROM and the external memory 20. The filter section 14 effects its filter control according to either one of the filter coefficients selected in response to the output signal KS of the switch 21. The filter coefficients to be stored in the external memory 20 include, for example, a filter coefficient that changes with time. A large memory capacity is required to allow a filter coefficient to change with time so an external memory is suited for that purpose. This external memory 20 receives the key-on signal KON from the key-assigner 10 and a tone color parameter TP4 from the tone color selection device 12. The external memory 20 controls change in the filter coefficient with lapse of time during depression of the key and after release of the key in response to the key-on signal KON and also controls the change characteristic of the filter coefficient in response to the tone color parameter TP4.

The control circuit 13 outputs a synchronizing pulse SYNC in response to the reference timing of the serial outputting of the tone signals to the line 16. This synchronizing pulse SYNC is applied to the digital filter section 14 and external memory 20 and used to serialize (serially read) filter coefficients in synchronism with the serial tone signal of the line 16 and control the synchronization of the serial calculation timing in the filter section 14.

Figure 2:
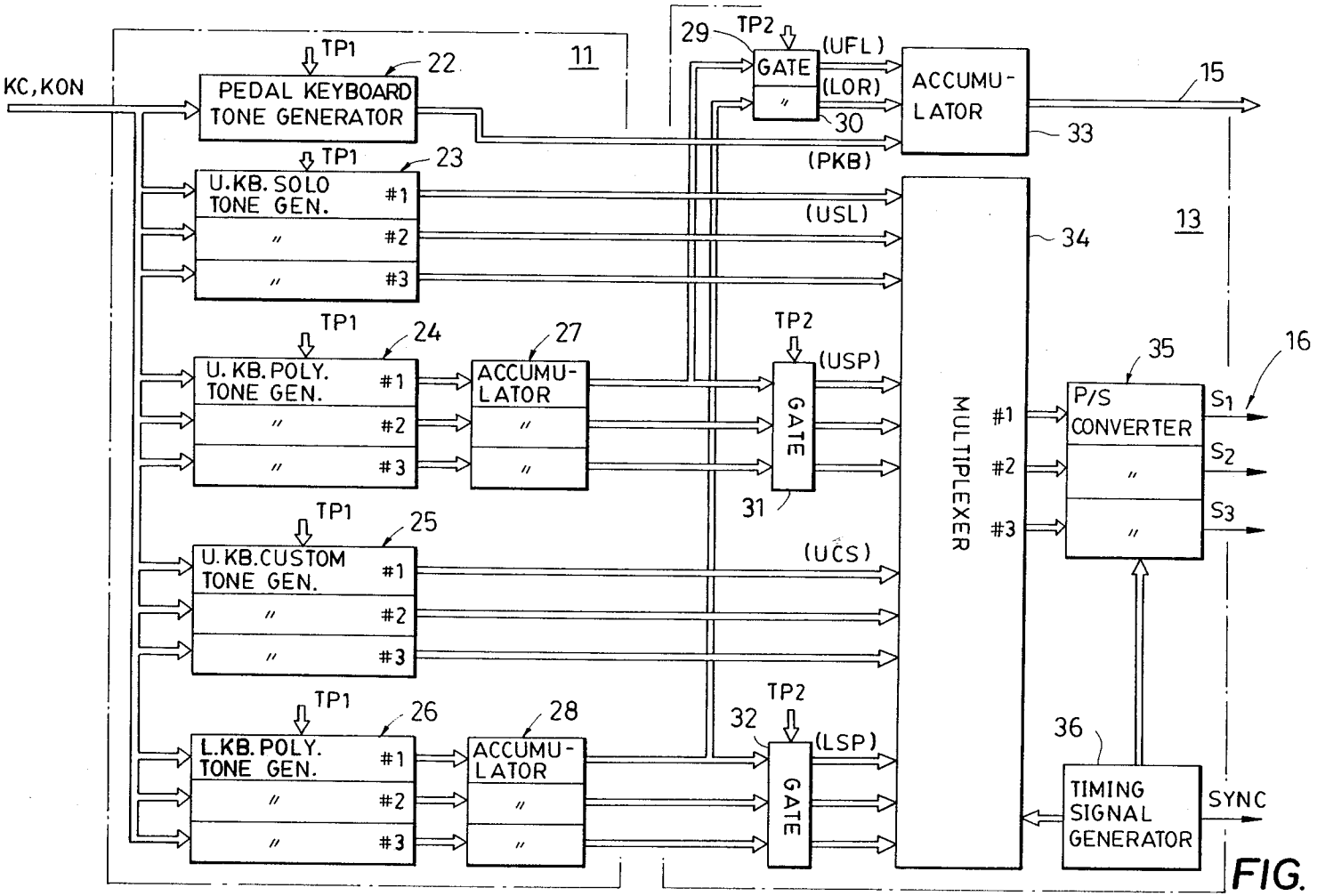
FIG. 2 is a block diagram showing an example each of the tone generation section, a tone signal distribution accumulation and serial conversion control circuit shown in FIG. 1.

FIG. 2 shows an example of the tone generation section 11 comprising multiple-channel tone sources or subchannels and the tone signal distribution accumulation and serial conversion control circuit 13. The tone generation section 11 comprises tone generators 22 to 26 for plural channels different from each other in the keyboard kind or the nature of tones they produce. Out of these channels, those which may use the digital filter section 14 (the tone generators 23 to 26) respectively comprise three tone generators corresponding to three subchannels (each designated by #1, #2 and #3). The pedal keyboard tone generator 22, upper keyboard solo tone generator 23 and upper keyboard custom tone generator 25 are monophonic type tone generators whereas the upper keyboard polyphonic system tone generator 24 and lower keyboard polyphonic system tone generator 26 are polyphonic type tone generators. The key information (key code KC, key-on signal KON, etc.) outputted from the key assigner 10 (FIG. 1) is applied to the tone generators 22 to 26. This key information comprises keyboard information enabling the key information (KC, KON, etc.) to be used in any of the tone generators 22 to 26 corresponding to the keyboard information. The polyphonic type tone generators 24, 26 are able to generate a plurality of tone signals corresponding to a plurality of key information (KC, KON, etc.) assigned to the respective tone generation channels. When a plurality of upper keyboard key information (KC, KON, etc.) are supplied at once, the upper keyboard monophonic system tone generators 23, 25 select one of them (the highest or lowest tone) to generate the tone signal thereof. The tone generators 22 to 26 are able to provide the tone signal to be generated with one or more sorts of tone colors selectively. For this purpose, the tone color selection device 12 (FIG. 1) supplies various tone color parameters TP1 corresponding to the selected tone color to the tone generators 22 to 26 which generate a tone signal having the frequency components or tone source waveforms, amplitude envelope, footage, tone volume and other various tone elements according to the tone color parameter TP1 at a tone pitch corresponding to the depressed key. However, the tone color element of a fixed formant is not provided here but provided by the digital filter section 14 at a post stage.

The subchannels (#1 to #3) provided in each of the channels (tone generators 23 to 26) which are capable of using the digital filter section 14 constitute multiple-channel tone sources for the tones to be generated in the channels 23 to 26. A tone signal to be generated by the upper keyboard solo tone generator 23, for example, is obtained by finally adding together the tone signals respectively generated by the tone generators corresponding to the three subchannels #1, #2 and #3 of that generator 23. Therefore, the tone signals generated by the subchannels #1, #2 and #3 may be called partial tone signals. However, all the tone generators of the subchannels need not be used depending on the kind of the tone color. For example, only the tone generator of one subchannel #1 may be used to generate a tone signal. Such multiple-channel tone sources or a plurality of subchannels #1 to #3 are advantageous to enable the digital filter section 14 to selectively control a portion of the partial tone signal constituting a tone signal. This will be described more in detail later.

The tone generators 22 to 26 generate tone signals in a digital form and may use any appropriate tone generation system such as a frequency modulation operation system, a harmonics synthesis system and a waveform memory reading system.

The polyphonic system tone generators 24 and 26 output digital tone signals corresponding to a plurality of depressed keys. Accumulators 27 and 28 provided correspondingly to the subchannels (#1 to #3) of the tone generators 24 and 26 accumulate the tone signals corresponding to a plurality of depressed keys in the respective subchannels.

In the tone signal distribution accumulation and serial conversion control circuit 13, gates 29, 30, 31 and 32 are provided to sort out the tone signals of respective channels supplied from the tone generation section 11 and are controlled according to the tone color parameter TP2 supplied from the tone color selection device. The gate 29 is provided to select and supply to an accumulator 33 the output tone signal of the accumulator 27 corresponding to the first subchannel #1 tone generator of the tone generator 24. Referring to Table 1 previously given, the output of this gate 29 corresponds to the tone signal of the upper keyboard flute (UFL). More specifically, when the tone color selection device 12 has selected a certain upper keyboard flute (UFL) tone color, the tone generator of the upper keyboard polyphonic system tone generator 24 corresponding to the first subchannel #1 generates the tone signal of the upper keyboard flute tone color which is then distributed to the side of the accumulator 33 (so as not to be passed through the digital filter section 14) by the gate 29.

The gate 30 is provided to select and supply to the accumulator 33 the output tone signal of the accumulator 28 that has accumulated the output of the tone generator of the lower keyboard polyphonic system tone generator 26 corresponding to the first subchannel #1. Referring to Table 1, the output of this gate 30 corresponds to the lower keyboard orchestra (LOR) tone signal. More specifically, when the tone color selection device 12 has selected a certain lower keyboard orchestra (LOR) tone color, the tone generator of the lower keyboard polyphonic system tone generator 26 corresponding to the subchannel #1 generates the tone signal of the lower keyboard orchestra tone color which is then distributed to the side of the accumulator 33 by the gate 30.

The gate 31 is provided to distribute the upper keyboard special (USP) tone signal to the side of the digital filter section 14 and the gate 32 to distribute the lower keyboard special (LSP) tone signal to the side of the digital filter section 14. When the tone color selection device 12 has selected a certain upper keyboard special (USP) tone color, the subchannels #1 to #3 of the upper keyboard polyphonic system tone generator 24 generate tone signals corresponding to the tone color, which through the accumulator 27, are distributed to the side of a multiplexer 34 (the side of the digital filter section 14) by the gate 31. Similarly, when a lower keyboard special (LSP) tone color has been selected, the subchannels #1 to #3 of the lower keyboard polyphonic system tone generator 26 generate tone signals corresponding to that tone color, which are distributed through the gate 32 to the side of the multiplexer 34.

While the first subchannel #1 of the upper keyboard polyphonic system tone generator 24 is used for the upper keyboard flute (UFL), the other subchannels #2, #3 of said tone generator 24 may be used for the upper keyboard special (USP). In that case, the gate 31 selects and supplies to the multiplexer 34 the tone signal corresponding to the subchannels #2 and #3. Similarly, while the first subchannel #1 of the lower keyboard polyphonic system tone generator 26 is used for the lower keyboard orchestra (LOR), the other subchannels #2 and #3 may be used for the lower keyboard special. The tone generators 24 and 26 may be used exclusively for the special (USP, LSP), expressly providing tone generators to be exclusively used for the upper keyboard flute (UFL) and the lower keyboard orchestra (LOR).

The accumulator 33 is provided to accumulate the upper keyboard flute (UFL) and lower keyboard orchestra (LOR) tone signals supplied from the gates 29 and 30 and the pedal keyboard (PKB) tone signal generated by the tone generator 22. The output signal of the accumulator 33 is supplied to the mixing circuit 17 (FIG. 1) through a line 15. The upper keyboard solo (USL) tone signal generated by the tone generator 23, the upper keyboard special (USP) tone signal supplied from the tone generator 24 through the gate 31, the upper keyboard custom (USC) tone signal generated by the tone generator 25, and the lower keyboard special (LSP) tone signal supplied from the tone generator 26 through the gate 32 are supplied to the digital filter section 14 (FIG. 1) through the multiplexer 34, parallel-serial converter 35 and the line 16. The multiplexer 34 is provided to time-division multiplex the tone signals of the respective channels (USL, USP, UCS, LSP) correspondingly to the filter channels ch1 to ch4 and the control signal therefor is supplied from a timing signal generator 36. The tone signals of the respective channels (USL, USP, UCS, LSP) are time division multiplexed individually in the subchannels #1, #2 and #3. The parallel digital tone signals outputted from the multiplexer 34 correspondingly to the subchannels #1 to #3 are applied to the respective parallel-serial converter 35 provided correspondingly to said subchannels. This converter 35 is provided to convert the digital tone signals of the subchannels #1 to #3 to timewise serial tone signals $S_1$, $S_2$ and $S_3$ and the control signal therefor is supplied from the timing signal generator 36. The timing signal generator 36 also outputs the synchronizing pulse SYNC mentioned earlier.

Figure 3:
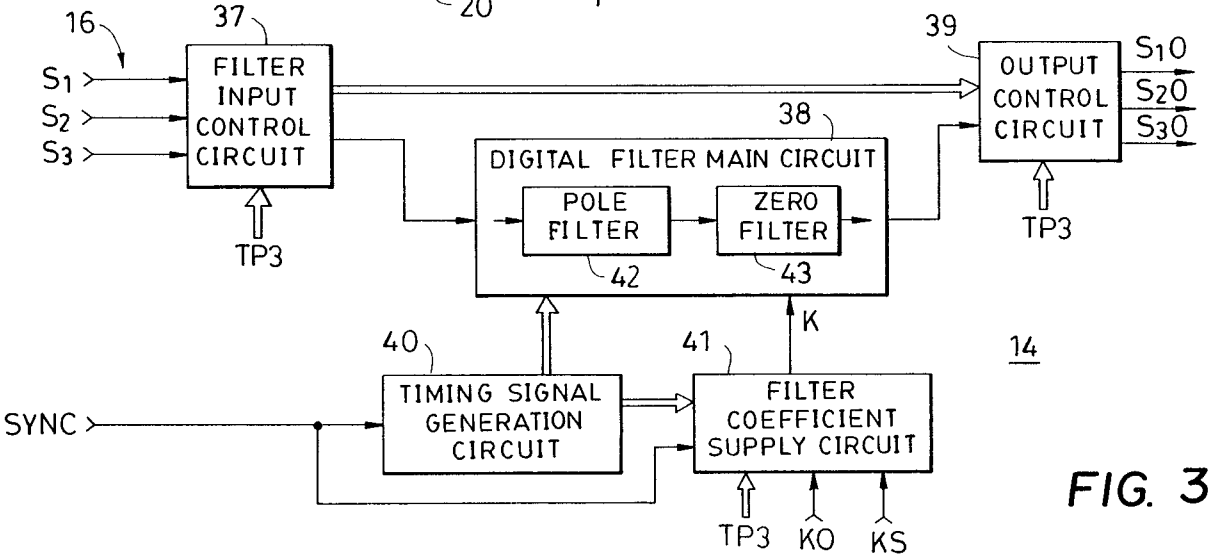
FIG. 3 is a block diagram showing an example of the digital filter portion shown in FIG. 1.

FIG. 3 is a block diagram showing an example of the digital filter section. The serial digital tone signals $S_1$, $S_2$ and $S_3$ corresponding to the subchannels #1 to #3 outputted from the parallel-serial converter 35 shown in FIG. 2 are applied to a filter input control circuit 37. The filter input control circuit 37 is provided to sort out those of the tone signals $S_1$, $S_2$ and $S_3$ to be applied to a digital filter main circuit 38 from those not to be applied thereto in response to the tone color parameter TP3. The tone signals (one or more of $S_1$, $S_2$ and $S_3$) to be applied to the digital filter main circuit 38 are added and mixed together in the respective filter channels and supplied from the input control circuit 37 to the filter main circuit 38. The other tone signals not to be passed through the digital filter circuit 38 are outputted from the digital filter section 14 through an output control circuit 39. The output control circuit 39 is provided to sort out and distribute the tone signals that have passed through the digital filter main circuit 38 and those that have not to output lines $S_1O$, $S_2O$ and $S_3O$ corresponding to the respective subchannels in response to the tone color parameter TP3.

A timing signal generation circuit 40 generates and supplies to the digital filter main circuit 38 based on the synchronizing pulse SYNC various timing signals for controlling filter calculation operation in the digital filter main circuit 38. A filter coefficient supply circuit 41 is provided to supply a filter coefficient K to the digital filter main circuit 38 and comprises a filter coefficient internal ROM which reads out a given filter coefficient in response to the tone color parameter TP3. The filter coefficient supply circuit 41 is provided with the filter coefficient KO supplied from the filter coefficient external memory 20 and the output signal KS of the filter coefficient selection switch 21, and supplies to the digital filter main circuit 38 either of the filter coefficient read by the internal ROM and the filter coefficient KO supplied from the external ROM in response to said switch output signal KS. The filter coefficient supply circuit 41 is supplied with the sychronizing pulse SYNC and the output signal of the timing signal generation circuit 40 and supplies a filter coefficient in synchronism with the filter operation timing.

The multiple-channel tone sources (the subchannels #1 to #3) may be used, for example, as follows. In a first example of usage, a small gap is created in pitch between the tone signals generated in the respective subchannels #1 to #3, passing all the tone signals $S_1$ to $S_3$ of these subchannels through the digital filter main circuit 38. This is suited to the tone colors of strings, chorus (plural human voices), etc. because it is thus possible, in the case of the strings tone color, to realize an effect simulating a sound of a plurality of string instruments played simultaneously by generating the tone signals with a small pitch gap between the plural subchannels #1 to #3 and besides, since each sound comprises a fixed formant, it is preferable to provide each of the tone signals $S_1$ to $S_3$ of all the subchannels with tone color components of a fixed formant by passing each of these tone signals through the digital filter main circuit 38. Further, in the case of chorus tone colors, it is thus possible to simulate a plurality of human voices in a more natural manner by generating the tone signals of human voices with a small pitch gap between the plural subchannels #1 to #3 and since each human voice comprises a fixed formant, it is preferable to pass the tone signals of all the subchannels through the digital filter main circuit 38. In this case, the control is effected such that upon selection of the strings tone color, for example, in the upper keyboard custom (UCS), the three tone generators of the tone generator 25 shown in FIG. 2 each corresponding to the subchannels #1 to #3 generate tone signals corresponding to the selected strings tone colors at a pitch corresponding to the depressed key and with a small gap between these tone signals whereas the input control circuit 37 shown in FIG. 3, upon receipt of the upper keyboard custom tone signals $S_1$ to $S_3$, sort out and distribute the tone signals $S_1$ to $S_3$ of all the subchannels #1 to #3 to the digital filter main circuit 38 in response to the tone parameters TP3 indicating the strings tone color. According to this example, independent tone signals are produced in the respective subchannels #1 to #3 and all these tone signals comprise fixed formants.

Figure 4A:
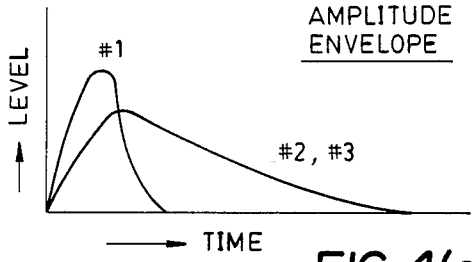
FIGS. 4(*a*), 4(*b*) and 4(*c*) are diagrams showing examples of use of the multiple-channel tone sources (sub-channels) shown in FIG. 2.
Figure 4B:
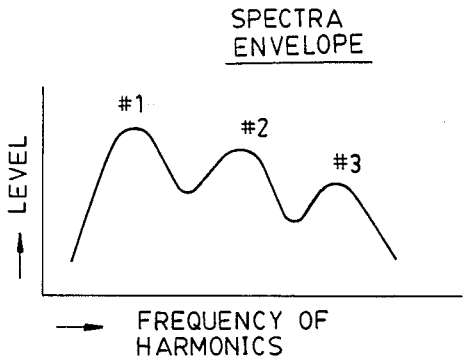
Figure 4C:
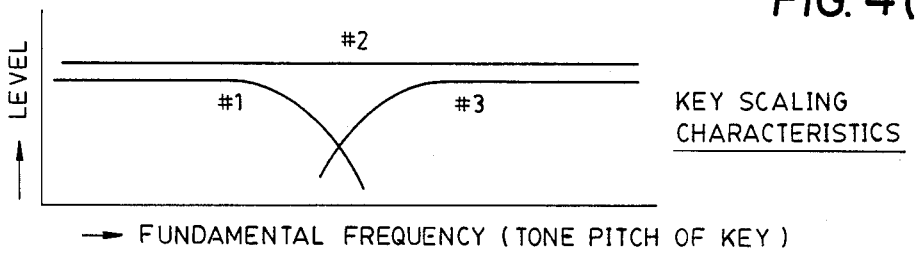

In a second example of usage, the tone signals generated in the respective subchannels #1 to #3 have the same pitch but have different amplitude envelopes and the tone signals of particular subchannels (one or more of $S_1$ to $S_3$) only are passed through the digital filter main circuit 38. This is suited to tone colors of the piano, vibraphone, electric bass, etc. FIG. 4(*a*) shows an example of the amplitude envelope provided in each of the subchannels #1 to #3 in the case of the piano tone color. The amplitude envelope provided in the first subchannel #1 is for simulating the amplitude envelope of the soundboard whereas the amplitude envelope (having a longer sustain state than the amplitude envelope provided in the subchannel #1) provided in the second and third subchannels #2 and #3 is for simulating the amplitude envelope of strings. Since in this case the tone color components for the soundboard are of a fixed formant and those for strings are of a moving formant (i.e., the spectrum distribution remains the same if the fundamental frequency changes), the input control circuit 37 shown in FIG. 3 passes the tone signal $S_1$ corresponding to the first subchannel 190 1 through the digital filter main circuit 38 and does not pass the other tone signals $S_2$ and $S_3$ through the digital filter main circuit 38. According to this example, the subchannels #1 to #3 each produce partial tone signals to form one tone signal, some of which partial tone signals comprise a fixed formant.

In a third example of usage, the tone signals generated in the respective subchannels #1 to #3 have the same fundamental frequency but have different bands of the harmonic components and the tone signals $S_1$ to $S_3$ of all the subchannels are applied to the digital filter main circuit 38. This is suited to synthesize a tone having a tone color (e.g. the human voice) having a plurality of fixed formants as shown in FIG. 4(*b*). More specifically, the first formant (peak portion) is intensified by the tone signal $S_1$ generated in the first subchannel #1, the second formant (peak portion) by the tone signal $S_2$ of the second subchannel #2 and the third formant (peak portion) by the tone signal $S_3$ of the third subchannel #3. In this case the subchannel #1 generates the tone signal $S_1$ in which concentrate the harmonic components corresponding to the band of the second formant, the subchannel #2 generates the tone signal $S_2$ in which concentrate the harmonic components corresponding to the band of the second formant and the subchannel #3 generates the tone signal $S_3$ in which concentrate the harmonic components corresponding to the band of the third formant. Since it is difficult to produce at once a tone signal comprising harmonic components evenly throughout a wide range of band, such usage wherein the band is divided and shared by the subchannels #1 to #3 is very effective. According to this example, the subchannels #1 to #3 produce partial tone signals to form one tone signal, all of which comprise a fixed formant.

In a fourth example of usage, the tone signals generated in the respective subchannels #1 to #3 have the same pitch whereas the respective tone volume levels are provided with key scaling of different characteristics, and tone signals of particular subchannels only (one or more of $S_1$ to $S_3$) are passed through the digital filter main circuit 38. This is suited to the tone colors of the double-reed instruments such as the oboe, bassoon, etc. In the tone colors of this sort, the movable formant components are intensive in the higher tone range of the fundamental frequency whereas the fixed formant components are intensive in the lower tone range. Accordingly, the tone volume levels of the respective tone signals generated in the subchannels #1 to #3 are provided with key scaling of different characteristics as shown, for example, in FIG. 4(*c*) according to the tone pitch or fundamental frequency of the key so as to pass the tone signal $S_1$ of the subchannel #1 having the lower tone range intensified through the digital filter main circuit 38, thus providing the tone signal corresponding to the key of a lower tone range with a fixed formant. While the tone signal $S_3$ of the subchannel #3 having the higher tone range intensified is not passed through the digital filter main circuit 38, whether or not the tone signal $S_2$ of the subchannel #2 to which key scaling was virtually not effected is passed through the digital filter main circuit 38 may be decided according to the nature of the normal tone color.

In a fifth example of usage, the subchannels #1 to #3 generate tone signals different in footage and tone signals of particular subchannels (one or more of $S_1$ to $S_3$) only are passed through the digital filter main circuit 38. This is suited to provide a tone of particular footage with a fixed formant.

In a sixth example of usage, the subchannels #1 to #3 generate tone source signals of different waveforms (sine wave, rectangular wave, saw-tooth wave, etc.) of which only particular tone source signals (e.g., rectangular wave, saw-tooth wave) are passed through the digital filter main circuit 38.

In the above case, it is required that the subchannels #1 to #3 generate in different manners a plurality of tone signals corresponding to one tone color selectable by operating one of the switches of the tone color selection device 12, which tone signals are synthesized to form a tone signal corresponding to one tone color selected. However, the subchannels #1 to #3 may generate tone signals of different tone colors of which only those tone signals (one or more of $S_1$ to $S_3$) to be provided with fixed formant are applied to the digital filter main circuit 38.

Figure 5A:
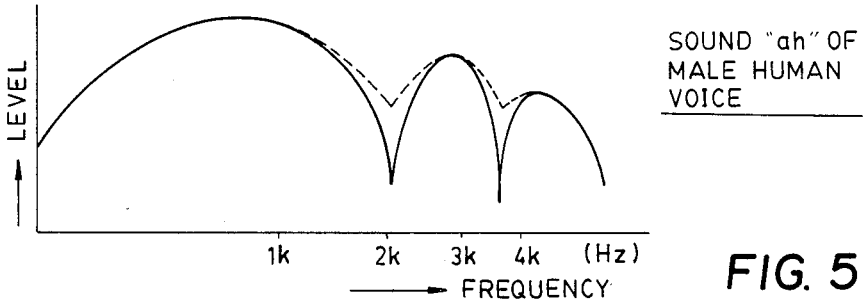
FIGS. 5(*a*), 5(*b*) and 5(*c*) are diagrams showing examples of amplitude-frequency characteristic for various tone colors which can be realized by combinations of a pole filter and a zero filter.
Figure 5B:
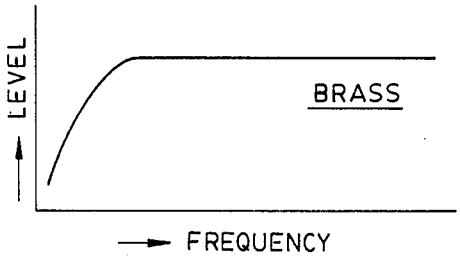
Figure 5C:
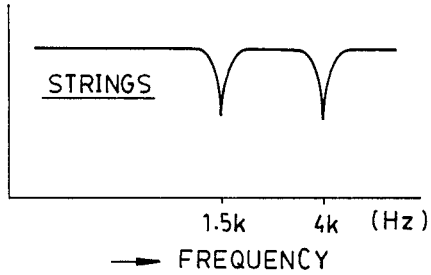

Referring to FIG. 3, the digital filter main circuit 38 comprises a pole filter 42 and a zero filter 43 serially connected to each other. A pole filter is able to control the peak portion of the filter characteristic (amplitude frequency characteristic) and a zero filter the valley portion of the filter characteristic. For example, the sound "ah" of the male human voice has an amplitude frequency characteristic as shown by the solid line in FIG. 5(*a*) wherein the dotted line indicates the valley portion of the amplitude frequency characteristic realized only by the pole filter, failing to lower the level sufficiently. This is because using the pole filter alone, the amplitude frequency characteristic may only be set by superposing the peak portions thereof. Therefore, the zero filter is provided serially in relation to the pole filter and the characteristic of the zero filter is so set as to sufficiently lower the levels of the desired frequency components, thereby sufficiently lowering the level of the valley portions as shown by the solid line in FIG. 5(*a*). FIG. 5(*b*) shows the amplitude frequency characteristic of the brass tone color, which is difficult to realize by the pole filter alone but may be realized by the combination of the pole filter and the zero filter. Specifically, the characteristic of the zero filter may be so set as to lower the level of the low range components (so that the frequency may be zero at point 0) whereas the high-level high-range characteristic may be set by the pole filter. FIG. 5(*c*) shows the amplitude frequency characteristic of the strings tone color which also is difficult to realize by the pole filter alone but may be realized through the combination of the zero filter and pole filter, setting the zero filter characteristic so as to have a given frequency at 0. As in the above examples, serial combination of the pole filter and the zero filter advantageously enables a complicated frequency characteristic to be realized.

Figure 7:
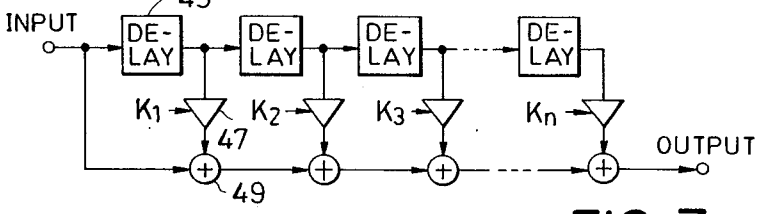
FIG. 7 is a block diagram showing a basic construction of a finite impulse response filter usable as the zero filter.
Figure 6:
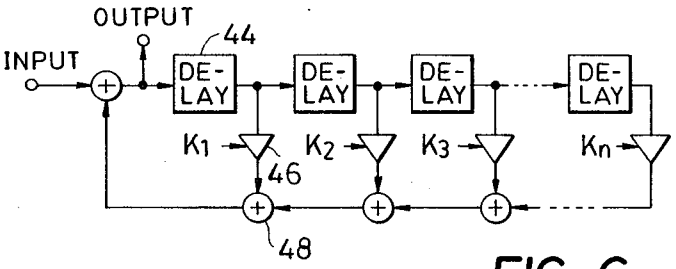
FIG. 6 is a block diagram showing a basic construction of an infinite impulse response filter usable as the pole filter.

In general, the pole filter has a closed loop for feeding back to the input side the sum of the present digital signal input and the past digital signal outputs for n samples each provided with weighting with a coefficient Ki (i=1, 2, . . . n) and is represented by an infinite impulse response filter (hereinafter referred to as IIR filter) as shown in FIG. 6. The zero filter outputs the sum of the present and past digital signal inputs for n samples each provided with weighting with the coefficient Ki (i=1, 2 . . . n) and is represented by a finite impulse response filter (hereinafter referred to as FIR)

as shown in FIG. 7. The blocks indicated "delay" in FIGS. 6 and 7 such as blocks 44 and 45 represent delay circuits for delaying the inputted digital waveform signal by the time corresponding to their one sampling time. The triangular blocks such as those indicated by reference numerals 46 and 47 represent multipliers for multiplying the digital waveform signals by the filter coefficients $K_1$ to $K_n$. The blocks marked "+" such as those indicated by reference numerals 48 and 49 represent adders.

A lattice-type filter is a kind of the IIR filter and known as a filter suited for tone synthesis. This lattice-type filter is advantageous in that it needs a smaller number of multipliers than the other types so the hardware may be reduced in size. Further in the lattice-type filter, the number of bits of the filter coefficient can be small and there is an established manner of setting a coefficient against a desired filter characteristic. Therefore, a lattice-type filter is used as a preferred filter in this embodiment.

Figure 8B:
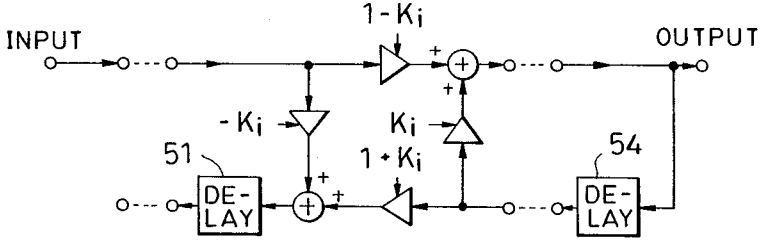
FIG. 8(*a*) is a block diagram showing a block diagram showing a basic construction of a lattice-type filter usable as the pole filter.
Figure 8C:
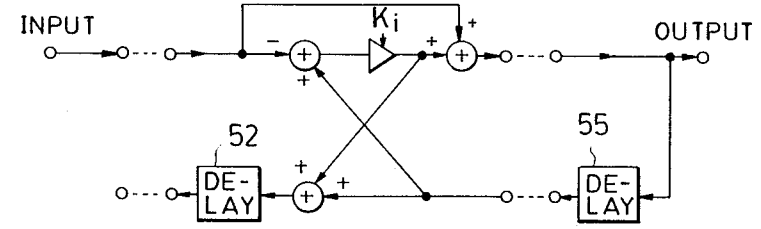
Figure 8A:
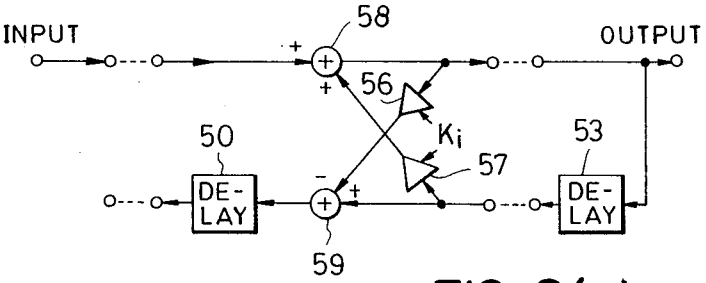

FIG. 8(*a*) shows a basic model of a lattice-type filter while FIGS. 8(*b*) and (*c*) respectively show modifications which are equivalent to the basic model. In FIG. 8, reference numerals 50 to 55 designate one-sampling time delay circuits, the triangular blocks including those 56 and 57 represent multipliers, and the blocks marked "+" including those 58 and 59 represent adders (or subtractors), as in FIGS. 6 and 7. The figure illustrates one of the one-stage (corresponding to the one sampling time delay) filter units a proper number of which are serially connected to compose the lattice-type filter circuit. The suffix i of the filter coefficient Ki indicates that that coefficient is the one for the ith-stage filter unit. The delay circuits 50, 51 and 52 are provided to feed back the one-sampling-time-earlier signal to the preceding-stage filter unit. In the actual circuit, the delay time is given by subtracting the delay time in the operation circuit from the one sampling time. In the final-stage filter unit, its own output signal is fed back. Therefore, the delay circuits 53, 54 and 55 are provided on the output side so as to set a delay time corresponding to the one sampling time between the output of the final-stage filter unit and its feedback input. The model of the lattice-type filter shown in FIG. 8(*c*) has the smallest number of multipliers and therefore is advantageous.

Figure 9:
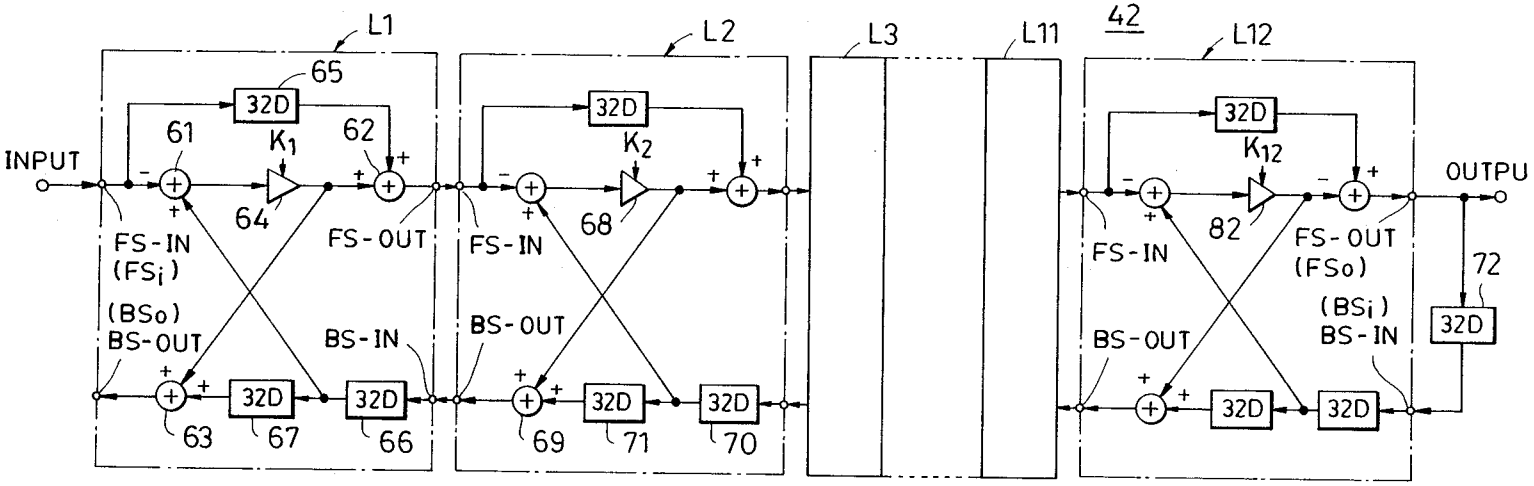
FIG. 9 is a block diagram showing an example of the pole filter shown in FIG. 3 constituted of 12 stages of lattice-type filters.
Figure 10:
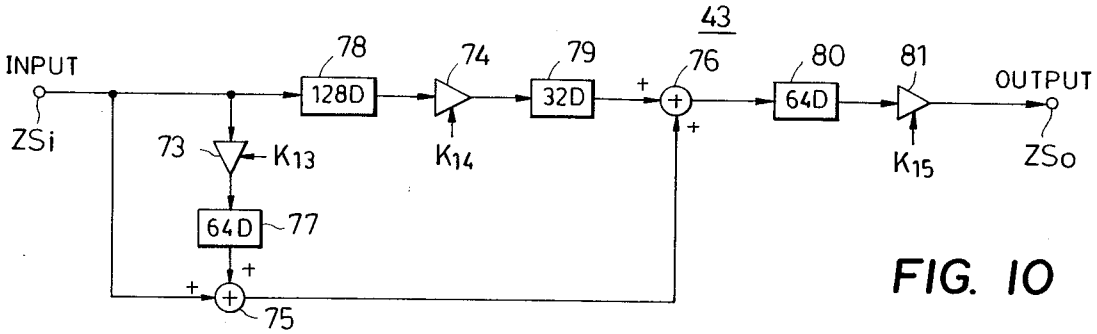
FIG. 10 is a block diagram showing an example of the zero filter shown in FIG. 3.

FIG. 9 shows an example of the pole filter 42 for the digital filter main circuit 38 (FIG. 3) composed of the lattice-type filters of which the model is shown in FIG. 8(*c*). The pole filter 42 consists of 12-stage lattice-type filters L1 to L12. The pole filter 42 shown in FIG. 9 is constituted by taking into account the operation time delay in the multipliers. FIG. 10 shows an example of the zero filter 43 for the digital filter main circuit 38 (FIG. 3) constituted by taking into account the operation time delay. Since this zero filter 43 is a quadratic zero filter (comprising delay elements for two-sampling times), the filter 43 could simply be constituted by serially connecting two of the delay circuits 45 in the FIR filter of FIG. 7 but it is constituted as shown in FIG. 10 in view of the operation time delay and other factors.

Before entering description in conjunction with FIGS. 9 and 10, description will be made about the data form of the digital tone signals inputted to the pole filter 42 and the zero filter 43.

Figure 11:
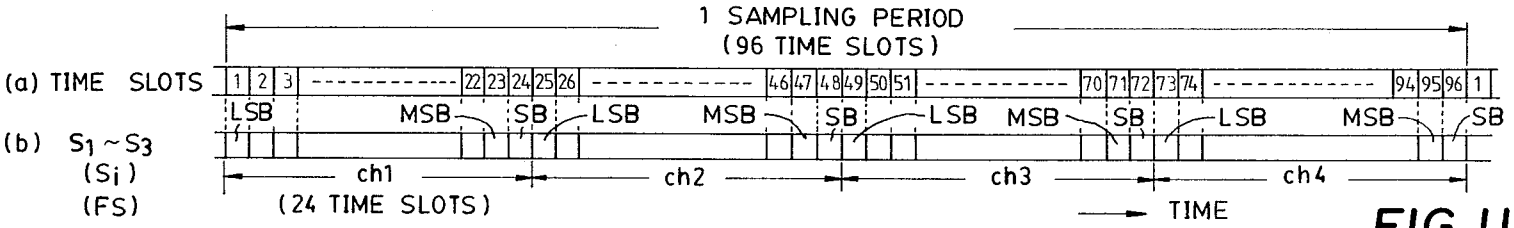
FIG. 11 is a time chart showing an example of a serialized form of tone signals.

Assume, for example, that one tone signal consists of digital data of 24 bits. The serial tone signals $S_1$, $S_2$ and $S_3$ of the respective subchannels applied to the digital filter section 14 in FIG. 3 from the control circuit 13 in FIG. 2 via the line 16 are timewise serialized by employing 24 time slots for each signal and the serial tone signals of 24 time slots for four filter channels are time-division multiplexed. Hence one sampling period of a tone waveform amplitude in the serial tone signals $S_1$, $S_2$ and $S_3$ in the respective subchannels is $24\times4=96$ time slots. FIG. 11(*a*) is a diagram showing sequential time slots in this one sampling period with numbers 1 to 96 affixed thereto. FIG. 11(*b*) shows data contents of the serial tone signals $S_1$, $S_2$ and $S_3$ corresponding to the respective time slots. The timings shown in FIGS. 11(*a*) and 11(*b*) are common through the serial tone signals $S_1$, $S_2$ and $S_3$ of the respective subchannels.

FIG. 11(*b*) shows that in the serial tone signals $S_1$, $S_2$ and $S_3$, the serial tone signal data of the filter channel ch1 (upper keyboard solo USL) is allotted to the 1st through 24th time slots, the serial tone signal data of the filter channel ch2 (upper keyboard special USP) to the 25th through 48th time slots, the serial tone signal data of the filter channel ch3 (upper keyboard custom UCS) to the 49th through 72nd time slots, and the serial tone signal data of the filter channel ch4 (lower keyboard special LSP) to the 73rd through 96th time slots. In each of the 24th-time-slot tone signal data, the first time slot (the first, 25th, 49th and the 73rd time slots) is assigned with the least significant bit LSB, followed by the more significant bits in order with the weight increasing as the stage advances until the 23rd time slot (the 23rd, 47th, 71st and the 95th time slots) is assigned with the most significant bit and the last time slot (the 24th, 48th, 72nd, and 96th time slots) is assigned with the sign bit.

Reverting to FIG. 9, description will be made about the filter unit L1 of the first stage. Reference numeral 61 designates an adder working as a subtractor, 62 and 63 adders, 64 a multiplier and 65, 66 and 67 delay circuits.

The characters 32D in the blocks of the delay circuits 65 to 67 indicate that these circuits each effect a 32-time-slot delay. FS-IN donotes a tone signal forward input terminal, FS-OUT a tone signal forward output terminal, BS-IN a backward signal input terminal, and BS-OUT a backward signal output terminal. The other units L2 to L12 are of the same construction as the unit L1. The forward output terminals FS-OUT of the units L1 to L12 are connected to the forward input terminals FS-IN of the respectively following units L2 to L12 while the backward output terminals BS-OUT of the units L2 to L12 are connected to the backward input terminals BS-IN of the respectively preceding units L1 to L11. The adder 61 (working as a subtractor) in the filter unit L1 subtracts the tone signal inputted from the forward input terminals FS-IN from the tone signal fed back from the next-stage unit L2 through the backward input terminal BS-IN and delay circuit 66. The output of the adder 61 is inputted to the multiplier 64 and multiplied by the filter coefficient $K_1$. The numeral 1 added to the letter K indicates that the coefficient corresponds to the 1st-stage unit L1. The output of the multiplier 64 is supplied to the adder 62 and thereby added to the input tone signal supplied through the terminal FS-IN and delay circuit 65. The delay circuit 65 is provided in view of the operation time delay in the multiplier 64. Specifically, since in this example, the multiplier 64 is designed so that its operation time delay is equivalent to 32 time slots, the delay circuit 65 effects 32-time-slot delay for synchronism. The output of the adder 62 is inputted to the next-stage unit L2 through the output terminal FS-OUT.

Between the output of the adder 61 and the signal fed back to the adder 61 from the next-stage unit L2 through the delay circuit 66, the time delay equivalent to one sampling period needs to be secured and is obtained as follows. The tone signal through the multiplier 68 and adder 69 in the unit L2 is inputted to the backward input terminal BS-IN of the unit L1. The signal is then inputted through the delay circuit 66 to the adder 61. Accoardingly, the output signal of the adder 61 is 32 time slots delayed by the multiplier 64, then another 32 time slots by the multiplier 68 in the next-stage unit and further 32 time slots by the delay circuit 66 so as to be delayed by 96 time slots in all before being fed back to the adder 61. The required delay time is therefore secured since, as before, one sampling period of the serial tone signal FS is 96 time slots.

The adder 63 (or 69 for L2) supplying a signal to the backward output terminal BS-OUT adds the output of the multiplier 64 (or 68 for L2) and the feedback signal supplied from the next-stage unit L2 (L3 for L2) through the delay circuits 66 and 67 (70 and 71 for L2). The output of the multiplier 64 corresponding to the output of the delay circuit 66 is 32 time slots behind the output timing of the circuit 66. The delay circuits 67 is therefore provided to develop the equivalent time delay.

The last-stage unit L12 feeds back to itself its output tone signal. Hence the time delay of 32 time slots in the multiplier of the next stage unit as described above cannot be expected and, accordingly, a delay circuit 72 for setting the time delay of 32 time slots is provided in a loop which feeds back the output signal of the forward output terminal FS-OUT of the unit L12 to the backward input terminal BS-IN.

In the following description, reference characters FSi and BS0 are used to designate the forward input terminal FS-IN and the backward output terminal BS-OUT of the first stage filter unit L1 and reference characters FS0 and BSi are used to designate the forward output terminal FS-OUT and the backward input terminal BS-IN in the last filter unit L12.

In the zero filter 43 shown in FIG. 10, the quadratic zero filter is composed of multipliers 73 and 74, adders 75 and 76 and delay circuits 77, 78 and 79. The first stage of this zero filter of the second order consists of the multiplier 73 to which an input tone signal is applied, the delay circuit 77 which delays the output signal of the multiplier 73 by 64 time slots and the adder 75 which adds the output signal of the delay circuit 77 and the input tone signal. To the multiplier 73 is applied a filter coefficient $K_{13}$ corresponding to the first stage zero filter. Delay in the operation time in the multipliers 73 and 74 is assumed to be also 32 time slots. Accordingly, the total time delay in the multiplier 73 and the delay circuit 77 is 96 time slots which is equivalent to one sampling period. Hence in the adder 75, the tone signal of the present sampling time and a signal obtained by multiplying the tone signal one sampling time before by the filter coefficient $K_{13}$ are added together. The second stage zero filter consists of a delay circuit 78 which delays the input tone signal by 128 time slots, a multiplier 74 which multiplies the output signal of this delay circuit with a filter coefficient $K_{14}$, a delay circuit 79 which delays the output of this multiplier 74 by 32 time slots and an adder 76 which adds the outputs of the delay circuit 79 and the adder 75 together. A total delay time by the circuits 78, 74 and 79 is 192 time slots which is equivalent to two sampling periods. Accordingly, in the adder 76, signal obtained by multiplying a tone signal two sampling times ago with the filter coefficient $K_{14}$ is added to the output signal of the adder 75. In the adders 75 and 76, therefore, a sum of the tone signal of the present sampling time, the signal obtained by multiplying the tone signal one sampling time ago with the filter coefficient $K_{13}$ and the signal obtained by multiplying the tone signal two sampling times ago with the filter coefficient $K_{14}$ is obtained. Thus, an output signal of the zero filter of the second order is obtained from the adder 76.

The output signal of the adder 76 is delayed by 64 time slots in a delay circuit 80 and thereafter is applied to a multiplier 81. The multiplier 81 is provided for controlling the output gain of the zero filter 43 and receives a coefficient $K_{15}$ for controlling the output gain. While the above described coefficients $K_{13}$ and $K_{14}$ participate in setting of the filter characteristic of the zero filter 43, this filter coefficient $K_{15}$ does not participate in setting of the filter characteristic but sets a gain of the zero filter as a whole. Time delay in the multiplier 81 is also 32 time slots and the delay circuit 80 performing the delay of 64 time slots is provided for synchronizing the signal delay time in the gain controlling circuits 80 and 81 with one sampling period (96 time slot).

Locations where the delay circuits 77, 78, 79 and 80 are inserted in the circuits 73, 77 and 75 of the first stage of the zero filter 43, the circuits 78, 74, 79 and 76 of the second stage and the gain controlling circuits 80 and 81 are not limited to those illustrated but may be selected suitably so long as delay of one sampling time is set in the first stage, that of two sampling times in the second stage and that of one sampling time in the gain control stage respectively. For example, the delay circuit 77 may be provided on the input side of the multiplier 73, locations of the delay circuits 78 and 79 may be exchanged and the delay circuit 80 may be provided on the output side of the multiplier 81. However, as will be described later, the respective filter coefficients $K_1$–$K_{15}$ in the present embodiment are supplied to the digital filter main circuit 38 in a timewise serial data form and the multipliers 64, 68, . . . 82, 73, 74 and 81 perform a serial operation in a predetermined time relationship. It is therefore necessary to properly control input timing of signals to these multipliers 64, 68, . . . 82, 73, 74 and 81 and, for this purpose, the delay circuits 77, 78, 79 and 80 are provided in the locations shown in FIG. 10.

The time delay between input signals and output signals in the pole filter 42 and the zero filter 43 in FIGS. 9 and 10 is a total of 384 time slots, i.e., four sampling periods in the pole filter 42 because there are 32 time slots for each of the 12 stage flter units L1–L12 whereas the time delay is three sampling periods in the zero filter 43.

Figure 12:
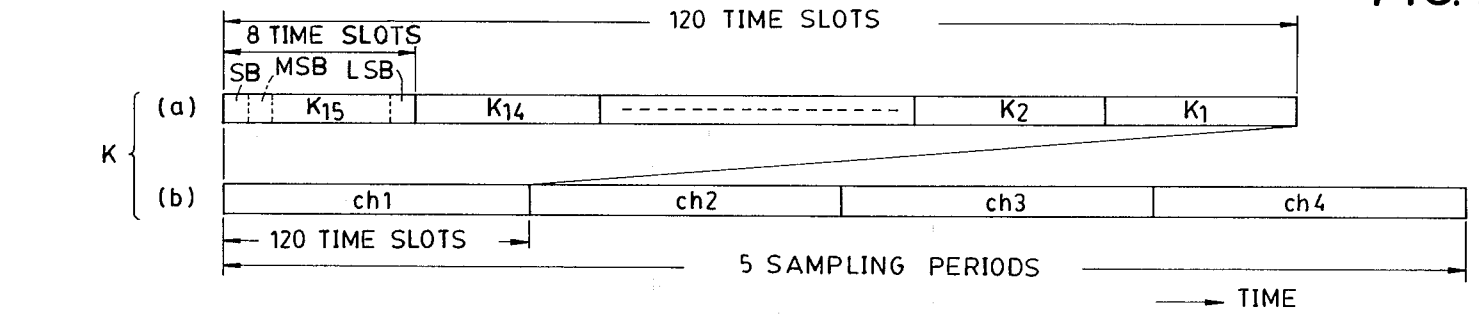
FIG. 12 is a time chart showing an example of a serialized form of filter coefficients.

The filter coefficients $K_1$–$K_{15}$ of the pole filter 42 and the zero filter 43 are provided by a filter coefficient supply circuit 41 (FIG. 3). These filter coefficients $K_1$–$K_{15}$ may be provided to the multipliers 64, 68, . . . 82, 73, 74 and 81 in parallel. In the present embodiment, however, the filter coefficient K supplied from the filter coefficient supply circuit 41 to the digital filter main circuit 38 is produced by timewise serializing the filter coefficients $K_1$–$K_{15}$. An example of the format of the serialized filter coefficient K is shown in FIG. 12. By way of example, one filter coefficient is digital data of 8 bits so that a total bit number of the fifteen filter coefficients $K_1$–$K_{15}$ is 120 bits. Hence the number of time slots required for serializing the filter coefficients $K_1$–$K_{15}$ for one tone color (one filter channel) is 120 and the number of time slots required for providing the filter coefficients for four filter channels in a time division multiplexed form is $120\times4=480$. One cycle time (480 time slots) of serial time division production of the filter coefficient K corresponds to 5 sampling periods ($480\div96=5$).

Referring to FIG. 12(*a*), the filter coefficient serial data K for one channel is outputted sequentially from data corresponding to the last stage of the zero filter 43 (in the order of $K_{15}$, $K_{14}$, $K_{13}$) and then sequentially from data corresponding to the last stage of the pole filter 42 (in the order of $K_{12}$, $K_{11}$ . . . $K_2$, $K_1$). In the serial data of each filter coefficient of 8 bits, data is outputted in the order from the most significant bit MSB to the least significant bit LSB starting from a sign bit SB. In the digital filter main circuit 38, the filter coefficient serial data K is sequentially shifted to convert the serial filter coefficients $K_1$–$K_{15}$ to parallel data and thereafter supply it to the predetermined multipliers 64, 68, . . . 82, 73, 74 and 81 (FIGS. 9 and 10). The data K which has been serialized in the form shown in FIG. 12(*a*) for one channel is time division multiplexed between the respective filter channels ch1–ch4 (in the order of filter channels ch1, ch2, ch3, ch4) as shown in FIG. 12(*b*).

Figure 13:
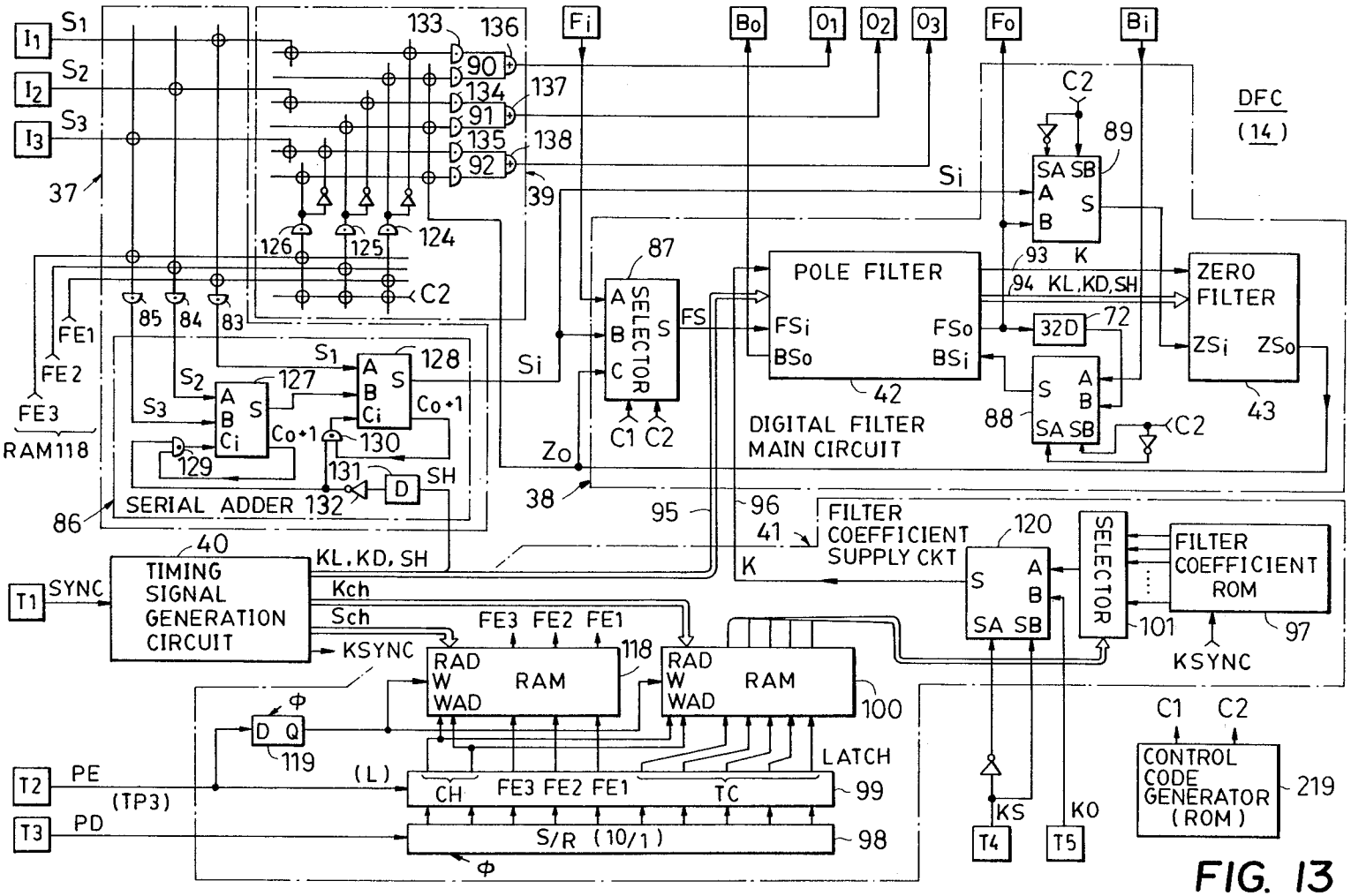
FIG. 13 is a block diagram showing a specific example of a digital filter circuit usable as the digital filter shown in FIGS. 1 and 3.

FIG. 13 shows a specific example of the digital filter section 14 in FIGS. 1 and 3. More specifically, FIG. 13 is a block diagram showing the internal construction of a digital filter chip DFC which is usable as the digital filter section 14 shown in FIGS. 1 and 3. The digital filter section 14 in FIG. 1 may be constructed of a single digital filter chip DFC as shown in FIG. 13 or alternatively of a plurality of the chips DFC in combination. In FIG. 13, component parts corresponding to the circuits 37–43 in FIG. 3 are designated by the same reference characters used in FIG. 3. One digital filter chip DFC comprises, as in FIG. 3, a filter input control circuit 37, digital filter main circuit 38, output control circuit 39, timing signal generation circuit 40 and filter coefficient supply circuit 41. The digital filter main circuit 38 comprises a pole filter 42 (see FIG. 9) consisting of a 12-stage lattice-type filter and a quadratic zero filter 43 (see FIG. 10).

To tone signal input terminals $I_1$, $I_2$ and $I_3$ are applied serial digital tone signals $S_1$, $S_2$ and $S_3$ corresponding to the respective subchannels #1–#3. The filter input control circuit 37 comprises AND gates 83, 84 and 85 for individually gating the signals $S_1$–$S_3$ supplied from the terminals $I_1$–$I_3$ and a serial adder 86 for adding the serial tone signals outputted by these AND gates 83–85. The digital filter main circuit 38 comprises, in addition to the pole filter 42 and the zero filter 43, selectors 87, 88 and 89 for switching combination of connection of the filters 42 and 43. The selector 87 receives a tone signal supplied from an input terminal Fi at its first input A, a serial tone signal Si outputted from the serial adder 86 at its second input B and an output signal Z0 of the zero filter 43 at its third input C. A serial tone signal (designated by FS) outputted from an output S of the selector 87 is applied to a forward input terminal FSi of the first stage filter unit L1 of the pole filter 42 (see FIG. 9). A signal from a backward output terminal $BS_0$ of the first stage filter unit L1 of the pole filter 42 (see FIG. 9) is applied to the output terminal $B_0$.

A signal from a forward output terminal $FS_0$ of the last stage filter unit L12 of the pole filter 42 (see FIG. 9) is applied to a delay circuit 72 and also to an output terminal $F_0$ and a second input B of the selector 89. To a first input A of the selector 89 is applied the serial tone signal Si outputted from the serial adder 86. The serial tone signal Si and the serial tone signal FS outputted from the selector 87 are of the same data format and timing as the serial tone signals $S_1$–$S_3$ supplied to the input terminals $I_1$–$I_3$ (see FIG. 11(*b*)). The delay circuit 72 in FIG. 13 performs the same function as the delay circuit 72 in FIG. 9. The output signal of the delay circuit 72 is applied to a second input B of the selector 88. To a first input A of the selector 88 is applied the serial tone signal provided by the input terminal Bi. An output S thereof is connected to the backward input terminal BSi of the last filter unit L12 of the pole filter 42 (see FIG. 9). The output S of the selector 89 is connected to the input terminal ZSi of the zero filter 43 (see FIG. 10). The serial tone signal $Z_0$ outputted from the output terminal ZSi of the zero filter 43 (see FIG. 10) is applied to the input C of the selector 87 as was previously described and also to AND gates 90, 91 and 92 of the output control circuit 39.

In the digital filter main circuit 38, the connection between the pole filter 42 and the zero filter 43 can be switched, for example, in three ways. The first of them is a connection in which the pole filter 42 is disposed in a pre-stage and the zero filter 43 in a post-stage and the two filters are serially connected. The second is a connection in which, conversely, the zero filter 43 is disposed in the pre-stage and the pole filter 42 in the post-stage and the two filters are serially connected. The third is a connection in which the pole filter 42 is used alone and is not connected to the zero filter 43. Such switching of the connections between the pole filter 42 and the zero filter 43 functions effectively in case a plurality of digital filter chips are used in combination as the digital filter section. For controlling the switching of the connection between the pole filter 42 and the zero filter 43, control codes C1 and C2 are applied to the selectors 87, 88 and 89.

The modes of the switching of the connections and contents of the codes C1 and C2 will be described more in detail later. For convenience of explanation, description will now be made on the assumption that a single digital filter chip DFC alone is used as the digital filter section 14, the pole filter 42 is disposed in the pre-stage and the zero filter 43 in the post-stage and the two filters are serially connected. In this case, the control codes C1 and C2 are both signal "1". In the selector 87, the input B is selected by "11" of the code C2. In the selector 89, the input B is selected by "1" of the code C2. Accordingly, the serial tone signal Si outputted from an serial adder 86 of the input control circuit 37 is applied as the signal FS to the input terminal FSi of the pole filter 42 through the selector 87, the output signal of the forward output terminal FS0 of the pole filter 42 is applied to the input terminal ZSi of the zero filter 43 through the selector 89 and a signal produced by delaying the output signal of the forward output terminal FS0 by the delay circuit 72 by 32 time slots is fed back to the backward input terminal BSi of the pole filter 42 through the selector 88. Thus, the pole filter 42 and the zero filter 43 are serially connected with the former being disposed in the pre-stage and the latter in the post-stage.

The timing signal generation circuit 40 generates, responsive to the synchronizing pulse SYNC applied through the terminal T1, predetermined timing signals KL, LD and SH for controlling a serial filter operation, channel selection code Kch synchronized with the time division timing of the respective filter channels ch1–ch4 in the serial filter coefficient K, a channel selection code Sch synchronized with the time division timing of the respective filter channels ch1–ch4 in the serial tone signals $S_1$–$S_3$, and a synchronizing pulse KSYNC for serializing the filter coefficient. The timing signals KL, LD and SH are supplied to the filter unit L1 of the first stage (see FIG. 9) of the pole filter 42 through a line 95. The serial data K of the filter coefficient outputted from the filter coefficient supply circuit 41 also is supplied to the first stage unit L1 of the pole filter 42. As will be described later, the serial filter coefficient data K is sequentially shifted through the respective stages of the pole filter 42, applied to the zero filter 43 through a line 93, again shifted sequentially through the respective stages of the zero filter 43, and finally converted to a parallel form from a serial form whereby the respective coefficients $K_1$–$K_{15}$ are distributed to predetermined stages. The timing signals KL, LD and SH are utilized for converting the serial filter coefficient K to a parallel form. These signals KL, LD and SH, therefore, are applied to the zero filter 43 through a line 94. As will be described later, the signal KL is applied simultaneously to the respective stages of the filters 42 and 43 whereas the signals SH and LD are sequentially shifted in the respective stages in the same manner as the serial filter coefficient K.

Figure 14:
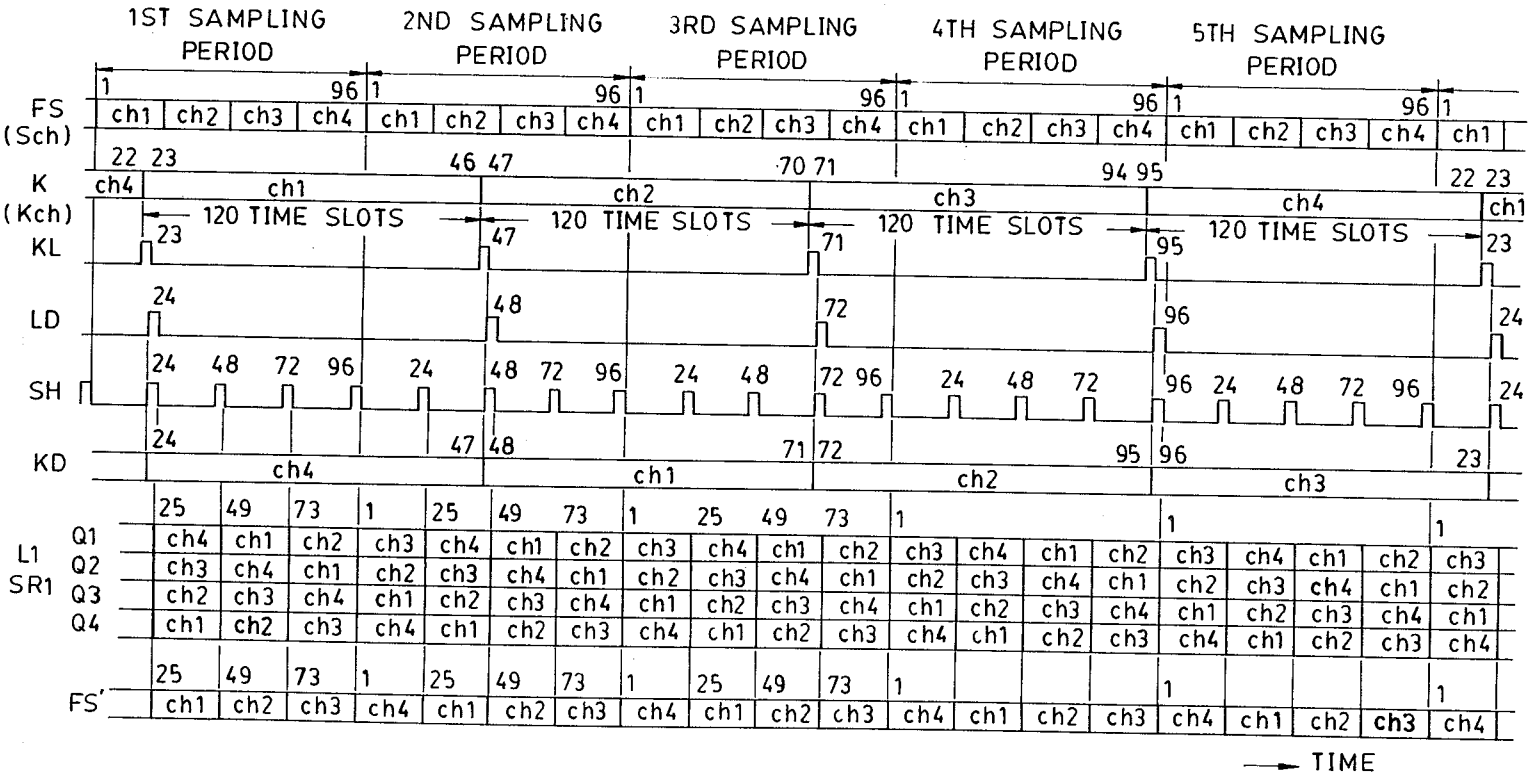
FIG. 14 is a time chart showing serial tone signals, filter coefficients and timing signals inputted to the pole filter shown in FIG. 13 as well as channel timing states of main signals at the first stage of the pole filter.

An example each of the timing signals KL, KD and SH applied to the first stage of the pole filter 42 through a line 95 is shown in FIG. 14. The column of FS in FIG. 14 shows states of the time division channels of the serial tone signal FS which is applied to the first stage filter unit L1 of the pole filter 42 through the selector 87 (i.e., states of time division channels of $S_1$–$S_3$). Likewise, the column of K in FIG. 14 shows the time division channel states ch1–ch4 of the serial filter coefficient data K applied to the first stage unit L1 of the pole filter 42 through a line 96. In FIG. 14, the numerals added to the signal waveform diagram indicate the numbers allotted to the time slots (FIG. 11(*a*)) in one sampling period. The signal FS and data K shown in FIG. 14 are illustrated in detail in FIGS. 11(*b*), and 12(*a*), respectively.

The serial filter coefficient data K and timing signals KL and LD are generated so as to have a cycle corresponding to five sampling periods of the tone signals FS. Naming said five sampling periods the 1st to 5th sampling periods each, the timing signal KL is a signal of which the pulses occur at the 23rd time slot of the first sampling period, at the 47th time slot of the second sampling period, at the 71st time slot of the third sampling period, and at the 95th time slot of the fourth sampling period at a cycle of 120 time slots. The timing signal LD is a similar signal to KL and its pulses occur at a cycle of 120 time slots but each pulse of LD occurs one time slot behind that of KL. In the serial filter coefficient data K, as before, the filter coefficients for one channel are assigned 120 time slots. Specifically, the filter coefficients K for the channel ch1 are assigned the 120 time slots from the 23rd time slot of the first sampling period to the 46th time slot of the second sampling period, thereafter the coefficients K for the channels ch2, ch3 and ch4 being successively assigned in order every 120 time slots in synchronism with the timing of the signal KL. The timing signal SH occurs at a cycle of 24 time slots or at the 24th, 48th, 72nd, and 96th time slots, repeatedly.

The channel selection code Kch generated from the timing signal generation circuit 40 exhibits code contenst representing the respective channels ch1–ch4 in synchronism with the time division channel timing of the filter coefficient K as shown in the column K of FIG. 14. The other channel selection code Sch exhibits code contents representing the respective channels ch1–ch4 in synchronism with the time division channel timing of the serial tone signal FS as shown in the column FS in FIG. 14.

The filter coefficient supply circuit 41 comprises a filter coefficient ROM 97 and a circuit for controlling reading of this ROM 97 in response to tone color parameter TP3. This circuit for controlling reading of the ROM 97 includes a shift register 98, a latch circuit 99, a random access memory 100 (hereinafter referred to as RAM) capable of both writing in and reading out. The tone color parameter TP3 consists of a serialized parameter PD. The shift register 98 and the latch circuit 99 function as a serial-to-parallel converter converting this serial data PD to parallel data. The tone color selection device 12 (FIG. 1) outputs, as information representing the tone color parameter TP3, serialized parameter data PD and a timing pulse PE representing a reference timing for serializing, supplying these signals to the digital filter section 14 through the terminals T2 and T3. The serializing of the tone color parameter TP3 is advantageous because wiring from the tone color selection device 12 to the digital filter section 14 can be simplified.

Figure 15:
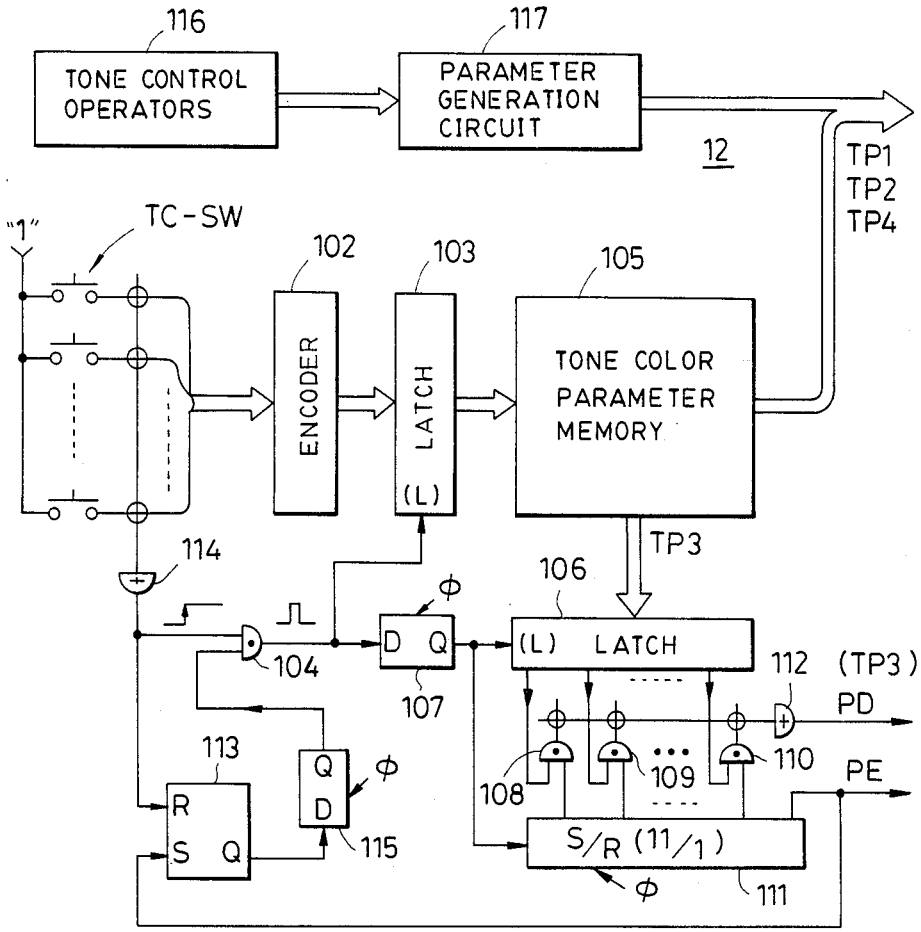
FIG. 15 is a block diagram showing an example of the tone color selection device shown in FIG. 1.

An example of the tone color selection device 12 is shown in FIG. 15. Tone color selection switches TC-SW are provided and outputs thereof are applied to an encoder 102. Upon manipulation of any one of the tone color selection switches TC-SW by the performer, a code signal for the switch is outputted from the encoder 102. The manipulation of the switch TC-SW also causes a load pulse from an AND gate 104 to be applied to a load control input L of the latch circuit 103 and an output code signal of the encoder 102 is loaded in the latch circuit 103. The code signal latched in the latch circuit 103, i.e., the code signal representing the selected tone color, is applied to an address input of a tone color parameter memory 105. The tone color parameter memory 105 prestores data representing tone color parameters in correspondence to selectable various tone colors and provides tone color parameter data corresponding to a tone color selected in accordance with a code signal supplied from the latch circuit 103. Among the data provided by the memory 105, the parameter data TP3 to be supplied to the digital filter section 14 is applied to a latch circuit 106 in parallel. To a load control input L of the latch circuit 106 is applied a load pulse from the AND gate 104 through a delay flip-flop 107. Accordingly, latching timing of the latch circuit 106 is slightly delayed as compared with that of the latch circuit 103. This is for effecting the latching operation of the latch circuit 106 after the tone color parameter TP3 corresponding to the code signal latched in the latch circuit 103 has been completely read out from the memory 105.

The tone color parameter PT3 is digital data of a suitable number of bits, e.g. 10 bits, 5 bits thereof being a tone code TC representing a selected tone color, 3 bits thereof being filter enable signals FE1, FE2 and FE3 representing which of the tone signals $S_1$–$S_3$ of the subchannels #1–#3 is to be supplied to the digital filter main circuit 38 and 2 bits thereof being a channel code CH representing which of the channels USL, USP, UCS and LSP the tone signal to which this tone color is to be imparted belongs to, i.e., which of the filter channels ch1–ch4 this tone color is to be imparted to. The latch circuit 106 has 10 latch sides and latches respective bits of the parameter TP3. Output signals of the 10 latch sites of the latch circuit 106 are applied to one input of 10 AND gates 108, 109 and 110.

A shift register 111 has 11 stages and sequentially shifts a pulse signal supplied from the delay flip-flop 107 to the first stage in response to a clock pulse $\phi$. Output signals of the first to eleventh stages of the shift register 111 are respectively applied to the other input of the 10 AND gates 108, 109 and 110. Outputs of the AND gates 108, 109 and 110 are all applied to an OR gate 112 whose output in turn is applied to the digital filter section 14 as the serial data PD of the tone color paramter TP3. An output signal of the eleventh stage of the shift register 111 is applied to a set input S of the flip-flop 113 and applied also to the digital filter section 14 as the timing pulse PE.

Figure 16:
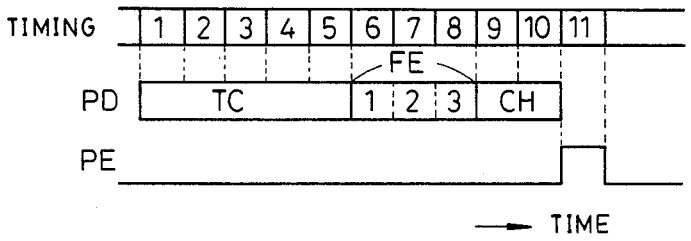
FIG. 16 is a time chart showing an example of a serialized form of tone color parameters outputted from the tone color selection device shown in FIG. 15.

In FIG. 16, an example of state of the serial data PD corresponding to the shift timing of the input pulse in the shift register 111 is shown with the shift timing of the input pulse being indicated by reference characters 1–11. As is also shown in FIG. 16, the filming pulse PE is generated at the timing 11, i.e., immediately after completing outputting of the serial data PD.

An OR gate 114 receives all output signals of the tone color selection switches TC-SW so that the output of the OR gate 114 is turned to "1" when any one of the switches has been depressed. The output signal of the OR gate 114 is applied to the AND gate 104 and also to a reset input R of a flip-flop 113. An output Q of the flip-flop 13 is delayed by a delay flip-flop 115 by one period of the clock pulse $\phi$ and thereafter is applied to the AND gate 104. Normally, the flip-flop 113 is in a set state and the AND gate 104 is in an enabled state. Upon depression of the tone color selection switch TC-SW, the output of the AND gate 104 is turned to "1" in accordance with rising of the output signal of the OR gate 114. The flip-flop 113 is reset simultaneously and the output of the delay flip-flop 115 falls to "0" after one period of the clock pulse $\phi$ thereby disabling the AND gate 104. Accordingly, the AND gate 104 outputs a short pulse of a pulse width equivalent to one period of the clock pulse $\phi$ at the moment when the tone color selection switch TC-SW has been depressed. In response to this output pulse of the AND gate 104, the serial data PD and the timing pulse PE are produced in the above described manner. As the timing pulse PE is generated, the flip-flop 113 is set. The AND gate 104 thereby is set to an enabled state so that a load pulse is generated from the AND gate 104 when the tone color selection switch TC-SW is depressed next time.

The tone color selection device 12 further comprises various tone control manipulators 116. A desired tone color parameter is generated by a parameter generation circuit 117 in response to manipulation of the manipulator 116. Parameter date other than the tone color parameter TP3 for the filter control read out of the tone color parameter memory 105 and predetermined one or ones of parameters outputted from the parameter generation circuit 117 are supplied to the tone signal generation section 11, the control circuit 13 and the external memory device 20 as the tone color parameters TP1, TP2 and TP4. These tone color parameters TP1, TP2 and TP4 may be supplied in the serial data form as in the case of the tone color parameter TP3.

In the embodiment shown in FIG. 15, the tone color selection device 12 is constructed of a discrete circuit. The construction of the device 12, however, is not limited to the discrete circuit but the processing may be made by a microcomputer system. In this case, the processings in the keyboard section 9 and the key assigner 10 (FIG. 1) may also be made by the microcomputer system.

Reverting to FIG. 13, the serial data PD of the tone color parameter TP3 is applied to the shift register 98. The shift register 98 has 10 stages and performs a shift control by the clock pulse $\phi$ in synchronization with the time division time slot of the serial data PD. The timing pulse PE is applied to a control input L of the latch circuit 99. Outputs of the respective stages of the shift register 98 are applied in parallel to the latch circuit 99 and states of the output signals of the respective stages are latched by the latch circuit 99 when the timing pulse PE is supplied thereto. Since the relationship between the serial data PD and the timing pulse PE is as shown in FIG. 16, the timing pulse PE is supplied when the channel code CH is applied to the first and second stages of the shift register 98, the filter enable signals FE3, FE2 and FE1 to the third, fourth and fifth stages, and the tone color code TC to the sixth through tenth stages, these signals being latched precisely by the latch circuit 99.

The RAM 100 memorizes the tone color codes TC corresponding to the filter channels ch1–ch4. The RAM 118 memorizes the filter enable signals FE1–FE3 corresponding to the filter channels ch1–ch4. These RAMs 100 and 118 have memory sites (addresses) corresponding to the respective channels ch1–ch4. To a write control input W of the RAMs 100 and 118 is applied a signal obtained by delaying the timing pulse PE by a delay flip-flop 119. To a write address designation input WAD is applied the channel code CH latched by the latch circuit 99. To a data input of the RAM 100 is applied the tone color code TC latched by the latch circuit 99. To a data input of the RAM 118 is applied the filter enable signals FE1–FE3 latched by the latch circuit 99. Immediately upon loading of the new data TC, FE1–FE3 and CH in the latch circuit 99, the RAMs 100 and 118 are set to a write mode and the tone color code TC and the signals FE1–FE3 are respectively loaded to an address designated by this new channel code ch. In this manner, each time the tone color selection operation is performed (i.e., each time the data PD and PE are provided), data is written in the RAMs 100 and 118 and finally the tone color codes TC of tones selected in correspondence to the respective filter channels ch1–ch4 are stored in the RAM 100 while the filter enable signals FE1–FE3 for the tones selected in correspondence to the filter channels ch1–ch4 are stored in the RAM 118.

To a readout address designation input RAD of the RAM 100 are applied, in time division, channel selection codes Kch for the respective channels ch1–ch4 from the timinig signal generation circuit 40. To a readout address designation input RAD of the RAM 118 are applied, in time division, channel selection codes Sch from the circuit 40. These RAMs 100 and 118 are of a type which is capable of writing while data is being read out. The channel selection codes Kch consist, as shown in the column K in FIG. 14, of signals representing the respective channels ch1–ch4 which are generated in time division with a width of 120 time slots per channel. The RAM 100 provides, in time division, the tone color codes TC for the respective channels ch1–ch4 in response to the codes Kch. The channel selection codes Sch consist, as shown in the column FS in FIG. 14, of signals representing the respcetive channels ch1–ch4 are generated in time division with a width of 24 time slots per channel. The RAM 118 provides, in time division, the filter enable signals FE1–FE3 for the respective channels ch1–ch4 in response to the codes Sch.

The tone color codes TC read out of the RAM 100 are applied to the control input of the selector 101. The selector 101 selects the filter coefficient read out of the filter coefficient ROM 97 in accordance with contents of the tone color codes TC. The filter coefficient ROM 97 prestores sets of filter coefficients corresponding to tone colors which can be selected by the tone color selection device 12. As was previously described, a set of the filter coefficients corresponding to one tone color consists of 15 filter coefficients $K_1$–$K_{15}$ and, as one filter coefficient consists of 8 bits, one set of the filter coefficients is data of 120 bits. Since the number of tone colors which can be selected by the 5-bit tone color code TC is 32 kinds, the ROM 97 stores, e.g. 32 sets of the filter coefficients. The synchronizing pulse KSYNC for reading out the filter coefficients generated by the timing signal generation circuit 40 is supplied to the ROM 97. The ROM 97 reads out, at a predetermined timing, the set of the filter coefficients of 120 bits timewise serially bit by bit in response to the synchronizing pulse KSYNC and effects this serial reading simultaneously in parallel for all tone colors. Respective states of the serial filter coefficient data of the respective sets thus read out in parallel are as shown in FIG. 12(*a*).

The serial data of the filter coefficients for each tone color read out of the ROM 97 is applied to the selector 101. The selector 101 selects a set of the serial filter coefficient data in response to the tone color code TC provided in time division by the RAM 100. In synchronism with the time width of 120 time slots during which the tone color code TC for one channel is supplied, the ROM 97 repeats the serial reading of one set of the filter coefficients for 120 bits. In the meanwhile, the contents of the tone color code TC read out of the RAM 100 change in time division every 120 time slots in response to the channel selection codes Kch. Accordingly, serial data of 4 sets of the filter coefficients corresponding to the tone colors selected in correspondence to the respective filter channels is outputted, in time division, from the selector 101 every 120 time slots. Channel states of the serial filter coefficient data outputted from the selector 101 are the same as those shown in the column K in FIG. 14.

The output of the selector 101 is applied to an input A of the selector 120. The selector 120 receives at the other input B serial data KO of the filter coefficient read out of the external memory device 20 (FIG. 1) through the terminal T5. The serial data form of this serial filter coefficient data KO is entirely the same as the data outputted from the selector 101, i.e., the serial filter coefficient data for the 4 channels ch1–ch4 which is time division multiplexed as shown in the column K in FIG. 14. An output signal KS of the filter coefficient changeover switch 21 (FIG. 1) is applied to a B-selection control input SB of the selector MO through the terminal T4 whereas a signal obtained by inverting this signal KS is applied to an A-selection control input SA. Accordingly, either the output of the external memory device 20 or the output of the selector 101 (i.e., the output of the ROM 97) is selected in response to turning on or off of this switch 21. Thus, the serial filter coefficient data K which has been selected by the selector 120 is applied to the first stage filter unit L1 of the pole filter 42 through the line 96.

Figure 17:
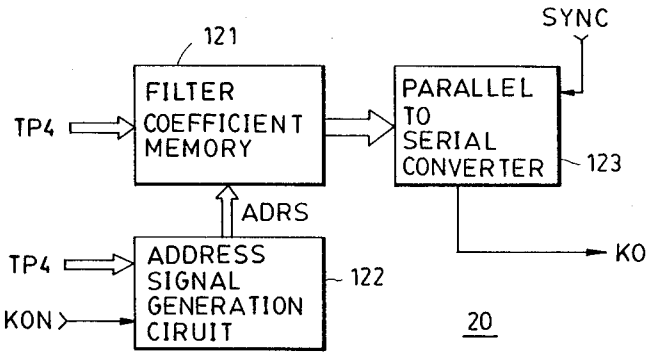
FIG. 17 is a block diagram showing an example of the filter coefficient external memory shown in FIG. 1.

The filter coefficient external memory 20 may be of the same construction as the filter coefficient ROM 97 provided in the digital filter section 14 or alternatively of a construction capable of supplying a filter coefficient which timewise varies in response to the key-on signal KON. An example of the latter type of the external memory 20 is shown in FIG. 17. In FIG. 17, a filter coefficient memory 121 prestores a plural sets of filter coefficients for one tone color with respect to each of plural tone colors, selects plural sets of filter coefficients corresponding to a single tone color in response to the tone color parameter TP4 provided by the tone color selection device 12 (FIG. 1, FIG. 15) and delivers out the selected coefficients set by set in time sequence in response to an address signal ADRS provided by an address signal generation circuit 122. The address signal generation circuit 122 generates the address signal ADRS whose value varies with the lapse of time in response to the key-on signal KON provided by the key-assigner 10 (FIG. 10). The circuit 122 also controls a pattern of the timewise variation of this address signal ADRS in response to the tone color parameter TP4.

Figure 18:
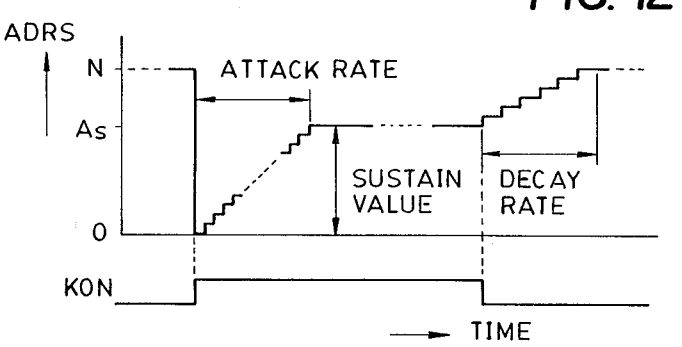
FIG. 18 is a block diagram showing an example of a manner in which an address signal is generated in the address signal generation circuit in FIG. 17.

An example of generation of the address signal ADRS in the address signal generation circuit 122 is shown in FIG. 18. In synchronization with rising of the key-on signal KON, the value of the address signal ADRS is set to "0" and the value of the signal ADRS increases in accordance with a predetermined attack rate in the order of "0", "1", "2"—. As the value of the address signal ADRS has reached a predetermined sustain value As, the increase of the number is ceased and the sustain value As is maintained. Upon subsequent falling of the key-on signal KON, the value of the signal ADRS increases in accordance with a predetermined decay rate in the order of "As", "As+1", "As+2"—. As the value has reached a final value "N", the increase is ceased and the timewise variation of the address signal ADRS in response to the key-on signal KON is ceased. The number of sets of filter coefficients corresponding to one tone color stored in the filter coefficient memory 121 is N sets and the filter coefficients of respective sets are sequentially read out in response to the value "0" through "N−1" of the address signal ADRS. In FIG. 18, the attack rate, decay rate and sustain value As are variably set in response to the tone color parameter TP4.

Since the tone colors to be assigned to the respective filter channels ch1–ch4 are previously known, the filter channel to which the selected tone color belongs is known from the contents of the tone color parameter TP4. In the filter coefficient memory 121, therefore, the filter coefficients of the tone colors selected in accordance with the filter channels ch1–ch4 can be read out in time division in response to the respective channel timings. Thus the filter coefficient memory 121 provides, in time division, one set of filter coefficients consisting of 120 bits in parallel and every channel ch1–ch4 and this one set of filter coefficients varies timewise with the variation in the address signal ADRS. A parallel-serial converter 123 converts a set of filter coefficients consisting of 120-bit data read out of the memory 121 to timewise serial data (consisting of 120 time slots). The synchronizing pulse SYNC is used as a reference timing signal in the serial conversion. The serial filter coefficient data KO thus supplied from the external memory 20 is of a data form as shown in the column K in FIG. 14.

The memory 20 which provides the timewise varying filter coefficient KO serves to realize a tone color in which the frequency characteristic varies with the lapse of time. The frequency characteristic of a human voice in particular changes subtly with time so that the memory 20 is suitable for supplying a filter coefficient for the human voice. To this end, the filter coefficient memory 121 and the address signal generation circuit 122 may be constructed such that they will supply filter coefficients correspondingly to the frequency character change of a desired human voice. In FIG. 18, a constant filter coefficient is read out in the sustain portion with the constant value as being used as the address signal ADRS. The value of the address signal ADRS may, however, be subtly varied periodically in the sustain portion also. For example, it will be effective to subtly change the value of the address signal ADRS in the sustain portion so that the filter coefficient will undergo a slight change periodically.

Reverting to FIG. 13, the filter enable signals FE1--FE3 read out of the RAM 118 are respectively applied to the AND gates 83-85 of the input control circuit 37 and the AND gates 124, 125 and 126 of the output control circuit 39. Any of the AND gates 83-85 in which the filter enable signals FE1-FE3 has become "1" is enabled and a corresponding serial tone signal (one or more of $S_1$-$S_2$) Is selected and applied to the serial adder 86. As was previously described, the timings of the channels ch1-ch4 of the filter enable signals FE1-FE3 read out of the RAM 118 coincide with the channel timings of the serial tone signals $S_1$-$S_3$ shown in the column FS in FIG. 14. Consequently the serial tone signals $S_1$-$S_3$ of the respective subchannels are selected by a combination set in correspondence to the respective filter channels ch1-ch4.

The serial adder 86 will now be described in detail. The serial tone signal $S_2$ provided by the AND gate 84 and the serial tone signal $S_3$ provided by the AND gate 85 are added together in an adder 127 and the output of this adder 127 and the serial tone signal $S_1$ provided by the AND gate 83 are added together in an adder 128. The adders 127 and 128 are both full adders having carry inputs Ci and their carry outputs $C_{0+1}$ are inputted to the carry inputs Ci through AND gates 129 and 130. A time delay of 1 time slot is provided between an addition timing at which a carry out signal is produced and a timing at which a signal "1" is produced from the carry output $C_{0+1}$. As shown in FIG. 11(*b*), in the serial tone signals $S_1$-$S_3$, data of a higher digit bit is allotted to a later time slot. By applying, therefore, a carry out signal outputted from the output $C_{0+1}$ 1 time slot later to the carry input Ci, the carry out signal can be added to data which is 1 bit higher. To the other inputs of the AND gates 129 and 130 are applied a signal obtained by inverting by an inverter 132 the timing signal SH having been generated in the timing signal generation circuit 40 and delayed by a delay circuit 131 by 1 time slot. As shown in FIG. 14, the timing signal SH is a signal which is turned to "1" at the 24th, 48th, 72nd and 96th time slots and the output signal of the delay circuit 131 which has delayed this timing signal SH by 1 time slot is turned to "1" at the 25th, 49th, 73rd and first time slots. Since, on the other hand, the serial tone signals $S_1$-$S_3$ are as shown in FIG. 11(*b*), the output signal of the delay circuit 131 is turned to "1" at the timing of the least significant bit (LSB) of the serial tone signals of the respective channels ch1-ch4 and hence the output of the inverter 132 is turned to "0". This results in inhibition, in the serial addition for each of the channels ch1-ch4, of inputting to the carry input Ci of a carry out signal which has been produced by calculation of a sign bit (SB) of another channel at the time slot of the least significant bit (LSB).

To the other inputs of the AND gates 124-126 of the output control circuit 39 is applied a control code C2. As will be described later, the control codes C1 and C2 are so set that, in a case where an output $Z_0$ of the zero filter 43 is used as an output tone signal of the digital filter chip DFC, control code C2 is always turned to "1". Accordingly, the AND gates 124-126 are always enabled in using the output signal $Z_0$ of the zero filter 43 as the output tone signal and the outputs of the AND gates 124-126 are turned to "1" or "0" depending upon values of the filter enable signals FE1-FE3. The outputs of the AND gates 124-126 are separately applied to the AND gates 90, 91 and 92. In the meanwhile, signals obtained by inverting the output signals of the AND gates 124-126 are separately applied to AND gates 133, 134 and 135. To other inputs of these AND gates 133, 134 and 135 are applied separately the serial tone signals $S_1$-$S_3$ of the respective subchannels. Outputs of the AND gates 90 and 133 are applied to an output terminal $O_2$ through an OR gate 137 whereas outputs of the AND gates 92 and 135 are applied to an output terminal $O_3$ through an OR gate 138.

If the output signal $Z_0$ of the zero filter 43 is used as the output tone signal, the signal $Z_0$ outputted from the zero filter 43 in synchronization with the channel timing at which the filter enable signals FE1-FE3 are turned to "1" is distributed to the output terminals $O_1$, $O_2$ and $O_3$ corresponding to the respective subchannels through the AND gates 90, 91 and 92 corresponding to the signals FE1-FE3 which are "1". In this case, the AND gates 133, 134 and 135 corresponding to the subchannels in which the filter enable signals FE1-FE3 are "0" are enabled to cause the serial tone signals $S_1$-$S_3$ which do not pass through the filter to be led directly to the output terminals $O_1$-$O_3$.

If the output signal $Z_0$ of the zero filter 43 is not used as the output tone signal, the code C2 is "0" and, accordingly, the AND gates 133-135 are always enabled and the AND gates 90-92 are always disabled whereby the input tone signals $S_1$-$S_3$ are directly led to all the output terminals $O_1$-$O_3$.

The pole filter 42 and the zero filter 43 in FIG. 13 may be of the same types as those used in FIGS. 9 and 10. In FIGS. 9 and 10, basic constructions of these filters only are shown and illustration of the circuit for converting the serial filter coefficient data K to parallel data and distributing the data to the multipliers 64, 68—82 of the respective units L1-L12 and the multipliers 73, 74 and 81 of the zero filter 42, the circuit for achieving the time division filter operation concerning the channels ch1-ch4 and the circuits for achieving the serial filter operation is omitted. A specific example of the filter units L1-L12 of the pole filter 42 having the basic construction as shown in FIG. 9 will now be described in conjunction with FIG. 19 and then a specific example of the zero filter 43 will be described.

Figure 19:
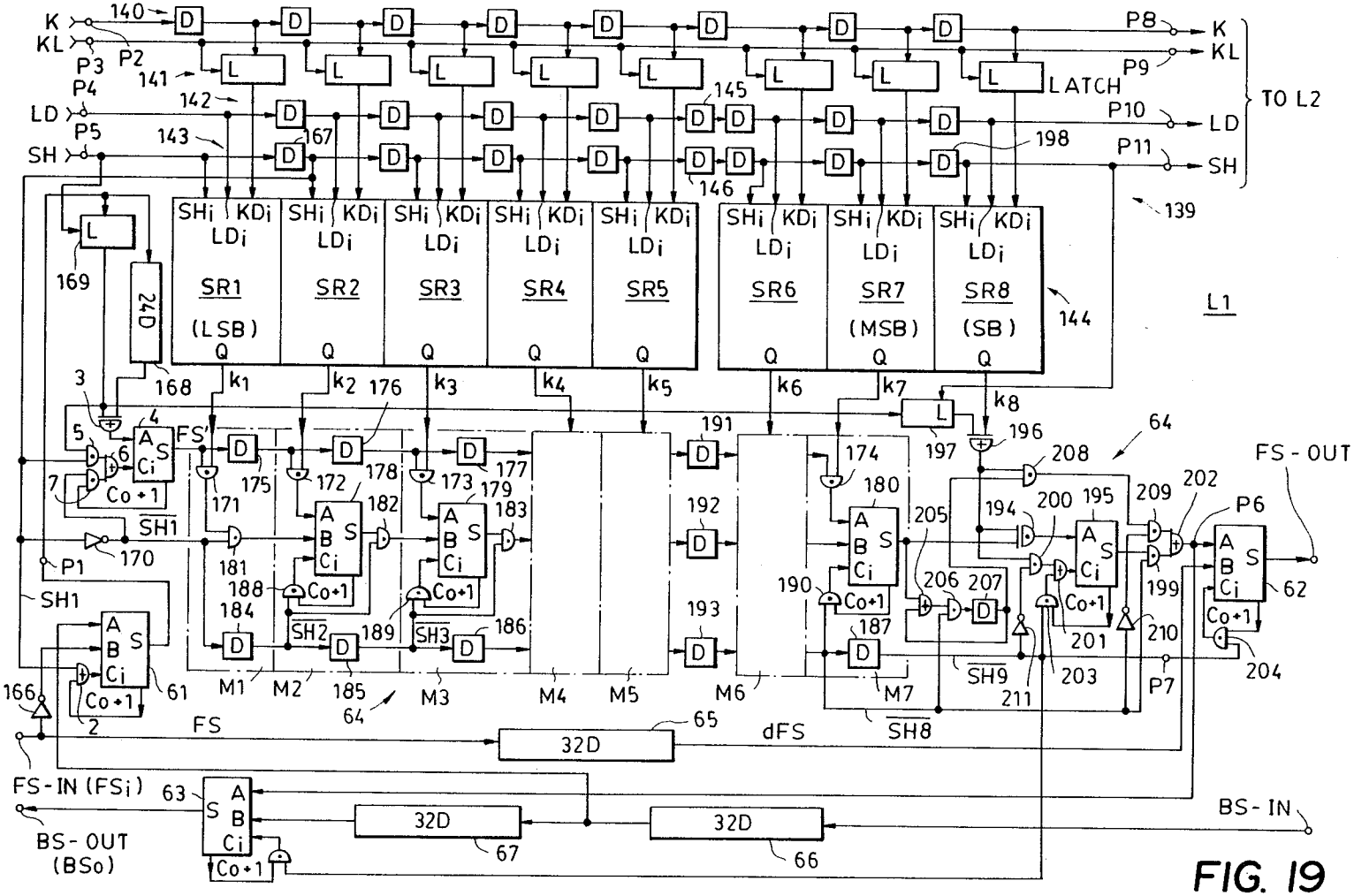
FIG. 19 is a circuit diagram showing a specific example of a first stage of the lattice-type pole filter shown in FIG. 9.

FIG. 19 illustrates a specific example of the 1st-stage filter unit L1 of the pole filter 42. The other filter units L2 to L12 are exactly or substantially the same construction as the unit shown. The circuits in FIG. 19 corresponding to the adders 61, 62, and 63 and delay circuits 65, 66 and 67 in FIG. 9 are designated by the same reference numerals. The circuit section in FIG. 19 corresponding to the multiplier 64 in FIG. 9 is designated generally by the same numeral.

A coefficient distribution circuit 139 which converts the serial filter coefficient K to parallel data by utilizing the timing signals KL, LD, and SH, which was omitted in FIG. 9, is included in FIG. 19. Description will first be made of the circuit 139. The delay circuits that effect a 1-time-slot delay are shown by the letter D in their blocks without reference numerals added unless these reference numerals are necessary for explanation. The coefficient distribution circuit 139 includes delay circuit trains 140, 142 and 143, a latch circuit 141 and a filter coefficient distribution memory 144. A delay circuit train 140 consisting of serially connected eight 1-time-slot delay circuits (i.e. 8-stage serial-shift-parallel-output type register) and a latch circuit 141 consisting of eight 1-bit type latch circuits to which the outputs of the individual circuits of the delay circuit train 140 are respectively inputted are provided to serial-to-parallel convert the serial filter coefficient data K. The serial filter coefficient data K is inputted to the delay circuit train 140 so as to be successively shifted through each of the delay circuits and, after being delayed by eight time slots, supplied to the next-stage unit L2. The timing signal KL is applied to the latch control inputs (L) of the latch circuit 141, enabling the individual latch circuits to latch the outputs of the respective delay circuits of the delay circuit train 140 when the signal KL is a "1". It is assumed that in this example, the output timing of the latch circuit 141 is one time slot behind the latch timing. The numerals 142 and 143 denote delay circuit trains formed of serially connected eight 1-time-slot delay circuits (serial-shift-parallel-output type shift register) similar to the circuit train 140. The timing signals LD and SH are inputted respectively to the delay circuit trains 142 and 143 and successively shifted so as to be delayed by eight time slots and supplied to the next-stage filter unit L2.

Similar circuits to the delay circuit trains 140, 142, and 143 and the latch circuit 141 are provided in the other filter units L2 to L12. Therefore, the serial filter coefficient data K and timing signals LD and SH are sequentially delayed by the filter units L1 to L12 by eight time slots by each unit. The timing signal KL is supplied to the filter units L1 to L12 simultaneously without being delayed. Further, the data K and the signals KL, KD and SH outputted from the final stage filter unit L12 of the pole filter 42 are applied to the zero filter 43 through the lines 93 and 94 (FIG. 13). As will be described later, a circuit similar to the coefficient distribution circuit 139 (delay circuit train 140, 142 and 143, latch circuit 141 and memory 144) is provided in correspondence to the three multipliers 73, 74 and 81 (FIG. 10) of the zero filter 43 and the data K and the timing signals LD and SH inputted from the lines 93 and 94 are sequentially delayed by 8 time slots by the three operation stages of the zero filter 43. The timing signal KL is supplied simultaneously to the respective operation stages of the zero filter 43 without being delayed.

The pulse generation timings of the respective timing signals KL, LD and SH supplied from the timing signal generation circuit 40 (FIG. 13) to the first stage filter unit L1 through the line 95 are, as was previously described, as shown in FIG. 14. The channel timing of the serial tone signal FS supplied from the selector 87 (FIG. 13) to the first stage filter unit L1 and the channel timing of the serial filter coefficient data K supplied from the selector 120 (FIG. 13) to the unit L1 through the line 96 are also as shown in FIG. 14.

As will be apparent from FIG. 14, immediately upon completion of the serial outputting of the filter coefficient data K for one channel, the timing signal KL is generated. As is shown in FIG. 12(*a*), the serial filter coefficient data K for one channel is outputted in sequence from data corresponding to the operation stages of the post stage (multiplier 81, 74 and 73, filter units L12–L1), i.e., in the order of $K_{15}$, $K_{14}$, $-K_1$.

Therefore, upon occurrence of the timing signal KL, the 8-bit filter coefficients $K_1$–$K_{15}$ each corresponding to the filter units L1 to L12 and the operation stages of the zero filter 43 are just located in the delay circuit trains (see 140 in FIG. 19) of the respective units so as to be latched in the latch circuits (see 141 in FIG. 19) of the respective units. Thus the serial filter coefficient data K is converted to parallel data $K_1$–$K_{15}$ by the filter units L1 to L12 and the zero filter operation stages. The parallel data is held in the latch circuits (141 in FIG. 19) until the next latch timing. For example, upon occurrence of the timing signal KL at the 23rd time slot in the first sampling period, the filter coefficient data for the channel ch4 is latched in the latch circuits (141 in FIG. 19) of the units L1 to L12 and the zero filter operation stages and held until the timing signal KL occurs at the 47th time slot in the second sampling period. Accordingly, the latch circuits 141 output the filter coefficients for the channels ch1 to ch4 at a timing as shown KD in FIG. 14.

In FIG. 19, a filter coefficient memory 144 stores the filter coefficients for the respective channels ch1 to ch4 and supplies them to the multiplier 64 at a timing of the serial tone signal FS. The memory 144 consists of eight shift registers SR1 to SR8 corresponding to the respective bits of a filter coefficient. The outputs of the latch circuit 141 that has latched each bit of an 8-bit filter coefficient are supplied to the respective KDi inputs of the shift registers SR1 to SR8. Among the shift registers SR1 to SR8, SR1 corresponds to the least significant bit (LSB), SR7 to the most significant bit (MSB), and SR8 to the sign bit (SB), of the filter coefficient. It is to be noted that the 8-bit filter coefficient data is represented in the sign and magnitude form with the lower seven bits expressing the absolute value of the filter coefficient and the sign bit (SB) which is a higher bit the sign of the coefficient (a "0" meaning that the coefficient is positive and "1" negative). It is assumed that the MSB of the coefficient or the bit corresponding to the shift register SR7 has a weight of decimal 0.5.

The timing signals SH and LD are inputted to the SHi input and LDi input of the shift register SR1, respectively. Further, the signals LD and SH successively delayed by the delay circuit trains 142 and 143 are respectively inputted to the SHi inputs and LDi inputs of the shift registers SR2 to SR8. The 5th-stage delay circuits 145 and 146 in the delay circuit trains 142 and 143 do not provide outputs to any registers since these circuit trains are only provided in view of the calculation time delay, to be described later, in the multiplier 64.

Figure 20:
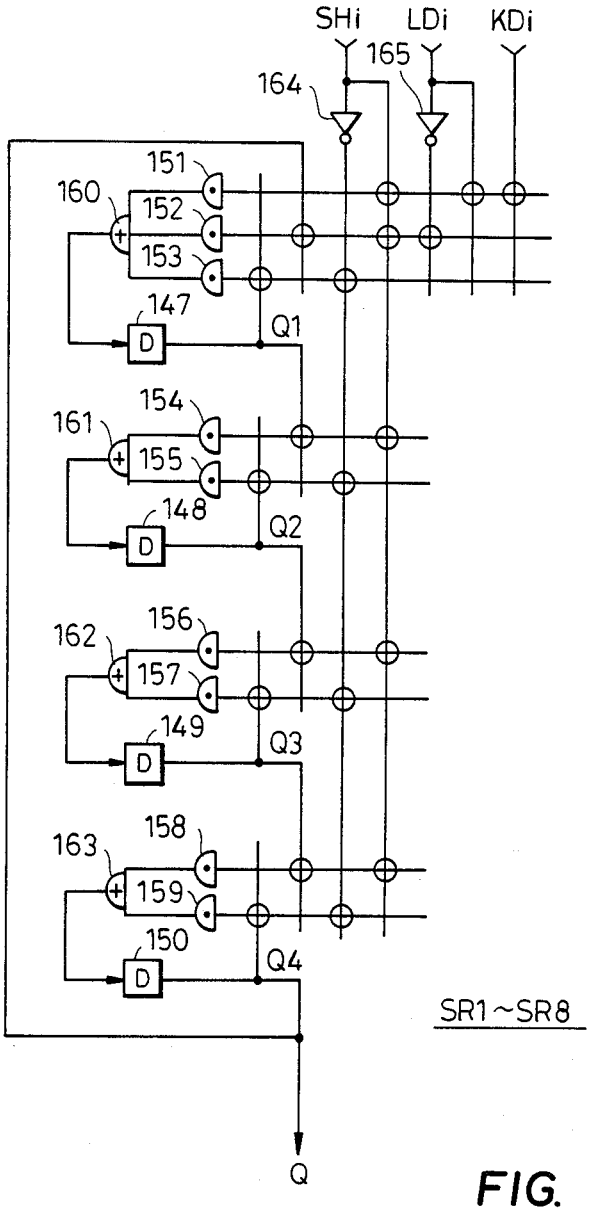
FIG. 20 is a circuit diagram showing an example of internal construction of the shift register for storing filter coefficients shown in FIG. 19.

Each of the shift registers SR1 to SR8 is constructed as shown in FIG. 20. Four 1-time-slot delay circuits 147, 148, 149 and 150 form a 4-stage shift register. KDi is a data input, LDi a new data load control input, and SHi a shift control input. New data applied to the KDi input is loaded into the 1st-stage delay circuit 147 through an AND gate 151 and OR gate 160 when the LDi input and SHi input are both supplied with the signal 1. When the signal to the SHi input is a "0", the signal inverted by an inverter 164 is a "1", which enables AND gates for holding 153, 155, 157 and 159 so that the outputs of the delay circuits 147, 148, 149 and 150 are self-held through these AND gates 153, 155, 157 and 159 and OR gates 160, 161, 162 and 163. When the signal to the SHi input is a "1", the AND gates for holding 153, 155, 157 and 159 are disabled and AND gates for shifting 152, 154, 156 and 158 enabled so that the output Q1 of the 1st-stage delay circuit 147 is shifted to the 2nd-stage delay circuit 148, the output Q2 of the 2nd-stage delay circuit 148 to the 3rd-stage delay circuit 149, the output Q3 of the 3rd-stage delay circuit 149 to the 4th-stage delay circuit 150, and the output Q4 of the 4th-stage delay circuit 150 to the 1st-stage delay circuit 147. The signal to the LDi input is on one hand inverted by an inverter 165 and inputted to the AND gate 152, thereby inhibiting the output Q4 of the 4th-stage from being shifted to the 1st-stage when new data is loaded into the 1st-stage delay circuit 147. Thus each time (every 120 time slots) the signal "1" based on the timing signal LD is applied to the LDi inputs, filter coefficient data is loaded from the latch circuit 141 (FIG. 19) into the first stages of the shift registers SR1 to SR8 whereas each time (every 24 time slots) the signal "1" based on the timing signal SH is applied to the SHi inputs, the data in each stage of the shift registers SR1 to SR8 is shifted to the next stage.

In the case of the shift register SR1 of the 1st-stage filter unit L1, for example, it is when the timing signal LD is generated that the filter coefficient data of the latch circuit 141 is loaded through the KDi input into the 1st-stage delay circuit 147. Specifically, the 1st-stage delay circuit 147 is loaded with the filter coefficient data for the channel ch4 at the 24th time slot in the first sampling period, the data for the channel ch1 at the 48th time slot in the second sampling period, the data for the channel ch2 at the 72nd time slot in the third sampling period, and the data for the channel ch3 at the 96th time slot in the fourth sampling period (see LD, KD, and SR1 of L1 in FIG. 14). Since the timing signal SH occurs five times in one cycle of the timing signal LD, the shifting is effected five times in the shift register SR1. Therefore, the data for the channel ch4 that was loaded into the 1st-stage delay circuit 147 at the 24th time slot in the first sampling period is shifted to the 2nd, 3rd, 4th, and 1st stage in this order each time the signal SH occurs at the 48th, 72nd, 96th, and 24th time slots (see SH in FIG. 14). Then, when the data for the channel ch1 is loaded into the 1st-stage delay circuit 147 at the 48th time slot in the second sampling period, the data for the channel ch4 that was loaded earlier is shifted to the 2nd-stage delay circuit 148. Thus the filter coefficient data for the channels ch1 to ch4 is loaded in order to the individual stages (delay circuits 147 to 150) of the shift register SR1. The rewriting of the filter coefficient data for the channels ch1 to ch4 is completed in the four periods of the timing signal LD or five sampling periods. The rewriting is repeated every five sampling periods. By the control thus effected, the channels ch1 to ch4 to which correspond the filter coefficients that appear in the outputs Q1, Q2, Q3, and Q4 from the respective stages (delay circuits 147 to 150) of the shift register SR1 in the 1st-stage filter unit L1 each occur as shown in FIG. 14 (SR1 of L1).

Reverting to FIG. 19, the signals SH and LD applied to the SHi and LDi inputs of the shift register SR1 are each serially delayed by one time slot and applied to the SHi and LDi inputs of the next-stage shift register SR2 and similarly in SR2 to SR8. Accordingly the variation patterns of the outputs Q1 to Q4 from the respective stages in the shift registers SR2 to SR8 are similar to those of SR1 shown in FIG. 14 (SR1 of L1) but the variation timings are each delayed by one time slot as compared with those in SR1 except that the variation timings (shift timings) in the shift register SR6 are two time slots behind those in SR5 since extra delay circuits 145 and 146 are provided between the shift registers SR5 and SR6. Thus the variation timings (shift timings) are serially shifted through the shift registers SR1 to SR8, with the delay of eight time slots in each filter unit.

In the filter unit L1 shown in FIG. 19, the 4th-stage outputs Q4 (see FIG. 20) are taken out as outputs Q of the shift registers SR1 to SR8 and applied to the multiplier 64.

The serial tone signal FS inputted from the forward input terminal FS-IN (FSi) is inverted by the inverter 166 and applied to the B input of the adder 61. The adder 61 is a full adder and its A input is supplied with the tone signal fed back through the delay circuit 66 from the next-stage filter unit L2. $C_{0+1}$ is a carry-out output. A 1-time-slot delay elapses between the addition timing at which the carry-out signal occurs and the timing at which the signal "1" is outputted from the output $C_{0+1}$. The output signal of the carry-out output $C_{0+1}$ is inputted to the Ci input of the adder 61 through an OR gate 2. As shown in FIG. 11(*b*), the higher bits of the serial tone signal FS are assigned to the later time slots. Therefore, by adding the carry-out signal that was outputted from the output $C_{0+1}$ one time slot behind to the Ci input, the carry-out signal can be added to the data which is higher by one bit. The other input to the OR gate is supplied with the signal SH1 outputted from the 1st-stage delay circuit 167 of the delay circuit train 143. The signal SH1 is one time slot behind the timing signal SH that occurs as shown in FIG. 14 so as to be a "1" at the 25th, 49th, 73rd and first time slots. Since the serial tone signal FS inputted to the input terminal FS-IN (FSi) occurs as shown in FIG. 11(*b*), the signal SH1 goes to "1" at a timing of the LSB of the serial tone signals for the channels ch1 to ch4 so that a "1" is repeatedly added at the LSB timing in the adder 61. This operation is performed to convert into a negative value the tone signal FS supplied from the input terminal FS-IN to the B input of the adder 61. Specifically, the tone signal FS is inverted by the inverter 166 and a "1" added to the LSB of the inverted signal, thereby converting it into a negative value in the two's complement form. The negative values of the tone signal FS supplied to the input terminal FS-IN are also expressed in the two's complement form. Accordingly, when the signal FS is a negative value, it is virtually converted into a positive value by the two's complement forming operation by the inverter 166 and signal SH1. Thus the adder 61 subtracts the tone signal amplitude data applied to the forward input terminals FS-IN from the fed-back tone signal amplitude data supplied to the A input through the backward input terminal BS-IN and delay circuit 66.

The output of the adder 61 is inputted to a delay circuit 168 as well as to the data input of a latch circuit 169. The portion from an input point P1 indicated between the adder 61 and the delay circuit 168 to an output point P6 indicated on the output side of an OR gate 202 corresponds to the multiplier 64. The output signal of the adder 61 indicating the difference between the feedback tone signal and the input tone signal FS is delayed by the delay circuit 168 by 24 time slots and applied to an exclusive OR gate 3. The output of the exclusive OR gate 3 is applied to the A input of an adder 4. The delay circuit 168, latch circuit 169, exclusive OR gate 3 and adder 4 are provided to convert the output signal of the adder 61 expressed in the two's complement form into the sign and magnitude form (sign bit and absolute value).

The latch control input (L) of the latch circuit 169 is supplied with the timing signal SH. The signal of the SB is outputted from the adder 61 at the 24th, 48th, 72nd and 96th time slots at which time slots the signal SH occurs (see FIG. 11(*b*)) so that the SB value is latched in the latch circuit 169. The output of the latch circuit 169 is applied to the exclusive OR gate 3 and AND gate 5. For example, in the 24 time slots from the 25th to 48th time slots during which the latch circuit 169 outputs the SB for the channel ch1 that is latched at the 24th time slot, the delay circuit 168 outputs the signal for the channel ch1 that was outputted from the first to 24th time slots from the adder 61 but delayed by 24 time slots. The channels of the SB signal outputted from the latch circuit 169 and the signal from the delay circuit 168 coincide with each other. When the SB signal latched in the latch 169 is a "0" or positive, the output signal of the delay circuit 168 passes the exclusive OR gate 3 as it is and, through the A input of the adder 4, outputted from the S output as it is. When the SB signal is a "1" or negative, the output of the delay circuit 168 is inverted by the exclusive OR gate 3. At the same time, an AND gate 5 is enabled by the output "1" of the latch circuit 169 and outputs the signal "1" at a timing of the signal SH1 and, accordingly, a "1" is applied to the Ci input of the adder 4 through an OR gate 6. The signal SH1 is the timing signal SH as delayed by one time slot and corresponds to the LSB. For example, in the period from the 25th to 48th time slots during which the delay circuit 168 outputs the signal for the channel ch1, the signal SH1 goes to 1 at the 25th time slot so that the adder 4 adds a "1" to the output signal for the LSB from the exclusive OR gate 3. The carry-out signal generated as a result of this addition is outputted from the Co+1 output one time slot later and applied to the Ci input through an AND gate 7 and OR gate 6. The other input to the AND gate 7 is supplied with a signal $\overline{\text{SH1}}$, the inverse of the SH1, from an inverter 170. At the LSB calculation timing, the AND gate 7 is disabled by a "0" of the signal $\overline{\text{SH1}}$ in order to inhibit the carry-out signal from the MSB for a channel at the preceding calculation timing. Thus a negative value expressed in the two's complement form is converted into the absolute value by the inversion at the exclusive OR gate 3 and addition of a "1" to the LSB.

By the construction described above, the signal FS' expressing the output signal of the adder 61 in the form of an absolute value is outputted from the S output of the adder 4. The states of the signal FS' in relation to the channels ch1 to ch4 are shown FS' in FIG. 14. As can be seen, the signal FS' is 24 time slots behind the input tone signal FS in timing. Similar to the signal FS shown in FIG. 11(*b*), the signal FS' is serial data of 24 bits (time slots) led by the LSB.

The multiplier 64 multiplles than 24-bit serial data FS' outputted from the adder 4 by the 8-bit filter coefficients outputted from the respective shift registers SR1 to SR8. The serial multiplication involving 24-bit data and 8-bit data generally requires the operation time for 32 time slots. However, since a time division operation for the individual channels must be performed every 24 time slots, the product involving the higher 24 bits including the sign bit SB is obtained, truncating the multiplication result involving the lower eight bits. The multiplier 64 comprises seven multiplier portions M1 to M7 corresponding respectively to the bits representing the absolute value portion of the filter coefficient outputted in parallel from the shift registers SR1 to SR7. These portions M1 to M7 are serially connected in this order. The portions M4, M5, and M6, not shown in detail, are of the same construction as the portions M2 and M3.

The portions M1 to M7 respectively comprise AND gates 171, 172, 173 . . . 174 for obtaining partial products and to these AND gates are inputted, respectively, the bits k1, k2 . . . K7 representing the absolute value portion of the filter coefficient outputted from the shift registers SR1 to SR7. The portions M1 to M6 respectively comprise serially connected delay circuits 175, 176, 177 . . . which serially delay the output signal FS' of the adder 4, each by one time slot. The outputs of these delay circuits are applied to the AND gates 172, 173 . . . 174, respectively. The AND gate 171 of the portion M1 is supplied with the signal FS' not delayed. The portions M2 to M7 respectively comprise adders 178, 179 . . . 180 which add the partial products obtained by the AND gates 171 to 174. Since the signal FS' is delayed by the delay circuits 175, 176, 177 successively, the weights of the outputs from the AND gates 171 to 174 coincide with each other at each time slot so that the adders 178 to 180 may add partial products having the same weight.

The partial products of the individual bits, i.e., the outputs of the AND gates 172 to 174 are applied to the A input of the adders 178 to 180. The partial products or sums of the partial products are inputted to the B inputs through AND gates 181, 182, 183 . . . . The AND gate 181 is supplied with the output of the AND gate 171 and the output signal $\overline{\text{SH1}}$ of the inverter 170. The AND gates 182, 183 . . . are supplied with the outputs of the adders 178, 179 . . . and the signals obtained by delaying said signal $\overline{\text{SH1}}$ by delay circuits 184, 185, 186 . . . in order successively. These AND gates 181, 182, 183 . . . are provided to truncate the partial products of the lower bits. The carry-out outputs $C_{0+1}$ of the respective adders 178, 179, . . . 180 are inputted to the carry-in input Ci through AND gates 188, 189 . . . 190. The other inputs of the AND gates 188, 189 . . . 190 are supplied with the signals each obtained by delaying the signal $\overline{\text{SH1}}$ by the delay circuits 184, 185, 186 . . . in order successively. While the AND gates 188, 189 . . . 190 enable the addition of carry-out signals for the same channel to be performed, they also serve to prevent the carry-out signal of the MSB for a channel at the preceding calculation timing from being added to the LSB for the following channel.

Delay circuits 191, 192 and 193 are provided between the portions M5 and M6 to compensate for the calculation delay of the AND gates 181, 182, 183 . . . and adders 178, 179 . . . in the portions M1 to M5. The sum of the calculation time delay in these portions M1 to M5 (shorter than one time slot) are adjusted to one time slot delay by the delay circuit 192 for synchronism with the change of time slots. Further, the delay circuit 191 is inserted in the line of the delay circuits 175, 176, 177 . . . while the delay circuit 193 in the line of the delay circuits 184, 185, 186 . . . for synchronism. Also, to keep pace with this delay, the extra delay circuits 145 and 146 are inserted in the delay circuit trains 142 and 143 respectively.

Thus the adder 180 in the portion M7 outputs serial data corresponding to the product of the signal FS' and the absolute-value part (bits k1 to k7) of the filter coefficient. The output of the adder 180 is applied to the A input of an adder 195 through an exclusive OR gate 194. The exclusive OR gate 194 and adder 195 are provided to convert the product of the respective sign bits of the signal FS' and the filter coefficient into the two's complement form in respone to the multiplication result. The data k8 representing the filter coefficient sign bit SB is inputted to the exclusive OR gate 196 from the shift register SR8. The SB of the signal FS' is latched in the latch circuit 169. A latch circuit 197, provided to synchronize the output signal of the latch circuit 169 with the output of the shift register SR8, latches the output of the latch circuit 169 at the timing when the 8th-stage delay circuit 198 in the delay circuit train 143 goes to 1. The output of the latch circuit 197 is supplied to the other input of the exclusive OR gate 196. Since the latch timing of the latch circuit 197 and the shift timing of the shift register SR8 synchronize with each other, the respective sign bit data of a filter coefficient and signal FS' for the same channel are inputted to the exclusive OR gate 196 in synchronism. The exclusive OR gate 196 outputs the signal "1" indicating "negative" when the sign bits do not coincide with each other and the signal "0" indicating "positive" when they coincide. When the output of the exclusive OR gate 196 is a "0", meaning the sign of the product is positive, the output of the adder 180 is passed through the exclusive OR gate 194 and adder 196 as it is and applied to the AND gate 199. When the output of the exclusive OR gate 196 is a "1", meaning that the sign of the product is negative, the output of the adder 180 is inverted by the exclusive OR gate 194 and applied to the A input of the adder 195. When the output of the exclusive OR gate 196 is a "1", an AND gate 200 supplies a "1" through an OR gate 201 to the Ci input of the adder 195 at the LSB timing as will be described later. Thus a negative product is converted into the two's complement form.

The product expressed in the two's complement form is supplied from the adder 195 through the AND gate 199 and OR gate 202 to the A input of the adder 62. It is noted that AND gates 203 and 204 which control the supply of the carry-out outputs $C_{0+1}$ of the adders 195 and 62 to the carry-in inputs Ci are provided for the same purpose as the AND gates 188, 189 . . . 190.

The loop consisting of an OR gate 205 supplied with the output of the adder 180, an AND gate 206, and delay circuit 207 is provided to detect whether the bits of the product are all "0". The signal $\overline{SH8}$ obtained by delaying the signal $\overline{SH1}$ by seven time slots is applied to the AND gate 206. The stored contents in the loop is reset by the signal $\overline{SH8}$. When the output of the adder 180 went to "1" even once, a "1" is held in the loop 205, 206, 207. When any bits of the output of the adder 180 did not become "1" at all, that is, the product was all "0", a "1" is not stored but a "0" remains in the loop 205, 206, 207. The outputs of the delay circuit 207 and exclusive OR gate 196 are inputted to an AND gate 208. When the product is not all "0", the output of the exclusive OR gate 196, i.e., the product of the sign bits, passes the AND gate 208 as it is. When the product is all "0", the AND gate 208 is disabled so that its output is a "0" (indicating the positive sign) whatever the output of the exclusive OR gate 196 may be. The output of the AND gate 208 is applied through an AND gate 209 and an OR gate 202 to the A input of the adder 62. The AND gate 209 is only enabled at the sign bit timing by the signal obtained by inverting the signal $\overline{SH8}$ by the inverter 210. Thus the output of the AND gate 208 indicates the sign bit of the product, the sign bit being forced to "0" or positive state when the product is all "0".

Figure 21:
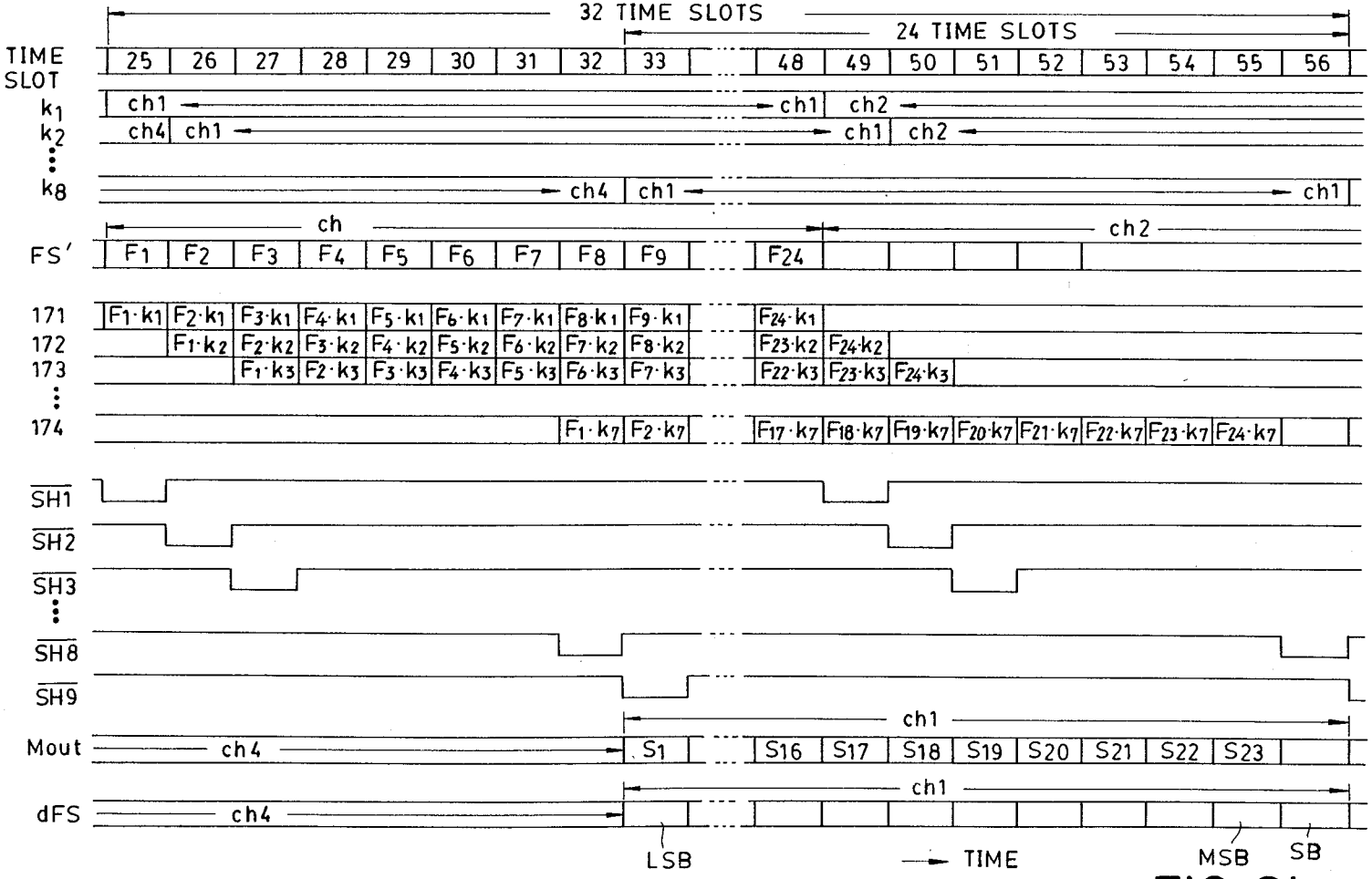
FIG. 21 is a time chart for explaining the serial multiplication in the multiplier shown in FIG. 19.

The calculation operation will now be described in detail with reference to FIGS. 19 and 21. FIG. 21 indicates the 25th to 56th time slots of the first sampling perod. Using the 32 time slots shown, multiplication of the 24-bit signal FS' by 8-bit filter coefficient for the channel ch1 is carried out. However, in the first eight (25th to 32nd) of the 32 time slots which are also the calculation timing of the higher bits for the channel ch4 that precedes the channel ch1, the priority is given to the calculation relating to the channel ch4, truncating the calculation for the channel ch1. Therefore, the multiplication for the channel ch1 is virtually carried out during the 24 time slots form the 33rd to 56th time slots.

k1 to k8 in FIG. 21 shows the states of the bits k1 to k8 of the filter coefficient outputted in parallel from the shift registers SR1 to SR8, in respect of the channels ch1 to ch4. As shown L1-SR-Q4 in FIG. 14 also, the LSB k1 of the filter coefficient outputted from the shift register SR1 covers the channel ch1 from the 25th to 48th time slots and shifts to the channel ch2 at the 49th time slot. As described before, since the shift timings of the respective shift registers SR1 to SR8 are serially stepped by one time slot, the bit k2 outputted from the shift register SR2 shifts to the channel ch1 at the 26th time slot and k3 to k7, though not shown in FIG. 21, at the 27th, 28th, 29th, 31st and 32nd time slots respectively. The bit k8 outputted from the shift register SR8 shifts to the channel ch1 at the 33rd time slot. It is noted that the bit k6 outputted from the shift register SR6 shifts to the channel ch1 at the 31st time slot instead of the 30th time slot because the extra delay circuits 145 and 146 are provided.

FS's in FIG. 21 shows the state of the signal FS' outputted serially from the adder 4. As shown also FS' in FIG. 14, the signal FS' covering the channel ch1 is outputted during the 24th time slots from the 25th to 48th time slots. FIG. 21 shows the timings of the respective bits F1 to F24 of the signal FS' for the channel ch1, F1 being the LSB.

171 to 174 in FIG. 21 shows the states of the partial product calculation performed at every time slot by the partial product calculation AND gates 171 to 174 of the respective multiplier portions M1 to M7. For example, "F1.k1" indicates the multiplication of the LSB F1 of the signal FS' by the LSBN k1 of the filter coefficient. As will be seen, the AND gate 171 of the portion M1 multiplies the respective bits F1, F2, F3 . . . F24 of the signal FS' successively supplied in order from the lower bits by the LSB k1 of the filter coefficient at all times. The timing at which the bit k1 shifts to the channel ch1 coincides with the timing at which the LSB of the signal FS' for the channel ch1 is applied to the AND gate 171 and, at that timing, i.e., the 25th time slot, the AND gate 171 outputs the partial product F1.k1. Therefore, in the 24 time slots (from the 25th to 48th time slots) during which the bit k1 retains a value for the channel ch1, the AND gate 171 successively finds the partial products F1.k1 to F24.k1 of the respective bits F1 to F24 of the signal FS' and the LSB k1 of the filter coefficient as shown in FIG. 21. Multiplication of the signal FS' by the other bits k2 to k7 of the filter coefficient is likewise performed by teh AND gates 172 to 174 in the respective portions M2 to M7. However, the calculation timings are serially stepped as shown in FIG. 21 because the signal FS' is serially delayed by the delay circuits 175, 176, 177 . . . before it is multiplied by the respective bits k2 to k7.

FIG. 21 ($\overline{SH1}$ to $\overline{SH9}$) shows the states of the signals $\overline{SH1}$ and $\overline{SH2}$ to $\overline{SH9}$ obtained by serially delaying the signal $\overline{SH1}$ by the delay circuits 184 to 187. The signal $\overline{SH2}$ outputted from the delay circuit 184 is one time slot behind the signal $\overline{SH1}$ and the signal $\overline{SH3}$ outputted from the delay circuit 185 is two time slots behind the signal $\overline{SH1}$. The signal $\overline{SH8}$ outputted from the delay circuit (not shown) in the portion M6 is obtained by delaying the signal $\overline{SH1}$ by seven time slots. The signal $\overline{SH9}$ outputted from the delay circuit 187 in the portion M7 is obtained by delaying the signal $\overline{SH8}$ by another one time slot.

At the 25th time slot, the signal $\overline{SH1}$ in the "0" state disables the AND gate 181 in the portion M1 so as to truncate the partial product F1.k1 outputted from the AND gate 171. At that time, the protions M2 to M7 find the partial products relating to the channel ch4 that precedes in the calculation timing so that the multiplier 64 outputs the multiplication result relating to the channel ch4.

At the following 26th time slot, the signal $\overline{SH2}$ in the "0" state disables the AND gate 182 in the portion M2 so as to truncate the output of the adder 178 that is the sum of the partial product F2.k1 outputted from the AND gate 171 and the partial product F1.k2 outputted from the AND gate 172. At that time, the portions M3 to M7 find the partial products relating to the channel ch4 so that the multiplier 64 outputs the multiplication results relating to the channel ch4.

Thus, up to the 31st time slot, the multiplication results relating to the channel ch1 are truncated by the delay signals $\overline{SH3}$ . . . of the signal $\overline{SH1}$. At the 31st time slot, the output of the adder (not shown) in the portion M6 is inhibited by the signal $\overline{SH7}$ (not shown) obtained by delaying the signal $\overline{SH1}$ by six time slots. At that time, the adder in the portion M6 outputs the sum of the partial product F6.k1+F5.k2+F4.k3+F3.k4+F2.k5+F1.k6. Referring to FIG. 21, the partial products F6.k1, F5.k2, F4.k3 . . . are produced at the 30th time slot. However, since the sum of the partial products yielded by the portions M1 to M5 is delayed by one time slot by the delay circuit 192, the sum is outputted from the portion M6 at the 31st time slot.

At the 32nd time slot, the multiplication results relating to the channel ch1 is not truncated in the portions M1 to M7. Therefore, the adder 180 in the portion M7 outputs the sum of the partial products F7.k1+F6.k2+F5.k3+ . . . F1.k7. However, the output of the adder 180 is inputted through the exclusive OR gate 194 and the adder 195 to the AND gate 199 and inhibited by the signal $\overline{SH8}$ in the "0" state that is applied to the other input of the AND gate 199. Therefore the multiplication result relating to the channel ch1 is also truncated at the 32nd time slot. As described before, until the 32nd time slot, the adder 64 (specifically, the OR gate 202 that is the output circuit of that adder) outputs the multiplication results relating to the channel ch4 that precedes in the calculation timing.

From the 33rd to 48th time slots, the signals SH1 to SH8 are all in the "1" state so taht the AND gates 181, 182, 183 . . . 199 are all enabled. During this period, therefore, the adder 64 outputs the sum of all the partial products relating to the channel ch1 that were obtained in the portions M1 to M7. While the signals $\overline{SH1}$ to $\overline{SH8}$ successively become "0" from the 49th to 56th time slots, this is to truncate the partial products relating to the following channel ch2 and the adder 64 does not fail to output the multiplication results relating to the channel ch1. Accordingly, the adder 64 virtually outputs the multiplication results relating to the channel ch1 during the 24 time slots from the 33rd to 56th time slots.

FIG. 21 (Mout) illustrates the timings of the bits S1 to S23 of the serial multiplication output relating to he channel ch1. As will be apparent from the above description, the LSB S1 of the multiplication result outputted at the 33rd time slot equals the sum of the partial products as given below together with those for S2, S3, . . . S21, S22 and S23.

$$S1=F8.k1+F7.k2+F6.k3+\ldots+F2.k7$$

$$S2=F9.k1+F8.k2+F7.k3+\ldots+F3.k7$$

$$S3=F10.k1+F9.k2+F8.k3+\ldots+F4.k7$$

$$\vdots$$

$$S21=F24.k5+F23.k6+F22.k7$$

$$S22=F24.k6+F23.k7$$

$$S23=F24.k7$$

It is noted that the MSB F24 of the signal FS' corresponds to the sign bit of the output of the adder 61 which, when positive, is passed through the exclusive OR gate 3 as it is, i.e., "0" and, when negative, its "1" state is inverted by the exclusive OR gate 3 to the "0" state. F24 therefore remains "0" all the time.

As will be seen from FIG. 21, the signal $\overline{SH9}$ goes to "0" at a timing of the LSB S1 of the multiplication output. Therefore, by having the signal $\overline{SH9}$ inverted by the inverter 211 and then inputted to the AND gate 200, it is possible to perform the addition of "1" to the LSB for the two's complement forming operation by the adder 195.

The signal $\overline{SH8}$ is inputted to the AND gate 206 in the loop 205 to 207 provided for all-"0" detection. As shown in FIG. 21, the signal $\overline{SH8}$ becomes "0" immediately before the LSB S1 of the multiplication output. Therefore, the loop 205 to 207 is reset (e.g. at the 32nd time slot) immediately before the adder 180 outputs a new multiplication result. In case the multiplication result outputted from the adder 180 is all 0, the delay circuit 207 still outputs the signal "0" at the time slot (e.g. the 56th time slot) immediately following the output timing of the MSB S23 of the multiplication output.

Whether the multiplication result is all "0" or not is thus known accurately at the time slot immediately following the timing of the LSB S23 of the serial multiplication output. At that time, the AND gate 209 is enabled by the inverted signal from the inverter 210 of the signal SH8 so as to select the data representing the sign bit of the multiplication output. As stated before, the sign bit data corresponds normally to the output signal of the exclusive OR gate 196 but is forced to "0" by the signal 0 of the delay circuit 207 when the multiplication output is all "0".

Thus the output of the adder 64 applied to the A input of the adder 62 through the OR gate 202 is a 23-bit serial data S1 to S23 occurring in order from the LSB and followed by the sign bit. The multiplication output data S1 to S23 for a negative value is represented in the two's complement form.

The tone signal dFS supplied from the delay circuit 65 to the B input of the adder 62 meanwhile is shown in FIG. 21. As the tone signal FS for the channel ch1 applied to the input terminal FS-IN from the first to 24th time slots is delayed by 32 time slots by the delay circuit 65, the tone signal dFS for the channel ch1 is outputted from the delay circuit 65 from the 33rd to 56th time slots. Therefore, the channels of the signals applied to the A and B inputs of the adder 62 coincide with each other and it is possible to add the multiplication output and the tone signal of the same channel. Assuming that the LSB of the tone signal (having the same weight as the bit F1 of the signal FS') has a weight of decimal 1, the LSB S1 of the output of the multiplier 64 also has a weight of decimal 1. As before, the bit S1 is the sum of the partial products F8.k1+ . . . +F2.k7. Referring to the partial product F2.k7 in particular, the bit F2 has a weight of decimal 2 because it is one bit more significant than the bit F1 and, since F2.k7 has a weight of decimal 1, the bit K7 has a weight of decimal 0.5. Thus the calculation processing is effected so that the LSB k7 of the filter coefficient k1 to k7 has a weight of 0.5. This means that the absolute value of the filter coefficient is smaller than 1.

The output of the adder 62 is inputted through the forward output terminal FS-OUT to the next-stage filter unit L2. The filter unit L2 performs the same operation as mentioned before based on the tone signal supplied from the preceding filter unit L1 through the forward input terminal (corresponding to FS-IN shown in FIG. 19) of the unit L2, the filter coefficient stored in the shift registers (corresponding to SR1 to SR8 in FIG. 19), etc. However, while there is a 32-time slot delay in the tone signal between the input terminals FS-IN and output terminals FS-OUT of the respective filter units L1 to L12, there is an 8-time-slot delay in the timing signals LD and SH between the same terminals. If, therefore, the units L2 to L12 were all of the same construction as the unit L1, discrepancy would result in the channels of the filter coefficient k1 to k8 and the signal FS' in the multiplier (corresponding to 64 in FIG. 19). In order to register the channels of the filter coefficient k1 to k8 and the signal FS' in the multipliers (corresponding to 64 in FIG. 19) of the respective units L1 to L12, the outputs Q of the shift registers SR1 to SR8 are each taken out at the different stages of these shift registers, depending on the filter units L1 to L15. Specifically, the 4th-stage outputs Q4 (see FIG. 20) of the shift registers SR1 to SR8 are taken out as outputs Q in the unit L1, the 1st-stage outputs Q1 in the unit L2, the 2nd-stage outputs Q2 in the unit L3, the 3rd-stage outputs Q3 in the unit L4, the 4th-stage outputs Q4 in the unit L5 and so on, thereby successively stepping the stages at which the outputs Q are taken out.

Figure 22:
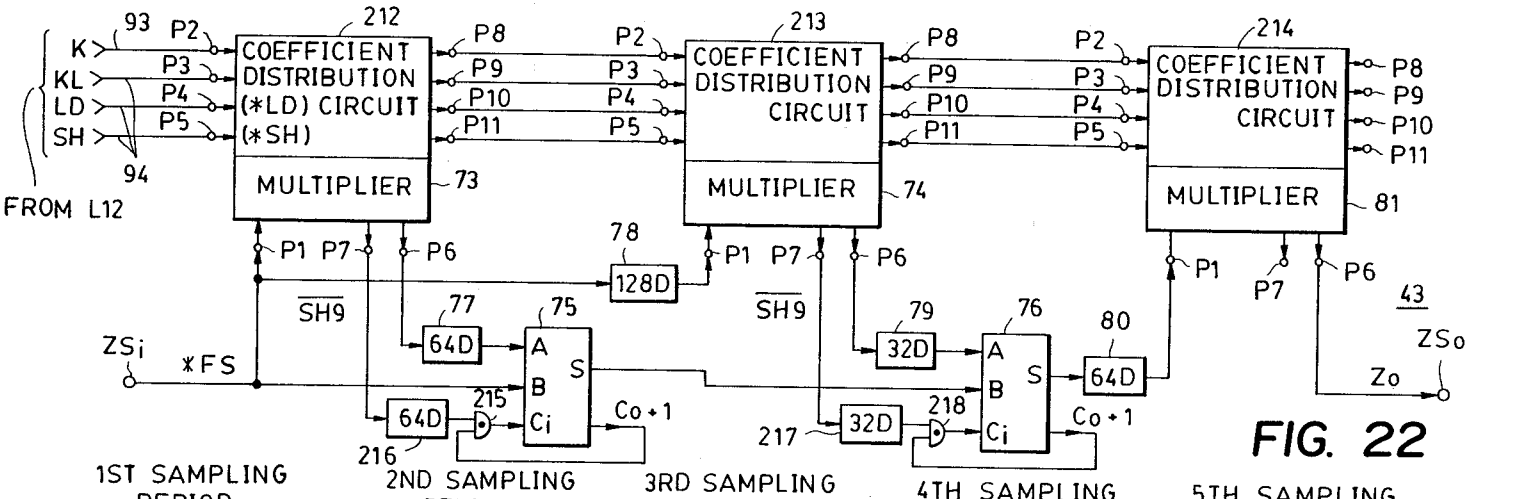
FIG. 22 is a circuit diagram showing a specific example of the zero filter shown in FIG. 10.

FIG. 22 shows the zero filter in FIG. 10 in further detail. The circuits in FIG. 22 corresponding to the multipliers 73, 74 and 81, the adders 75 and 76 and the delay circuits 77, 78, 79 and 80 in FIG. 10 are designated by the same reference numerals. Coefficient distribution circuits 212, 213 and 214 which are omitted in FIG. 10 are illustrated in FIG. 22.

The internal constructions of the multipliers 73, 74 and 81 and the coefficient distribution circuits 212, 213 and 214 in the respective operation stages can be the same as those shown in FIG. 19 (64 and 139), i.e., each of the multipliers 73, 74 and 81 can be of the same construction as the multiplier 64 in FIG. 19 and each of the coefficient distribution circuit 212, 213 and 214 as the coefficient distribution circuit 139 in FIG. 19 (the portion consisting of the delay circuit train 140, 142 and 143, the latch circuit 141 and the coefficient memory 144). More specifically, input points P1, P2, P3, P4 and P5 and output points P6, P7, P8, P9, P10 and P11 in the block of the multiplier 73 and the coefficient distribution circuit 212 in the first operation stage correspond to points of the same reference numerals in FIG. 19. The specific circuit of the multiplier 64 in FIG. 19 from the input point P1 indicated on the input side of the delay circuit 168 and the latch circuit 169 to the output point P6 indicated on the output side of the OR gate 202 and the output point P7 indicated on the line of the signal $\overline{SH9}$ is entirely the same as the specific circuit of the multiplier 73 in FIG. 22. Furhter, the specific circuit of the coefficient distribution circuit 139 in FIG. 19 from the input points P2–P5 indicated on the input lines of the data K and signals KL, LD and SH to the outputs points P8–P11 indicated on the output lines is entirely the same as the coefficient distribution circuit 212 in FIG. 22. Furthermore, in the same manner as the coefficient distribution circuit 139 in FIG. 19 in which the output Q of the shift register SR1–SR8 of the filter coefficient memory 144 is applied to the multiplexer 64, a signal representing the filter coefficient is applied from the coefficient distribution circuit 212 to the multiplier 73 in FIG. 22. In the multiplier 74 and the coefficient distribution circuit 213 in the second operation stage and the multiplier 81 and the coefficient distribution circuit 214 in the third operation stage, the input and output points P1–P11 correspond to the points of the same reference numerals in FIG. 19.

Stages of the shift registers SR1–SR8 (FIG. 19) in the respective coefficient distribution circuits 212, 213 and 214 from which the output Q is taken out are successively shifted in the same manner as in the previously described pole filter units L1–L12. Since the output Q3 of the third stage (FIG. 20) is taken out in the last pole filter unit L12, the fourth stage output Q4 (FIG. 20) is taken out in the first operation stage (distribution circuit 212) of the zero filter 43, the first stage output Q1 is taken out in the second operation stage (distribution circuit 213) and the second stage output Q2 is taken out in the third operation stage (distribution circuit 214).

In FIG. 22, the serial filter coefficient data K and the timing signals KL, LD and SH provided from the last unit L12 of the pole filter 42 through lines 93 and 94 are applied to the first stage coefficient distribution circuit 212. The data K and the signals KL, LD and SH thereafter are supplied to the second stage coefficient distribution circuit 213 and further supplied from the second stage circuit 213 to the third stage circuit 214. As was previously described, the data K and the signals LD and SH are respectively delayed by 8 time slots in the circuits 212, 213 and 214 of the respective stages whereas the signal KL is not delayed. Finally, in the memory 144 in each of the coefficient distribution circuits 212, 213 and 214 (see FIG. 19) of the respective stages, predetermined filter coefficients corresponding to the operation stages ($K_{13}$, $K_{14}$ and $K_{15}$ in FIG. 10) are stored with respect to each of the channels ch1–ch4.

Figure 23:
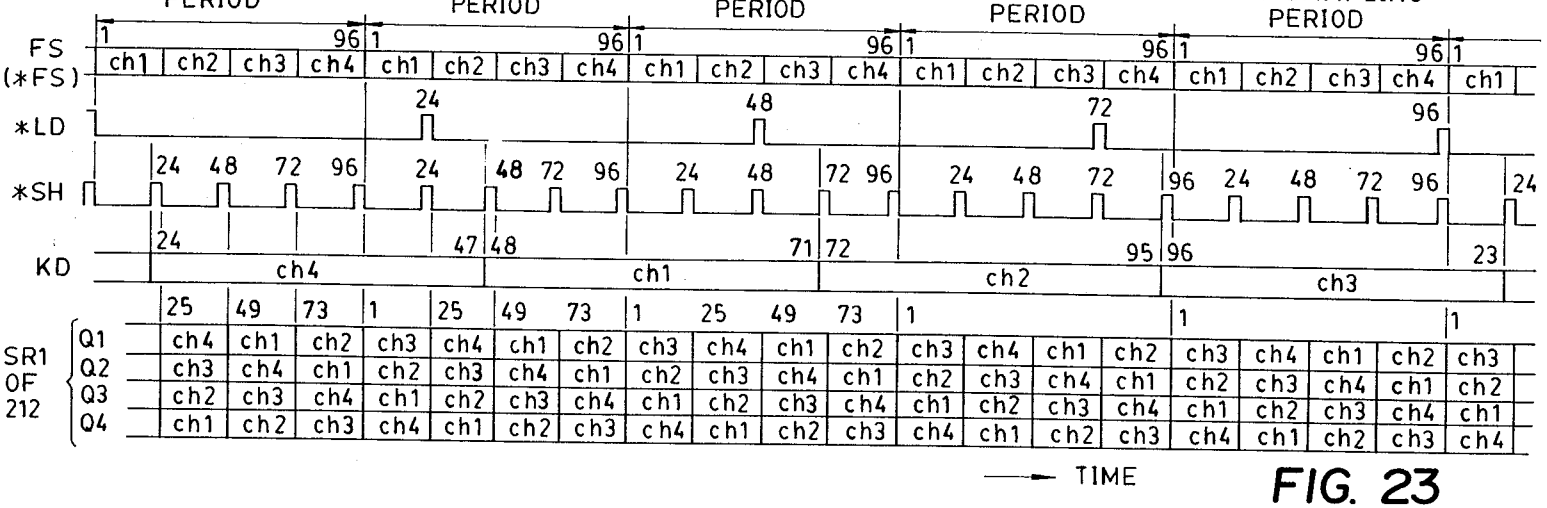
FIG. 23 is a time chart showing an example of states of signals in the first operation stage of the zero filter shown in FIG. 22.

States of the timing signals LD and SH applied to the first stage of the zero filter 43 are shown in the columns of *LD and *SH in FIG. 23. In the column of FS in FIG. 23, the channel timing of the tone signal FS outputted from the selector 87 (FIG. 13) is shown in the same manner as in FIG. 14. Since the signals LD and SH are respectively delayed by 8 time slots in the 12 units L1–L12 of the pole filter 42, signals obtained by delaying the signals LD and SH in FIG. 14 by 96 time slots are applied to the first stage of the zero filter 43. Accordingly, the timing signal LD which is of a period of 120 time slots assumes a state which is delayed by 96 time slots shown as *LD in FIG. 23 whereas the signal SH which is of a period of 24 time slots is virtually the same as SH in FIG. 14, as shown in the column of *SH in FIG. 23. The column of KD in FIG. 23 which shows the channel of the filter coefficient latched by the latch circuit (corresponding to 141 in FIG. 19) in the first stage coefficient distribution circuit 212 is the same as KD in FIG. 14 as described above. Accordingly, the channel states of outputs Q1–Q4 (FIG. 20) of the respective stages of the shift register SR1 for the least significant bit of the filter coefficient memory (corresponding to 144 in FIG. 19) in the first stage coefficient distribution circuit 212 assume those as shown in the column of "SR1 of 212" in FIG. 23. It will be understood that these states are the same as the states shown in the column of "SR1 of L1" in FIG. 14. As will be described above, the channel state of a serial tone signal *FS applied to an input terminal of the zero filter 43 is always the same as the channel state of the serial tone signal FS applied to the pole filter 42. Hence the timing of the serial operation in the first stage multiplier 73 in the zero filter 43 is synchronized with the serial operation timing of the multiplier 64 in the first stage unit L1 of the pole filter 42. This arrangement is advantageous because, as will be described later, it enables the combination of connection between the pole filter 42 and the zero filter 43 to be switched freely without taking the operation timing into account.

The tone signal *FS supplied to the input terminal ZSi of the zero filter 43 is applied to the input B of the adder 75 and the delay circuit 78 and also to the first stage 73 through the input point P1 (FIG. 19). The result of the multiplication corresponding to this tone signal *FS is outputted from the output point P6 (seen FIG. 19) with a delay of 32 time slots as was previously described. The serial tone signal outputted from the output point P6 is delayed by the delay circuit 77 by 64 time slots and thereafter is applied to the input A of the adder 75. This serial tone signal applied to the input A is delayed by 96 time slots (i.e., 1 sampling period) from the timing of the serial tone signal applied to the input B so that the serial tone signals of the same channel with bits of the same weight are added together by the adder 75. The carry output $C_{0+1}$ of the adder 75 is supplied to the carry input Ci through an AND gate 215. The AND gate 215 receives at another input thereof a signal which is obtained by delaying the signal $\overline{SH9}$ (see FIG. 21) outputted from the output point P7 (see FIG. 19) of the multiplier 73 by 64 time slots by a delay circuit 216. As was previously described, this signal SH9 is turned to "0" when the weight of the serial tone signal outputted from the output point P6 (OR gate 202 in FIG. 19) whose timing is shown in M out in FIG. 21 is the least significant bit. The delay circuit 216 is provided for synchronizing with the delay operation of the delay circuit 77 and the AND gate 215 is provided for preventing inputting to the carry input Ci of a carry out signal produced by the addition of the most significant bit of the preceding channel at a timing of addition of the least significant bit of a next channel.

To the input point P1 of the second stage multiplier 74 is applied the serial tone signal *FS which has been delayed by the delay circuit 78 by 128 time slots. For synchronizing the serial operation timing in the multipliers (i.e., synchronizing the channels and the weights of respective bits of the serial tone signals and filter coefficients to be multiplied with) in a case where serial multiplication is to be effected by employing the coefficient distribution circuit 139 and the multiplier 64 as shown in FIG. 19, the input timing of the serial tone signal must be delayed from the input timing of the preceding multiplier by 32 time slots, as will be apparent from the above description. Comparing the tone signal input timing of the second stage multiplier 74 with that of the first stage multiplier 73, the input timing of the second stage is delayed by 1 sampling period (96 time slots) and 32 time slots (totalling 128 time slots) by the delay circuit 78 and, therefore, the condition of the delay of 32 time slots is satisfied. Accordingly, synchronization of the serial operation timing is realized also in the second stage multiplier 74.

The serial tone signal, i.e., the result of the multiplication, outputted from the output point P6 of the second stage multiplier 74 (see FIG. 19) is applied to the input A of the adder A of the adder 76 after being delayed by the delay circuit 79 by 32 time slots. The output S of the adder 75 of the preceding stage is applied to the input B of the adder 76. In the same manner as was previously described, the signal $\overline{SH9}$ outputted from the output point P7 of the multiplier 74 (see FIG. 19) is delayed by a delay circuit 217 by 32 time slots in synchronism with the delay time of the delay circuit 79 and thereafter is applied to an AND gate 218. The AND gate 218 receives at the other input thereof the carry output $C_{0+1}$ of the adder 76 and its output in turn is applied to the carry input Ci. The delay circuit 217 and the AND gate 218 perform the same function as the above described 215 and 216. The delay circuit 79 is provided, as was previously described, for delaying the timing of the signal applied to the input A of the adder 76 from the timing of the input signal *FS by 2 sampling periods (192 time slots). By setting of delay of 128 time slots by the delay circuit 78, 32 time slots in the multiplier 74 and 32 time slots by the delay circuits 79, a delay of 192 time slots is provided.

The output signal of the adder 76 is delayed by the delay circuit 80 by 64 time slots and applied to the input point P1 of the multiplier 81. A serial tone signal is outputted from the output point P6 of the multiplier 81 at a timing 32 time slots later than the timing at the input point P1. This serial tone signal is applied to an output terminal ZS0 as an output tone signal Z0 of the zero filter 43. The delay circuit 80 is provided, for the same reason as was previously described, for setting a time delay of 32 time slots between the tone signal input timing of the second stage multiplier 74 and that of the third stage multiplier 81. Time delay of 32 time slots is set in the multiplier 74, 32 time slots by the delay circuit 79 and 64 time slots by the delay circuit 80, i.e., a total of 128 time slots is set. Since 128 time slots is 1 sampling period (96 time slots) and 32 time slots, a time delay of 32 time slots is virtually provided between the tone signal input timing of the second stage multiplier 74 and that of the third stage multiplier 81.

Comparing timings of the input signal *FS and the output signal Z0 of the zero filter 43, delay of 288 time slots in total is provided by a route of the delay circuit 78, multiplier 74, delay circuits 79 and 80 and multiplier 81. Since this time delay is 3 sampling periods, the timings of the input signal *FS and the output signal Z0 (i.e., timings of the channel and the weight of respective bits of the serial data) are in perfect synchronization. The output signal Z0 therefore is a serial tone signal in perfect synchronization with the signal FS in FIG. 14 or FIG. 23.

The timing of the serial tone signal outputted from the forward output terminal FS0 of the last stage unit L12 of the pole filter 42 is also in perfect synchronization with FS in FIG. 14. Since the tone signal is delayed by 32 time slots in each of the 12 stage units L1–L12, the total delay time amounts to 384 time slots which corresponds to 4 sampling periods and hence the timings of the serial tone signals at the forward input terminal FSi and the forward output terminal FS0 of the pole filter 42 are synchronized. As shown in FIG. 13, either the signal at the output terminal FS0 of the pole filter 42 or the serial tone signal Si outputted from the input control circuit 37 is selected by the selector 89 and supplied to the input terminal ZSi of the zero filter 43. Accordingly, the timing of the serial tone signal *FS applied to the zero filter 43 through the input terminal ZSi is always synchronized with FS in FIG. 14 as was previously described. Hence the timings (i.e., timings of the channels and the weights of respective bits of the serial data) of the serial tone signals $S_1$–$S_3$ applied from the input terminals $I_1$–$I_3$ of FIG. 13, the serial tone signals Si applied from the input control circuit 37, the serial tone signal FS applied from the selector 87 to the pole filter 42, the serial tone signal outputted from the output terminal of the pole filter 42, the serial tone signal *FS applied to the input terminal ZSi of the zero filter 43 and the serial tone signal Z0 outputted from the output terminal ZS0 of the zero filter 43 are all in synchronization as shown in the column of FS in FIG. 14 or FIG. 23.

Referring to FIG. 1, the digital filter section 14 may be constituted using a single digital filter chip or plural chips DFC as shown in FIG. 13. In FIG. 13, the combinations of connection of the pole filter 42 and the zero filter 43 in the digital filter chip DFC, feeding of the input signal to them and taking out the output signal therefrom are controlled by control codes C1 and C2 so as to have one of four states. Using one or more digital filter chips that are controlled so as to have a desired state according to the control codes C1 and C2, various combinations of the pole and zero filters may be realized.

The table 2 below shows an example of the four states of the digital filter chip DFC corresponding to the control codes C1 and C2.

TABLE 2

| C1 | C2 | Types of DFC | States |
|---|---|---|---|
| 0 | 0 | DFC-I | "pole only"<br>input Fi<br>output Fo |
| 1 | 0 | DFC-II | "zero → pole"<br>inputs $I_1$ to $I_3$<br>output Fo |
| 0 | 1 | DFC-III | "pole → zero"<br>input Fi<br>outputs $O_1$ to $O_3$ |
| 1 | 1 | DFC-IV | "pole → zero"<br>inputs $I_1$ to $I_3$<br>outputs $O_1$ to $O_3$ |

The "C1, C2" columns in the above table indicate truth values of the control codes C1 and C2. The "types of DFC" column indicates the identification codes of the digital filter code DFC corresponding to the respective states. The "states" column indicates the connection combinations of the pole filter 42 and the zero filter 43 and reference numbers of the output terminals used for inputting and outputting of the tone signal. "Pole only" means only the pole filter 42 is used, "zero→pole" means the zero filter 43 and pole filter 42 are serially connected so that the zero filter 43 precedes the pole filter 42 and "pole→zero" means the pole filter 42 and zero filter 43 are serially connected so that the pole filter 42 precedes the zero filter 43.

The control input of the selector 87 shown in FIG. 13 is supplied with the control codes C1 and C2. In accordance with the contents of these codes C1 and C2, one of the inputs A, B and C is selected as shown in the table 3 below.

TABLE 3

| | | Selector 87 | |
|---|---|---|---|
| C1 | C2 | Inputs to be selected | (Signals or terminals to be selected) |
| 0 | 0 | A | (Fi) |
| 1 | 0 | C | (Zo) |
| 0 | 1 | A | (Fi) |
| 1 | 1 | B | (Si) |

The B selection control input SB of the selector 88 is supplied with the control code C2 while the A selection control input SA is supplied with the inverted signal of the code C2. Similarly the selection control input of the selector 89 is supplied with the code C2 while the selection control input SA is supplied with the inverted signal of the code C2.

Where C1="0" and C2="0", by way of example, the input A is selected in the selector 87 as shown in Table 3 above and the tone signal supplied from the outside to said input A through the input terminal Fi is outputted from said selector 87 and applied as signal FS to the forward input terminal FSi of the pole filter 42. In the selector 88, the input A is selected in response to "0" of the code C2 and the signal supplied from outside to said input B through the input terminal Bi is outputted from said selector 88 and applied to the backward input terminal BSi of the pole filter 42. In the selector 89, the input A is selected in response to "0" of C2 and the serial tone signal Si is inputted to the zero filter 43 but, since the output signal Zo of the zero filter 43 is prohibited by the output control circuit 39 and not selected by the selector 87, the zero filter 43 is virtually not used. In the output control circuit 39, the AND gates 124 to 126 are disabled all the time in response to "0" of the code C2 so that the AND gates 90 to 92 are disabled all the time to prohibit the zero filter output signal Z0. Accordingly, the digital filter chip DFC is in the state wherein the serial tone signal supplied from outside through the input terminal Fi is passed to the pole filter 42 whose output signal is outputted to the outside through the output terminal Fo so that the zero filter 43 is virtually not used. The chip DFC in this state is indicated as "DFC-I" as in Table 2 and consists of a 12-stage lattice-type pole filter 42 only. The backward input terminal BSi of the last filter unit L12 is provided with the signal supplied from outside through the input terminal Bi rather than the output of its own forward output terminal FS0 that has passed through the delay circuit 72. This means that only the pole filter 42 does not complete the filter system but a lattice-type filter is further added at a post stage (to the terminals Fo and Bi).

Where C1="1" and C2="0", the selector 87 selects the input C as shown in Table 3 above and supplies the output signal Zo of the zero filter 43 as signal FS to the input terminal FSi of the pole filter 42. In response to "0" of C2, the selector 88 selects the input A and, as mentioned above, applies the signal which is supplied from outside through the terminal Bi to the backward input terminal BSi of the pole filter 42. In response to "0" of C2, the selector 89 selects the input A so that the serial tone signal Si supplied from the input control circuit 37 is applied to the input terminal ZSi of the zero filter 43 through said selector 89. In response to "0" of C2, the output control circuit 39 precludes the zero filter output signal Zo from being led to the output terminals $O_1$ to $O_3$ as in the case mentioned before. Accordingly, the digital filter chip is in the state wherein the serial tone singal Si supplied from the input terminals $I_1$ to $I_3$ throught the input control circuit 37 is passed to the zero filter 43 through the selector 89, the output signal Zo of the zero filter 43 is passed through the selector 87 to the pole filter 42 and the output signal of the pole filter 42 is outputted to the outside through the output terminal Fo. That is, the zero filter 43 and the pole filter 42 are so connected that the zero filter 43 precedes the pole filter 43 as in the "DFC-II" type of Table 2. However, the backward input terminal BSi of the last filter unit L12 of the pole filter 42 is supplied with the signal from the terminal Bi rather than the delay circuit 72 as in the previous case. Accordingly, the lattice-type filter is further added at a post stage (to the terminals Fo and Bi) in this case also.

Where C1="0" and C2="1", the selector 87 selects the input A as shown in Table 3 and applies the serial tone signal supplied from outside through the input terminal Fi to the pole filter 42 as signal FS. In response to "1" of C2, the selector 88 selects the input B and applies to the backward input terminal BRi of the pole filter 42 the signal obtained by delaying the output signal of its own forward output terminal FSo by 32 time slots through the delay circuit 72. In response to "1" of C2, the selector 89 selects and applies to the zero filter 43 the seial tone signal that was supplied from the output terminal FSo of the pole filter 42 through the input B. In the output control circuit 39, the AND gates 124 to 126 are enabled in response to "1" of C2 and, as mentioned above, the AND gate 90 to 92 are enabled in response to the filter enable signals FE1 to FE3 so as to distribute the output signal Zo of the zero filter 43 among the output terminals $O_1$ to $O_3$. Accordingly, the digital filter chip DFC is in the state wherein the serial tone signal supplied from outside through the input terminal Fi is passed through the selector 87 to the pole filter 42 whose output signal is passed through the selector 89 to the zero filter 43 on one hand and returned to its own backward input terminal BSi through the delay circuit 72 and selector 88 on the other and the output signal Zo of the zero filter 43 is distributed among the output terminals $O_1$ to $O_3$ for the respective subchannels through the output control circuit 39. In other words, this is the state in which the pole filter 42 is connected to the zero filer 43 so as to precede it and the tone signal is supplied from the input terminal Fi and outputted from the output terminals $O_1$ to $O_3$ as in "DFC-III" in Table 2.

Where C1="1" and C2="1", the selector 87 selects the input B as shown in Table 3 and outputs the serial tone signal Si that is supplied from the input terminals $I_1$ to $I_3$ through the input control circuit 37 and applies this signal Si to the pole filter 42 as signal FS. As in the previous case, the selectors 88 and 89 select the input B in response to "1" of C2. The output control circuit 39, as in the previous case, distributes the output signal Zo of the zero filter 43 among the output terminals $O_1$ to $O_3$ according to the signal FE1 to FE3. Thus the digital filter chip DFC is in the state in which the serial tone signal Si supplied from the input terminals $I_1$ to $I_3$ through the input control circuit 37 is applied through the selector 87 to the pole filter 42 whose output signal is applied through the selector 89 to the zero filter 43 on one hand and returned to its own backward input terminal BSi on the other whereas the output signal Zo of the zero filter 43 is distributed among the output termianls $O_1$ to $O_3$ of the respective channels for outputting. In other words, this is the state in which, as in "DFC-IV" in Table 2, the pole filter 42 is connected to the zero filter 43 so as to precede it and the tone signal is applied from the input terminals $I_1$ to $I_3$ and outputted from the output terminals $O_1$ to $O_3$.

In the above DFC-I and DFC-II types of the digital filter chips, since the code C2="0", the AND gates 133, 134 and 135 in the output control circuit 39 are enabled all the time. Accordingly, all the serial tone signals applied to the input terminals $I_1$ to $I_3$ are always led to the output terminals $O_1$ to $O_3$ through the AND gates 133 to 135 and OR gates 136 to 138. In the DFC-III and DFC-IV types, on the other hand, since the code C2="1", only those serial tone signals of the subchannels not to be passed through the filter are led to the output terminals $O_1$ to $O_3$ through the AND gates 133 to 135 and OR gates 136 to 138 according to the filter enable signals FE1 and FE3 as mentioned above.

As shown in FIG. 13, a control code generator 219 is provided in connection with the digital filter chip DFC to generate and supply the codes C1 and C2 to the selectors 87 to 89 and AND gates 124 to 126. The generator 219 may be constituted, for example, by ROM so that the truth values of the generated codes C1 and C2 are fixed according to the use (types DFC-I to DFC-IV) of the chips DFC. Alternatively, the truth values of the generated codes C1 and C2 may be freely selected in response to the switch output signal and the like added from outside as address input. Alternatively, desired control codes C1 and C2 may be directly supplied from outside.

Figure 24A:
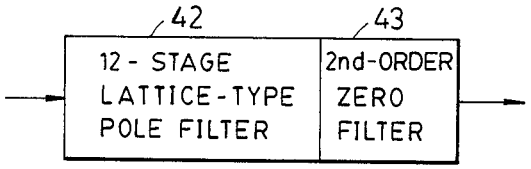
FIG. 24(*a*) is a block diagram showing an example of combination of connection between the pole filter and the zero filter.
Figure 24B:
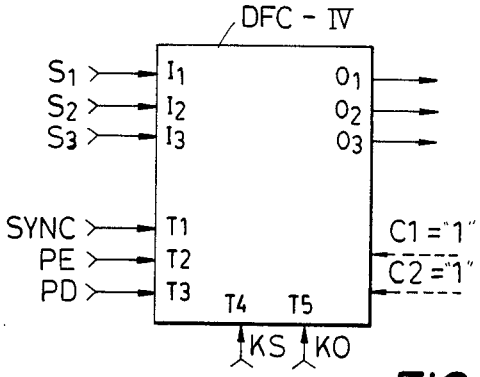
Figure 25A:
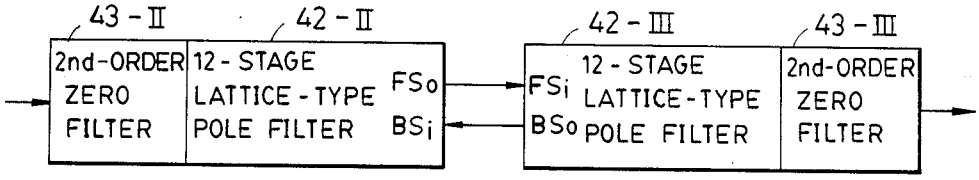
FIG. 25(*a*) is a block diagram showing another example of combination of connection between the pole filter and the zero filter in the digital filter section in FIG. 1.
Figure 25B:
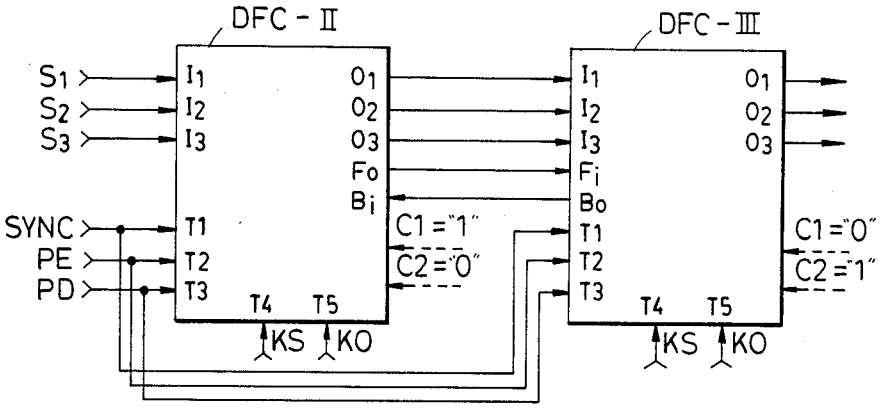

Now some examples of the digital filter section 14 consisting of one or more digital filter chips DFC will be described.

Where the filter structure in the digital filter section 14 is such as shown in FIG. 24(*a*), a single DFC-IV type digital filter chip DFC is used as shown in FIG. 24(*b*). Where, as mentioned above, the chip DFC is of DFC-IV type, the pole filter 42 precedes the zero filter 43 as shown in FIG. 24(*a*) and the tone signal supplied from the input terminals $I_1$ to $I_3$ is inputted to the pole filter 42 through the input control circuit 37 whereas the output signal of the zero filter 43 is outputted from the output terminals $O_1$ to $O_3$. FIG. 24(*b*) only shows the terminals $I_1$ to $I_3$, $O_1$ to $O_3$ and T1 to T5 connected with outer circuits. Accordingly, the terminals Fi, Fo, Bi and Bo (see FIG. 13) which are not shown are not connected with any circuits where a single DFC is used. FIG. 24(*b*) shows the truth values of the control codes C1 and C2 for the DFC-IV type. The inputs of C1 and C2 are indicated by dotted arrows in FIG. 24(*b*) meaning that they may be applied from outside as mentioned before. FIGS. 25(*b*) and 26(*b*) are drawn in like manner. In this single type DFC-IV, the filter consists of a 12-stage lattice-type pole filter (42) and a 2nd-order zero filter (43) serially connected, obtaining a corresponding filter characteristic.

Where the filter structure is such as shown in FIG. 25(*a*), the digital filter section 14 is constituted using two digital filter chips of DFC-II and DFC-III type as shown in FIG. 25(*b*). As previously mentioned, the zero filter 43 precedes the pole filter 42 with the tone signal input terminals being $I_1$ to $I_3$ and output terminals Fo in DFC-II type, whereas the pole filter 42 precedes the zero filter 43 with the tone signal input terminal being Fi and output terminals $O_1$ to $O_3$ in DFC-III type. Accordingly, the output terminal Fo of the DFC-II type is connected to the input terminal Fi of the DFC-III type, the input terminal Bi of the DFC-II type to the output terminal Bo of the DFC-III type and the output terminals $O_1$ to $O_3$ of the DFC-II type for the respective subchannels to the input terminals $I_1$ to $I_3$ of the DFC-III as shown in FIG. 25(*b*). Thus the second-order zero filter 43-II, 12-stage lattice-type pole filter 42-II, 12-stage lattice-type pole filter 42-III, the second-order zero filter 43-III are serially connected in this order as shown in FIG. 25(*a*). The connection of the terminals Fo and Bi of the DFC-II to the terminals Fi and Bo of the DFC-III realizes the connection of the output terminal FSo and input terminal BSi of the prior-stage pole filter 42-II (i.e. of DFC-II) to the input terminal FSi and output terminal BSo of the post-stage pole filter 42-III (i.e. of DFC-III). This is because in the DFC-II type, the signal of the terminal Bi is applied to the terminal BSi whereas the output signal of the terminal FSo delayed by 32 time slots through the delay circuit 72 is not allowed to be applied to the terminal BSi by the selector 88 (see FIG. 13) as mentioned earlier. As a result a 24-stage lattice-type pole filter is virtually constituted by the pole filters 42-II and 42-III.

Figure 26A:
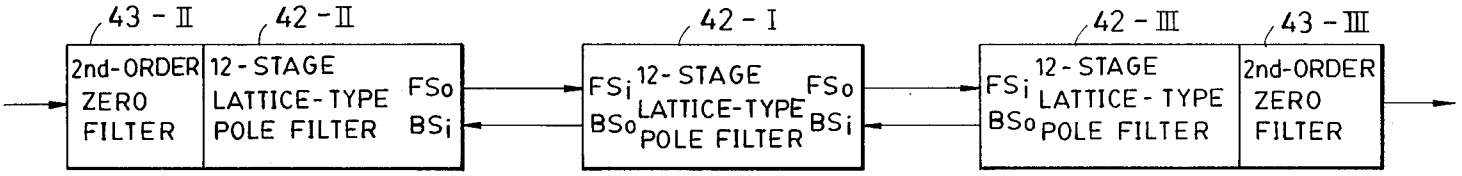
FIG. 26(*a*) is a block diagram showing another example of combination of connection between the pole filter and zero filter in the digital filter section shown in FIG. 1.
Figure 26B:
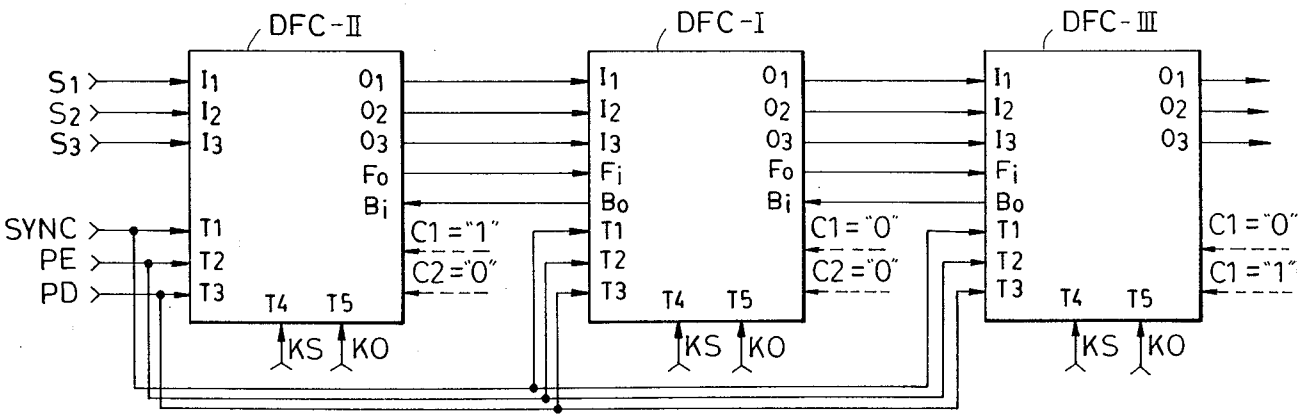

It is known that the lattice-type filter realizes a frequency characteristic having more peaks (poles) in proportion to the number of the stages of the filter. Similarly more valleys (zero) can be obtained by increasing the number of order (stages) of the zero filter. Therefore, the combination shown in FIG. 25 enables a more complicated frequency characteristic to be set and controlled than that shown in FIG. 24 by the 24-stage lattice-type pole filters 42-II, 42-III and fourth-order zero filters constructed by zero filters 43-II and 43-III.

Where the filter structure is such as shown in FIG. 26(*a*), the digital filter section 14 is constituted by three digital filter chips DFC of DFC-II, DFC-I and DFC-II types as shown in FIG. 26(*b*), wherein the DFC-I type is provided between the DFC-II and DFC-III types described in FIG. 25(*b*). As mentioned above, in the DFC-I type only the pole filter 42 is used and the terminal Fi is used as the tone signal input terminal and Fo as the output terminal. Accordingly, the output terminal Fo of the DFC-II type is connected to the input terminal Fi of the DFC-I type, the output terminal Bo of the DFC-I type to the input terminal Bi of the DFC-II type and the terminals Fo and Bi of the DFC-I type to the terminals Fi and Bo of the DFC-III type as shown in FIG. 25(*b*). The output terminals $O_1$ to $O_3$ of the DFC-II type for the respective subchannels are connected to the input terminals $I_1$ to $I_3$ of the DFC-I type whereas the output terminals $O_1$ to $O_3$ of the DFC-I type to the input terminals $I_1$ to $I_3$ of the DFC-III type. Thus, as shown in FIG. 26(*a*), second-order zero filter 43-II, 12-stage lattice-type pole filter 42-II, 12-stage lattice-type pole filter 42-I, 12-stage lattice-type pole filter 42-III and second-order zero filter 43-III are serially connected in this order.

The connections of the terminals Fo and Bi of the DFC-II to the terminals Fi and Bo of the DFC-I and the terminals Fo and Bi of the DFC-I to the terminals Fi and Bo of the DFC-III realize the connections of the terminals FSo and BSi of the post-stage pole filter 42-II to the terminals FSi and BSo of the middle-stage pole filter 42-I and the terminals FSo and FSi of the middle-stage pole filter 42-I to the terminals FSi and BSo of the post-stage pole filter 42-III. The reason therefor will be obvious from the descriptions given with reference to the respective types DFC-I, II and III. As a result, a 36-stage lattice-type pole filter is virtually constituted by three 12-stage lattice-type filters 42-II, 42-I and 42-III. Accordingly, the combination shown in FIGS. 26(*a*) and (*b*) enables a more complicated frequency characteristic to be set and controlled than that shown in FIGS. 25 (*a*) and (*b*).

In FIGS. 26 (*a*) and (*b*), more than one middle-stage DFC-I type digital filter chip may be provided. Thus the stages of the lattice-type pole filter is increased further, enabling a more complicated frequency characteristic to be set and controlled.

In FIGS. 25(*b*) and 26(*b*), the output terminals $O_1$ to $O_3$ for the respective subchannels and the input terminals $I_1$ to $I_3$ are sequentially connected between the digital filter chips DFC. This enables the serial tone signal that is not passed through the filter to be led from the first chip DFC-II through the last chip DFC-III.

Where a plurality of digital filter chips DFC (DFC-I, II and III) are used as shown in FIGS. 25(*b*) and 26(*b*), it is effective to provide these chips with different filter coefficients in order to vary the frequency control characteristics among these chips. For that purpose, the memory contents of the filter coefficient ROM 97 (see FIG. 13) provided in these chips may be varied from each other, the filter coefficients KO supplied from outside may be varied from each other and the like. Also, filter coefficients KO supplied may be used for one or more of the plural digital filter chips DFC (DFC-I, II and III) constituting the digital filter section 14 and inner filter coefficients for the remaining chips.

It is possible to realize a different combination of connection between the pole filter 42 and zero filter 43 than is mentioned above by altering the manner in which the selection circuits or gates (the selectors 87, 88, 89, etc.) is provided inside the digital filter chip DFC. This will also enable a different combination of plural digital filter chips DFC to be realized. For example, it is possible to realize a connection whereby a single zero filter 43 is used in the chip DFC and it is further possible to constitute a multiple-stage zero filter by serially connecting a plurality of such single-zero-filter type digital filter chips DFC.

What is claimed is:

1. A digital filter for an electronic musical instrument comprising:

A digital type pole filter capable of controlling a peak in an amplitude-frequency characteristic; and a digital type zero filter coupled with said pole filter and capable of controlling a valley in an amplitude-frequency characteristic, a digital tone signal being applied to said digital filter imparting the tone color determined by the amplitude frequency characteristics of both said pole filter and said zero filter.

2. A digital filter for an electronic musical instrument as defined in claim 1 wherein said pole filter comprises an infinite impulse response filter and said zero filter comprises finite impulse response filter.

3. A digital filter for an electronic musical instrument as defined in claim 2 wherein said pole filter comprises a lattice-type filter.

4. A digital filter for an electronic musical instrument as defined in claim 3 wherein said pole filter comprises a plurality of filter units sequentially connected in series through forward outputs and inputs, and backward outputs and inputs of respective adjacent filter units;

each of said filter units comprises a first delay circuit for delaying a signal provided by its backward input by a predetermined time, a first adder for subtracting a digital tone signal applied from its forward input from an output signal of said first delay circuit, a multiplier for multiplying an output signal of said first adder with a filter coefficient, a second delay circuit for delaying the signal applied from said forward input by a period of time corresponding to an operation time delay in said multiplier, a second adder for adding an output signal of said multiplier and an output signal of said second delay circuit together and applying its addition output to its forward output, a third delay circuit for delaying the output signal of said first delay circuit by the period of time corresponding to the operation time delay in said multiplier, and a third adder for adding an output signal of said third delay circuit and the output signal of said multiplier together and applying its addition output to its backward output, the delay time in said first delay circuit being time obtained by subtracting twice the operation time delay in said multiplier from one sampling period of the digital tone signal; and said zero filter comprises finite impulse response filter operation stages of plural orders and an operation stage for gain adjusting connected in series to said filter operation stages.

5. A digital filter for an electronic musical instrument as defined in claim 1 wherein said pole filter and said zero filter are serially connected to each other.

6. A digital filter for an electronic musical instrument as defined in claim 5 wherein the pole of said pole filter is controlled in correspondance to a substantially central position of a peak-like pass band in fixed formant to be realized and zero of said zero filter is controlled in correspondence to a substantially central position of a valley-like stop band in said fixed formant.

7. A digital filter according to claim 1 wherein said digital filter imparts a tone color characterized by a certain formant having a peak and a valley at respective separate frequencies, and wherein said pole filter is selected to exhibit a peak at the frequency of the peak in said certain formant and said zero filter is selected to exhibit a zero at the frequency of the valley in said certain formant.

8. A digital filter system for an electronic musical instrument comprising:

a plurality of digital filters of different constructions; and connection switching means for setting a combination of connections between said digital filters and for switching said combination of connections in response to a selection signal, a digital tone signal being applied to said digital filter system imparting the tone color determined by the combination of connections set by said connection switching means.

9. A digital filter system for an electronic musical instrument as defined in claim 8 wherein said connection switching means comprises a plurality of selectors provided on input sides of said respective digital filters for selectively applying one of outputs of said digital filters or said digital tone signal applied to said digital filter system to an input of a corresponding one of said digital filters.

10. A digital filter system for an electronic musical instrument as defined in claim 9 wherein at least one of said digital filters comprises a filter of a type having a forward input, a forward output, a backward input and a backward output and said filter of this type includes said selectors in correspondence to said forward input and said backward input.

11. A digital filter system for an electronic musical instrument comprising:

a plurality of digital filters of different constructions; and connection switching means capable of setting a combination of connections between said digital filters and selectively switching said combination of connections in response to a selection signal;

a digital tone signal applied to said digital filter system being imparted with a tone color determined by the combination of connections set by said connection switching means, and wherein;

at least one of said digital filters is a pole filter capable of controlling a peak in an amplitude-frequency characteristic and at least one of said digital filters is a zero filter capable off controlling a valley in an amplitude-frequency characteristic; and wherein said determined tone color is characterized by a format having both a peak established by said at least one pole filter and a valley established by said at least one zero filter.

12. A digital filter system for an electronic musical instrument as defined in claim 11 wherein said digital filters comprise one pole filter of said type and one zero filter of said type and said connection switching means is at least capable of selectively switching the combination of connections to either a first combination in which the output of said pole filter is applied to said zero filter, a second combination in which the output of said zero filter is applied to said pole filter or a third combination in which said pole filter alone is used.

13. A digital system for an electronic musical instrument as defined in claim 12 wherein said pole filter consists of a lattice-type filter, said digital filter system has a first input terminal to which said digital tone signal is applied, a second input terminal corresponding to a forward input of said lattice-type pole filter and a third input terminal corresponding to a backward input of said lattice-type pole filter, said first combination includes a state in which a signal of said first input terminal is used as a forward input signal to said lattice-type pole filter and a state in which a signal of said second input terminal is used as the forward input signal to said lattice-type pole filter, and said connection switching means is capable of switching, in accordance with the selected combination, between a state in which the forward output is connected to the backward input of said lattice-type pole filter or a state in which said third input terminal is connected to the backward input of said lattice-type pole filter.

14. A digital filter system for an electronic musical instrument comprising a plurality of digital filter composites, each of said digital filter composites comprising a plurality of digital filters of different constructions and connection switching means for of setting a combination of connections between said digital filters and for switching said combination of connections in response to a selection signal, said digital filter composites being coupled to each other and the combination of connections between said digital filters being selected for each of said filter composites by said connection switching means within said respective filter composites and a filter construction as a whole being determined by assembly of these combinations.

15. A digital filter system for an electronic musical instrument as defined in claim 14 wherein said digital filters comprise a pole filter capable of controlling a peak in an amplitude-frequency characteristic and a zero filter capable of controlling a valley in the amplitude-frequency characteristic, said filter composites comprise a first filter composite having a combination of connections in which said zero filter is provided in a forward stage and said pole filter is provided in a post stage and a second filter composite having a combination of connections in which said pole filter is provided in a forward stage and said zero filter is provided in a post stage.

16. A digital filter system for and electronic musical instrument as defined in claim 15 wherein one or more third filter composites having a combination of connections in which said pole filter alone is used are serially inserted between said first filter composite and said second filter composite.

17. A digital filter system for an electronic musical instrument as defined in claim 15 wherein said pole filter comprises a lattice-type filter having a forward input, a forward output, a backward input and backward output.

18. A digital filter system for an electronic musical instrument as defined in claim 16 wherein said pole filter comprises a lattice-type filter having a forward input, a forward output, a backward input and backward output.

19. An electronic musical instrument comprising:

keyboard means having a plurality of keys;

tone signal generating means for generating a digital tone signal corresponding to a depressed key among said keys;

tone color setting means for setting a tone color of a tone to be produced;

filter coefficient generating means for generating filter coefficients corresponding to said set tone color;

digital filtering means, connected to said tone signal generating means and said filter coefficient generating means, and including a pole filter capable of controlling a peak in an amplitude-frequency characteristic and a zero filter capable of controlling a valley in an amplitude-frequency characteristic respectively provided in a transmission path of the digital tone signal, said filter coefficients for controlling said peak being applied to said pole filter and said filter coefficients for controlling said valley being applied to said zero filter;

digital-to-analog converting means for converting said filtered digital tone signal to an analog one; and sound means for producing a tone corresponding to said converted tone signal, said set tone color being imparted to said tone.

20. A electronic musical instrument comprising:

keyboard means having a plurality of keys;

tone signal generating means for generating a digital tone signal corresponding to a depressed key among said keys;

tone color setting means for setting a tone color of a tone to be produced;

filter coefficient generating means for generating filter coefficients corresponding to said set tone color;

digital filtering means connected to said tone signal generating means and said filter coefficient generating means, including a plurality of digital filters of different constructions and connection switching means for of setting a combination of connections between said digital filters and for switching said combination of connections in response to a selection signal, and filtering the digital tone signal with characteristics determined by the combination of connections of the digital filters set by said connection switching means and said filter coefficients;

digital-to-analog converting means for converting said filtered digital tone signal to analog one; and sound means for producing a tone corresponding to said converted analog tone signal, said set tone color being imparted to said tone.

* * * * *